US009110438B2

(12) United States Patent
Kubo et al.

(10) Patent No.: US 9,110,438 B2
(45) Date of Patent: Aug. 18, 2015

(54) FLANGE MEMBER, PHOTOSENSITIVE DRUM, PROCESS CARTRIDGE, IMAGE FORMING APPARATUS, AND IMAGE FORMING METHOD

(75) Inventors: Daisuke Kubo, Shizuoka (JP); Keiichi Yano, Shizuoka (JP); Akira Nakamura, Shizuoka (JP); Yoko Arai, Shizuoka (JP)

(73) Assignee: RICOH COMPANY, LTD., Tokyo (JP)

( * ) Notice: Subject to any disclaimer, the term of this patent is extended or adjusted under 35 U.S.C. 154(b) by 91 days.

(21) Appl. No.: 13/881,636

(22) PCT Filed: Nov. 10, 2011

(86) PCT No.: PCT/JP2011/076459
§ 371 (c)(1),
(2), (4) Date: Apr. 25, 2013

(87) PCT Pub. No.: WO2012/063962
PCT Pub. Date: May 18, 2012

(65) Prior Publication Data

US 2013/0230338 A1 Sep. 5, 2013

(30) Foreign Application Priority Data

Nov. 12, 2010 (JP) ..... 2010-254183
Nov. 12, 2010 (JP) ..... 2010-254187

(51) Int. Cl.
*G03G 15/00* (2006.01)
*G03G 21/18* (2006.01)

(52) U.S. Cl.
CPC ..... *G03G 21/18* (2013.01); *G03G 15/751* (2013.01); *G03G 15/757* (2013.01)

(58) Field of Classification Search
CPC ..... G03G 15/751; G03G 21/1647
USPC ..... 399/117, 116, 159
See application file for complete search history.

(56) References Cited

U.S. PATENT DOCUMENTS 4,126,388 A * 11/1978 Kawai ..... 355/1
5,913,494 A * 6/1999 Burbridge et al. ..... 244/213
6,167,219 A * 12/2000 Miyamoto et al. ..... 399/90
6,336,017 B1 1/2002 Miyamoto et al.
6,516,169 B2 2/2003 Niimi et al.

(Continued)

FOREIGN PATENT DOCUMENTS

JP 41-013369 U 6/1966
JP 01-136959 U 9/1989

(Continued)

OTHER PUBLICATIONS

International Search Report Issued Dec. 27, 2011 in PCT/JP2011/076459 Filed on Nov. 10, 2011.

*Primary Examiner* — Ryan Walsh
*Assistant Examiner* — Philip Marcus T Fadul
(74) *Attorney, Agent, or Firm* — Cooper & Dunham LLP

(57) ABSTRACT

A disclosed flange member includes a press-fitted portion to be press-fitted in an axial end-opening portion of a hollow and cylindrical sleeve member; an axle opening portion including an axle opening into which a shaft member is inserted when the press-fitted portion is press-fitted in the end-opening portion; and a linking portion extending in a direction parallel to a circular cross section of the sleeve member and connecting the axle opening portion to the press-fitted portion. The linking portion includes a stress-absorbing portion that is deformed so as to absorb stress to which an outer peripheral surface of the press-fitted portion is subjected upon contact with an inner peripheral surface of the sleeve member when the press-fitted portion is press-fitted in the end-opening portion, thus preventing the stress from being transmitted to the axle opening portion via the linking portion.

14 Claims, 57 Drawing Sheets

(56) References Cited

U.S. PATENT DOCUMENTS

| | | | | |
|---|---|---|---|---|
| 6,803,162 | B2 | 10/2004 | Niimi | |
| 7,680,435 | B2 | 3/2010 | Kusano | |
| 2007/0172253 | A1* | 7/2007 | Kusano | 399/117 |
| 2012/0321348 | A1* | 12/2012 | Toriu et al. | 399/159 |

FOREIGN PATENT DOCUMENTS

| | | | |
|---|---|---|---|
| JP | 02-007676 | U | 1/1990 |
| JP | 03-109406 | | 5/1991 |
| JP | 05-015068 | U | 2/1993 |
| JP | 08-123251 | | 5/1996 |
| JP | 10-288917 | | 10/1998 |
| JP | 11-249494 | | 9/1999 |
| JP | 2000-206723 | | 7/2000 |
| JP | 2001-034001 | | 2/2001 |
| JP | 2002-148904 | | 5/2002 |
| JP | 2002-148905 | | 5/2002 |
| JP | 2003-239948 | | 8/2003 |
| JP | 2004-117377 | | 4/2004 |
| JP | 2007-226169 | | 9/2007 |

* cited by examiner

FLANGE MEMBER, PHOTOSENSITIVE DRUM, PROCESS CARTRIDGE, IMAGE FORMING APPARATUS, AND IMAGE FORMING METHOD

TECHNICAL FIELD

The present invention relates to a flange member that can be used in a photosensitive drum of an image forming apparatus of an electrophotography type, such as copy machines, printers, and facsimile machines. The present invention also relates to a photosensitive drum, a process cartridge, and an image forming apparatus, each of them including the flange member.

The present invention also relates to an image forming method involving the photosensitive drum including the flange member.

BACKGROUND ART

There is an increasing demand for higher image qualities in image forming apparatuses, such as copy machines, laser printers, and facsimile machines. Particularly, in full-color printing applications, there is the problem of image displacement in multi-color images.

A photosensitive drum used for forming an image by an electrophotographic technology is typically subjected to the processes of charging, latent image formation and development, image transfer, and cleaning by various units disposed around the photosensitive drum while the photosensitive drum is rotated. In order to achieve high image quality, an entire surface of the photosensitive drum needs to be uniformly charged and developed under uniform developing conditions.

Because the photosensitive drum is rotated during such processes, the photosensitive drum is required to have a high runout accuracy (which indicates the amount of variation in the distance between a rotation center and a peripheral surface of the photosensitive drum). Generally, the photosensitive drum includes a cylindrical base of a metal, such as aluminum. On an outer peripheral surface of the cylindrical base, a photosensitive layer is provided. The cylindrical base with the photosensitive layer formed thereon may be referred to as a "sleeve member". Further, flange members are attached to end-opening portions at the ends of the sleeve member in the axial direction thereof.

The photosensitive drum is supported by, and rotated with respect to, an apparatus main body via the flange members and a shaft member engaged in axle openings provided in the flange members. Thus, the flange members need to be accurately and securely attached to the end-opening portions of the sleeve member. In order to achieve a smooth and accurate rotation of the photosensitive drum, the axle openings in the flange members need to be aligned with the central axis of the sleeve member at all times. Further, in order to allow the photosensitive drum to be rotated smoothly and without error, the flange members need to be prevented from idly rotating with respect to the sleeve member or being detached therefrom. For these purposes, the sleeve member and the flange members are typically assembled by press fitting (in combination with an adhesive, as needed).

In comparison with the base of the sleeve member, the flange members generally have lower rigidity. As a result, the flange members may be deformed at the time of press fitting, resulting in the deformation or displacement of the axle openings of the flange members. Specifically, the flange member includes a press-fitted portion that is press-fitted in the end-opening portion of the sleeve member, an axle opening portion including the axle opening, and a linking portion that extends in a direction parallel to a circular cross section of the sleeve member upon press fitting. The linking portion links the axle opening portion with the press-fitted portion. When the press-fitted portion is press-fitted in the end-opening portion of the sleeve member, an outer peripheral surface of the press-fitted portion that contacts an inner peripheral surface of the end-opening portion is subjected to stress from the inner peripheral surface of the sleeve member. When the stress is transmitted from the press-fitted portion via the linking portion to the axle opening portion, the axle opening in the axle opening portion is deformed or displaced.

When the axle opening is deformed or displaced, the position of the axle opening of the flange member with respect to the central axis of the sleeve member is displaced, thereby decreasing the runout accuracy. It has been difficult to manufacture the photosensitive drum having a high runout accuracy in a stable manner.

Japanese Laid-open Utility Model Publication 01-136959 ("Patent Document 1") discusses a flange member having an elastic structure. However, the stress absorbing capacity of this elastic structure is not very high, so that the axle opening may be readily deformed or displaced, resulting in low runout accuracy. Further, the structure of Patent Document 1 includes areas where the sleeve member and the flange member are not in close contact with each other, resulting in the problem of idle rotation or detachment.

Japanese Laid-open Patent Publication No. 08-123251 ("Patent Document 2") or Japanese Laid-open Patent Publication No. 10-288917 ("Patent Document 3") discloses a flange structure in which the linking portion includes straight ribs and opening portions between the ribs. By providing the opening portions, when the outer peripheral surface of the press-fitted portion is subjected to stress from the inner peripheral surface of the sleeve member, the stress can be absorbed by deformation of the linking portion around the opening portions. In this way, the deformation or displacement of the axle opening due to the stress applied to the axle opening portion can be prevented.

However, in the disclosures of Patent Documents 2 and 3, the ribs linking the press-fitted portion and the axle-opening portion are straight-shaped. Thus, when the stress is applied to the straight ribs in a direction along the length of the ribs, the stress is not absorbed by the opening portions upon press fitting but instead directly transmitted to the axle opening portion. As a result, the axle opening is deformed or displaced, resulting in a decrease in the runout accuracy.

The above problems may arise not just in the flange members attached to the sleeve member for the photosensitive drums, but also in the case of any flange member that is press-fitted in an end-opening portion of a cylindrical member.

DISCLOSURE OF INVENTION

In view of the foregoing problems of the related art, it is an object of the present invention to provide a flange member capable of reliably preventing the deformation or displacement of the axle opening of the flange member upon press fitting into the sleeve member, and a photosensitive drum, a process cartridge, and an image forming apparatus each of them including the flange member.

Another object of the present invention is to provide an image forming method involving the use of the photosensitive drum.

According to one aspect, there is provided a flange member that includes a press-fitted portion configured to be press-fitted in an end-opening portion at an end of a hollow and cylindrical sleeve member in an axial direction of the sleeve member; an axle opening portion including an axle opening into which a shaft member is inserted at a position corresponding to a central axis of the sleeve member when the press-fitted portion is press-fitted in the end-opening portion; and a linking portion extending in a direction parallel to a circular cross section of the sleeve member upon press fitting of the flange member, the linking portion connecting the axle opening portion to the press-fitted portion. The linking portion includes a stress-absorbing portion configured to be deformed so as to absorb a stress to which an outer peripheral surface of the press-fitted portion is subjected upon contact with an inner peripheral surface of the sleeve member when the press-fitted portion is press-fitted in the end-opening portion, thus preventing the stress from being transmitted to the axle opening portion via the linking portion.

BEST MODE OF CARRYING OUT THE INVENTION

Embodiment 1

Figure 2:
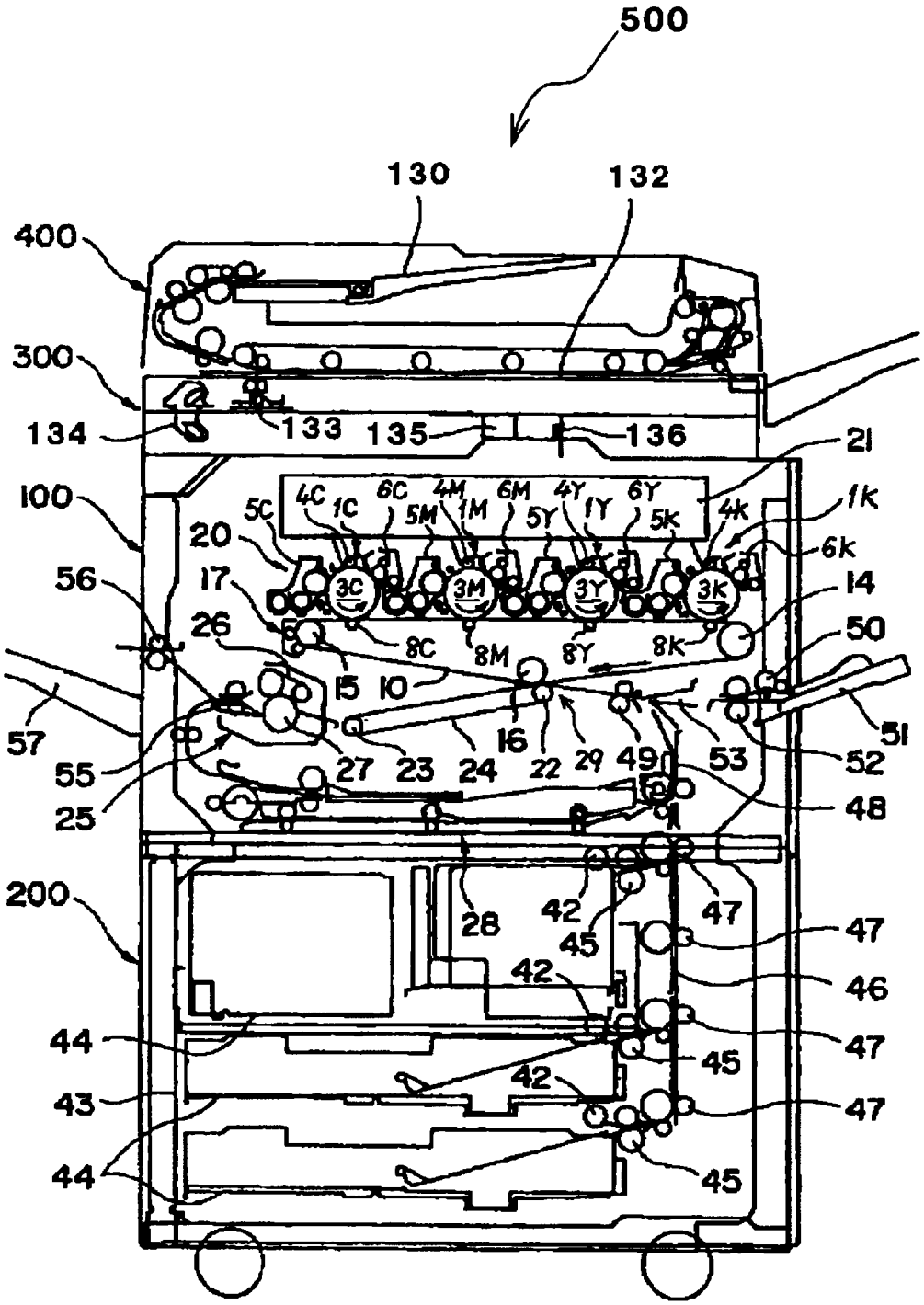
FIG. 2 illustrates a copy machine according to Embodiment 1.

In the following, an image forming apparatus according to Embodiment 1 will be described. FIG. 2 illustrates a copy machine 500 which is a tandem-type color copy machine as an example of the image forming apparatus according to Embodiment 1. The copy machine 500 includes a printer unit 100 (which may be referred to as an "apparatus main body"), a sheet-feeding unit 200 which may include a sheet-feeding table, a scanner unit 300 mounted over the printer unit 100, and an automatic document feeder (ADF) unit 400 mounted over the scanner unit 300. The copy machine 500 also includes a control unit (not illustrated) for controlling the operation of the various units.

The printer unit 100 includes an intermediate transfer belt 10 (which may be referred to as an "intermediate transfer body") disposed at about the center of the printer unit 100. The intermediate transfer belt 10 is extended across a first support roller 14, a second support roller 15, and a third support roller 16. The intermediate transfer belt 10 is rotated in the clockwise direction in the drawing, as indicated by an arrow. Four photosensitive drums 3K, 3M, 3C, and 3Y are provided opposite the intermediate transfer belt 10 as latent image carriers that carry toner images of black, magenta, cyan, and yellow, respectively, on their surfaces. Any of the photosensitive drums 3K, 3M, 3C, and 3Y may be referred to as "the photosensitive drum 3".

Around the photosensitive drums 3, there are disposed charging units 4K, 4M, 4C, and 4Y that uniformly charge the surfaces of the corresponding photosensitive drums 3. Any of the charging units 4K, 4M, 4C, and 4Y may be referred to as "the charging unit 4". Also, developing units 5K, 5M, 5C, and 5Y that form toner images of the corresponding colors on the photosensitive drums 3 are disposed around the corresponding photosensitive drums 3. Any of the developing units 5K, 5M, 5C, and 3Y may be referred to as "the developing unit 5".

Figure 3:
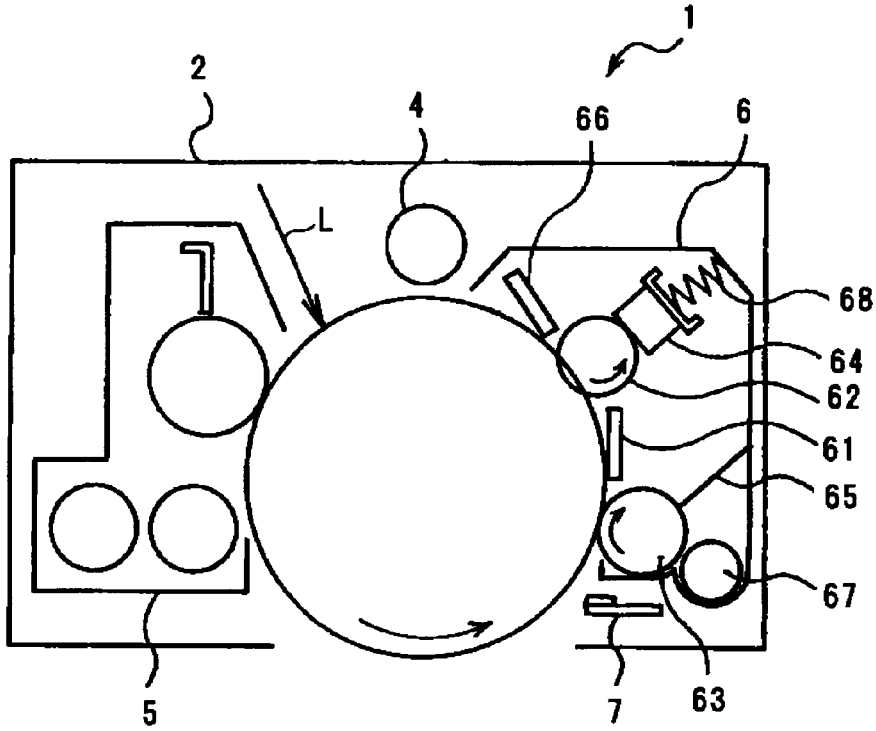
FIG. 3 is an enlarged view of an image forming unit according to Embodiment 1.

The printer unit 100 also includes drum cleaning units 6K, 6M, 6C, and 6Y that remove residual toner from the surfaces of the corresponding photosensitive drums 3 after primary transfer. Any of the drum cleaning units 6K, 6M, 6C, and 6Y may be referred to as "the drum cleaning unit 6". The drum cleaning unit 6 may include a lubricant supplying mechanism for supplying a lubricant onto the surface of the photosensitive drum 3, and a lubricant leveling blade for leveling the supplied lubricant. The photosensitive drum 3, the developing unit 5, the charging unit 4, and the drum cleaning unit 6 constitute an image forming unit 1K, 1M, 1C, or 1Y. Any of the image forming units 1K, 1M, 10, and 1Y may be referred to as "the image forming unit 1", as illustrated in FIG. 3. The four image forming units 1K, 1M, 1C, and 1Y are disposed laterally next to each other as illustrated, thereby forming a tandem image forming unit 20.

The charging unit 4 may include a contactless charging roller to which a combination of an AC (alternating current) voltage and a DC (direct current) voltage is applied in order to uniformly charge the photosensitive drum 3. The contactless charging roller is merely an example of the charging unit 4. Preferably, the charging unit 4 may include other forms of a contactless charger or a contacting charging roller.

The printer unit 100 further includes a belt cleaning unit 17 disposed opposite the second support roller 15 across the intermediate transfer belt 10. The belt cleaning unit 17 removes residual toner that may remain on the intermediate transfer belt 10 after the toner images are transferred onto a transfer sheet as a recording medium. The printer unit 100 also includes an exposing unit 21 over the tandem image forming unit 20.

The printer unit 100 also includes primary transfer rollers 8K, 8M, 8C, and 8Y disposed inside the loop of the intermediate transfer belt 10. Any of the primary transfer rollers 8K, 8M, 8C, and 8Y may be hereafter referred to as "the primary transfer roller 8". The primary transfer roller 8 is disposed opposite the photosensitive drum 3 across the intermediate transfer belt 10. Specifically, the primary transfer roller 8 is pressed against the photosensitive drum 3 via the intermediate transfer belt 10 in a primary transfer area.

The printer unit 100 further includes a secondary transfer unit 29 disposed on the opposite side of the intermediate transfer belt 10 from the tandem image forming unit 20. The secondary transfer unit 29 includes a secondary transfer roller 22, a secondary transfer belt extending roller 23, and a secondary transfer belt 24 extended across the secondary transfer belt extending roller 23 and the secondary transfer roller 22. The secondary transfer roller 22 is configured to press the secondary transfer belt 24 against the third support roller 16 via the intermediate transfer belt 10, thus forming a secondary transfer nipping portion as a secondary transfer area between the secondary transfer belt 24 and the intermediate transfer belt 10.

The printer unit 100 further includes a fusing unit 25 disposed to the left of the secondary transfer unit 29 for fusing a transferred image onto the transfer sheet. The fusing unit 25 includes a heating roller 26*a* having an internal heat source, a fusing roller 26*b*, an endless fusing belt 26 extended across the heating roller 26*a* and the fusing roller 26*b*, and a pressing roller 27 pressed against the fusing belt 26. The secondary transfer unit 29 has a transfer sheet transport function for transporting the transfer sheet onto which the toner images have been transferred in the secondary transfer nipping portion to the fusing unit 25. Preferably, the secondary transfer unit 29 may include a transfer roller or a contactless charger. In this case, the secondary transfer unit 29 may not include the transfer sheet transport function.

Under the secondary transfer unit 29 and the fusing unit 25, a sheet inverting unit 28 is disposed parallel to the tandem image forming unit 20. The sheet inverting unit 28 is configured to invert the transfer sheet so that images can be recorded on both sides of the transfer sheet. Specifically, after an image is fused onto one side of the transfer sheet, the transport path of the transfer sheet is switched by a switching nail 55 to the sheet inverting unit 28. Then, the sheet inverting unit 28 inverts the transfer sheet and feeds it back into the secondary transfer nipping portion, where another image is transferred onto the other side of the transfer sheet. Thereafter, the transfer sheet is ejected onto an ejected sheet tray 57.

The scanner unit 300 reads image information of a document placed on a contact glass 132 by using a reading sensor 136, and sends the image information to the control unit (not illustrated). Based on the received image information, the control unit may control a light source (not illustrated), such as a laser or a LED, provided in the exposing unit 21 of the printer unit 100 in order to irradiate the photosensitive drum 3 with exposing light, such as a laser light beam L illustrated in FIG. 3. The irradiation causes an electrostatic latent image to be formed on the surface of the photosensitive drum 3. The latent image is thereafter developed into a toner image through a predetermined developing process.

The sheet-feeding unit 200 includes sheet-feeding cassettes 44 housed in a paper bank 43 in multiple stages, sheet-feeding rollers 42 for feeding the transfer sheets from the sheet-feeding cassettes 44, separating rollers 45 for feeding the transfer sheets onto a sheet-feeding path 46 one sheet at a time, and transport rollers 47 for transporting the transfer sheet onto a sheet-feeding path 48 within the printer unit 100.

In the copy machine 500 according to Embodiment 1, manual feeding is enabled in addition to the feeding by the sheet-feeding unit 200. For this purpose, the copy machine 500 includes a manual feed tray 51, and a manual-feed separating roller 52 for feeding the transfer sheets on the manual feed tray 51 into a manual sheet-feeding path 53, one sheet at a time. The manual feed tray 51 and the manual-feed separating roller 52 is provided on one side of the copy machine 500 in the illustrated example.

The transfer sheet transported from the sheet-feeding cassettes 44 or the manual feed tray 51 is abutted against a registration roller pair 49. The registration roller pair 49 is configured to feed only one transfer sheet by a single rotation operation. The transfer sheet is then transported to the secondary transfer nipping portion between the intermediate transfer belt 10 and the secondary transfer belt 24 of the secondary transfer unit 29.

In the copy machine 500 according to Embodiment 1, in the case of color copying, an original document may be set on a document base 130 of the document transport unit 400. Alternatively, the document may be set on the contact glass 132 of the scanner unit 300 by opening the document transport unit 400, and then the document transport unit 400 may be closed to press down on the document.

When a start switch (not illustrated) is pressed, the scanner unit 300 is activated after the document set on the document base 130 is transported to the contact glass 132. Alternatively, when the document is set on the contact glass 132, the scanner unit 300 is immediately activated upon pressing of the start switch. Activation of the scanner unit 300 activates a first travelling member 133 and a second travelling member 134. A light source in the first travelling member 133 emits light and reflects the light reflected from the document surface onto the second travelling member 134. The second travelling member 134 includes mirrors by which the reflected light is reflected onto an image forming lens 135 via which the light becomes incident on the reading sensor 136. The reading sensor 136 then reads the Image information of the document.

The surfaces of the photosensitive drums 3 are uniformly charged by the charging unit 4. The image information read by the scanner unit 300 is separated into information of the colors, based on which the surfaces of the respective photosensitive drums 3 are exposed by the exposing unit 21 using the laser light beam, for example. Thus, electrostatic latent images are formed on the surfaces of the respective photosensitive drums 3. Thereafter, toner images of the corresponding colors are formed on the photosensitive drums 3.

For example, a process of forming a yellow (Y) image will be described. In the image forming unit 1Y for yellow, the electrostatic latent image is formed on the surface of the photosensitive drum 3Y by the exposing unit 21 using laser light. The latent image is developed by the developing unit 5Y using yellow toner, thereby forming the toner image of yellow on the photosensitive drum 3Y. Similarly, the toner images of the colors of C (cyan), M (magenta), and K (black) are formed on the photosensitive drum 3C, 3M, and 3K, respectively, by the image forming units 1C, 1M, and 1K, respectively.

While the toner images are formed on the photosensitive drums 3, the sheet-feeding rollers 42 or 50 are operated to feed the transfer sheet of a size corresponding to the image information. At the same time, the first support roller 14, the second support roller 15, or the third support roller 16 is driven by a drive motor (not illustrated) so as to move the intermediate transfer belt 10 in the clockwise direction in FIG. 2, with the support rollers not being driven rotating in a driven manner. In accordance with the surface movement of the intermediate transfer belt 10, the single-color toner images on the photosensitive drums 3Y, 3C, 3M, and 3K are successively transferred onto the intermediate transfer belt 10 in a primary transfer process, thereby forming a superposed color image on the intermediate transfer belt 10.

On the other hand, in the sheet-feeding unit 200, the sheet-feeding rollers 42 are selectively rotated so as to feed the transfer sheet from one of the sheet-feeding cassettes 44. The transfer sheets are fed onto the sheet-feeding path 46 one sheet at a time by the separating rollers 45, and are then guided by the transport rollers 47 onto the sheet-feeding path 48 within the main body of the copy machine 500, i.e., the printer unit 100. The transfer sheet is then abutted against the registration roller pair 49. Alternatively, the manual feeding roller 50 is rotated to feed the transfer sheet on the manual feed tray 51. In this case, the transfer sheets are fed onto the manual-sheet-feeding path 53 by the manual-feed separating roller 52 one sheet at a time, and then similarly abutted against the registration roller pair 49. When using the transfer sheet on the manual feed tray 1, the manual feeding roller 50 is rotated to feed the transfer sheets from the manual feed tray 51, and the transfer sheets are further fed onto the manual-sheet-feeding path 53 one sheet at a time by the manual-feed separating roller 52 until abutted against the registration roller pair 49.

The registration roller pair 49 is rotated in accordance with the timing of the composed color image on the intermediate transfer belt 10 so that the transfer sheet can be fed into the secondary transfer nipping portion, where the intermediate transfer belt 10 and the secondary transfer roller 22 contact each other at an appropriate timing. In the secondary transfer nipping portion, the color image is transferred from the intermediate transfer belt 10 onto the transfer sheet in the secondary transfer process by using a transfer electric field or contacting pressure.

The transfer sheet onto which the color image has been transferred in the secondary transfer nipping portion is further fed by the secondary transfer belt 24 of the secondary transfer unit 29 into the fusing unit 25. In the fusing unit 25, the color image is fused onto the transfer sheet by pressing and using heat provided in the fusing nip formed between the pressing roller 27 and the fusing belt 26. Thereafter, the transfer sheet is ejected by an ejecting roller 56 out of the apparatus and stacked on the ejected sheet tray 57. Alternatively, when the transfer sheets is to be printed on both sides, the direction of sheet transport is switched by the switching nail 55 after the color image is fused onto one side of the transfer sheet, so that the transfer sheet can be transported to the sheet inverting unit 28. After the transfer sheet is inverted by the sheet inverting unit 28, the transfer sheet is guided back to the secondary transfer nipping portion where an image is recorded on the other side of the transfer sheet. The transfer sheet is eventually ejected by the ejecting roller 56 onto the ejected sheet tray 57.

After the transfer of the color image onto the transfer sheet in the secondary transfer nipping portion, the residual toner on the surface of the intermediate transfer belt 10 is removed by the belt cleaning unit 17 in preparation for the next image forming operation by the tandem image forming unit 20.

After the transfer of the corresponding toner image onto the intermediate transfer belt 10, the photosensitive drum 3 is neutralized by a pre-cleaning neutralizing lamp 7 illustrated in FIG. 3. Thereafter, the residual toner on the photosensitive drum 3 is removed by the drum cleaning unit 6 in preparation for the next image forming operation including the uniform charging of the photosensitive drum 3 by the charging unit 4. Preferably, the photosensitive drum 3 may be neutralized by a post-cleaning neutralizing lamp after the residual toner is removed by the drum cleaning unit 6.

FIG. 3 is an enlarged view of the image forming unit 1 according to Embodiment 1. As illustrated in FIG. 3, the image forming unit 1 includes a unit frame body 2 in which the photosensitive drum 3 and process units including the charging unit 4, the developing unit 5, and the drum cleaning unit 6 are integrally provided. The image forming unit 1 can be detached from and attached to the main body of the copy machine 500 as a process cartridge. Thus, in accordance with Embodiment 1, the image forming unit 1 as a whole can be replaced. Preferably, however, the photosensitive drum 3, the charging unit 4, the developing unit 5, and the drum cleaning unit 6 may be replaced individually.

Next, the features of the image forming unit 1 will be described in greater detail. The image forming unit 1 includes the photosensitive drum 3 (latent image carrier), and the charging unit 4 (charging unit) for charging the surface of the photosensitive drum 3. The image forming unit 1 also includes the developing unit 5 for developing the latent image formed on the surface of the photosensitive drum 3 by the exposing unit 21 (latent-image forming unit), by supplying toner. Further, the image forming unit 1 includes the drum cleaning unit 6 for removing the residual toner on the surface of the photosensitive drum 3 after the toner image is transferred onto the intermediate transfer belt 10 (transfer body) by the primary transfer roller 8 (transfer unit). The drum cleaning unit 6 includes, from the upstream side of the direction of surface movement of the photosensitive drum 3 indicated by an arrow, a pre-cleaning neutralizing lamp 7, a fur brush 63 which may include a rotating brush, a cleaning blade 61, a coating brush 62, and a leveling blade 66. In the drum cleaning unit 6, the fur brush 63 and the cleaning blade 61 constitute a toner-removing unit. The drum cleaning unit 6 also includes a lubricant supplying mechanism including the coating brush 62 and a lubricant pressing spring 68 that presses solid zinc stearate 64 retained in a bracket onto the coating brush 62.

The surface of the photosensitive drum 3 from which the toner image has been transferred onto the intermediate transfer belt 10 in the primary transfer portion, where the photosensitive drum 3 and the primary transfer roller 8 are opposed to each other, is neutralized by the pre-cleaning neutralizing lamp 7. Then, the residual toner is disordered by the fur brush 63, whereby the residual toner can be rendered more readily removable by the cleaning blade 61 further downstream the surface transport direction of the photosensitive drum 3. The toner attached onto the fur brush 63 is flicked by a flicker 65, and the blown toner is transported by a transport screw 67 to the outside of the drum cleaning unit 6.

The fur brush 63 is rotated in a driven direction indicated by an arrow in FIG. 3 with respect to the direction of surface movement of the photosensitive drum 3. The cleaning blade 61 may be fixedly supported on a rotatably retained holder (not illustrated) such that the cleaning blade 61 can engage the surface of the photosensitive drum 3 in a counter direction with respect to the direction of surface movement of the photosensitive drum 3. The cleaning blade 61 may be configured to remove the toner by being pressed against the photosensitive drum 3 by a pressing spring (not illustrated).

The surface of the photosensitive drum 3 from which the residual toner has been removed by the cleaning blade 61 is coated with the lubricant, such as zinc stearate, by the coating brush 62. Specifically, as the solid zinc stearate 64 retained in the bracket is pressed against the coating brush 62 by the lubricant pressing spring 68, the coating brush 62 scrapes off the solid zinc stearate 64 and applies it onto the surface of the photosensitive drum 3.

The coating brush 62 is also rotated in a counter direction with respect to the direction of surface movement of the photosensitive drum 3. The lubricant scraped from the solid zinc stearate 64 by the coating brush 62 and applied onto the surface of the photosensitive drum 3 is further made more evenly applied onto the photosensitive drum 3 by the leveling blade 66 of a fixed-pressure applying type, which is supported in contact with the surface of the photosensitive drum 3 in a counter direction with respect to the direction of surface movement of the photosensitive drum 3.

Thus, in the image forming unit 1, after the residual toner is removed, the surface of the photosensitive drum 3 is coated with the lubricant as described above in preparation for the next image forming operation, which may begin with the uniform charging of the drum surface by the charging unit 4.

Figure 4:
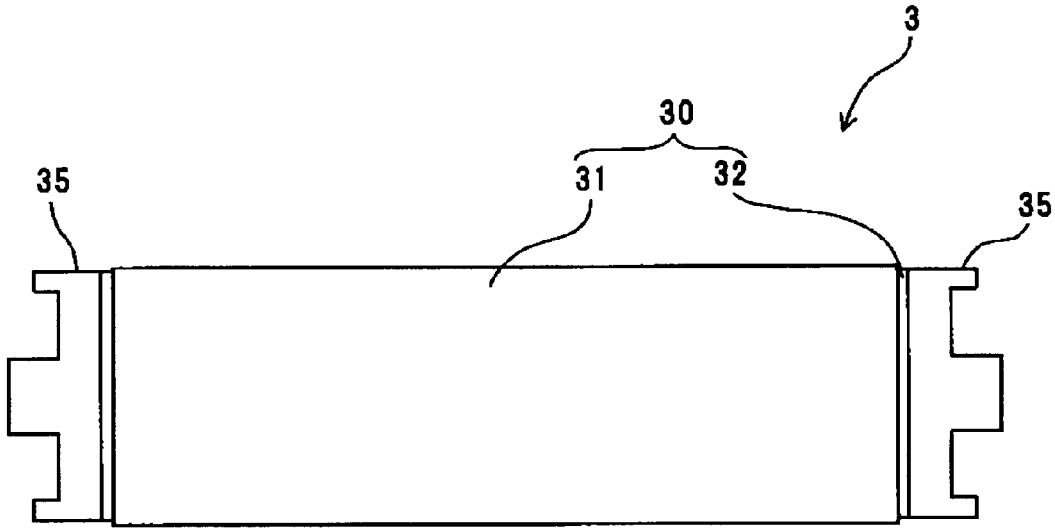
FIG. 4 is a side view of a photosensitive drum.

Next, the photosensitive drum 3 according to the present embodiment will be described. FIG. 4 is a side view of the photosensitive drum 3. The photosensitive drum 3 includes a sleeve 30 and the flange members 35 disposed on the axial ends of the sleeve 30. The sleeve 30 includes a hollow and cylindrical base 32 and a photosensitive layer 31 provided on an outer peripheral surface of the base 32.

Figure 5:
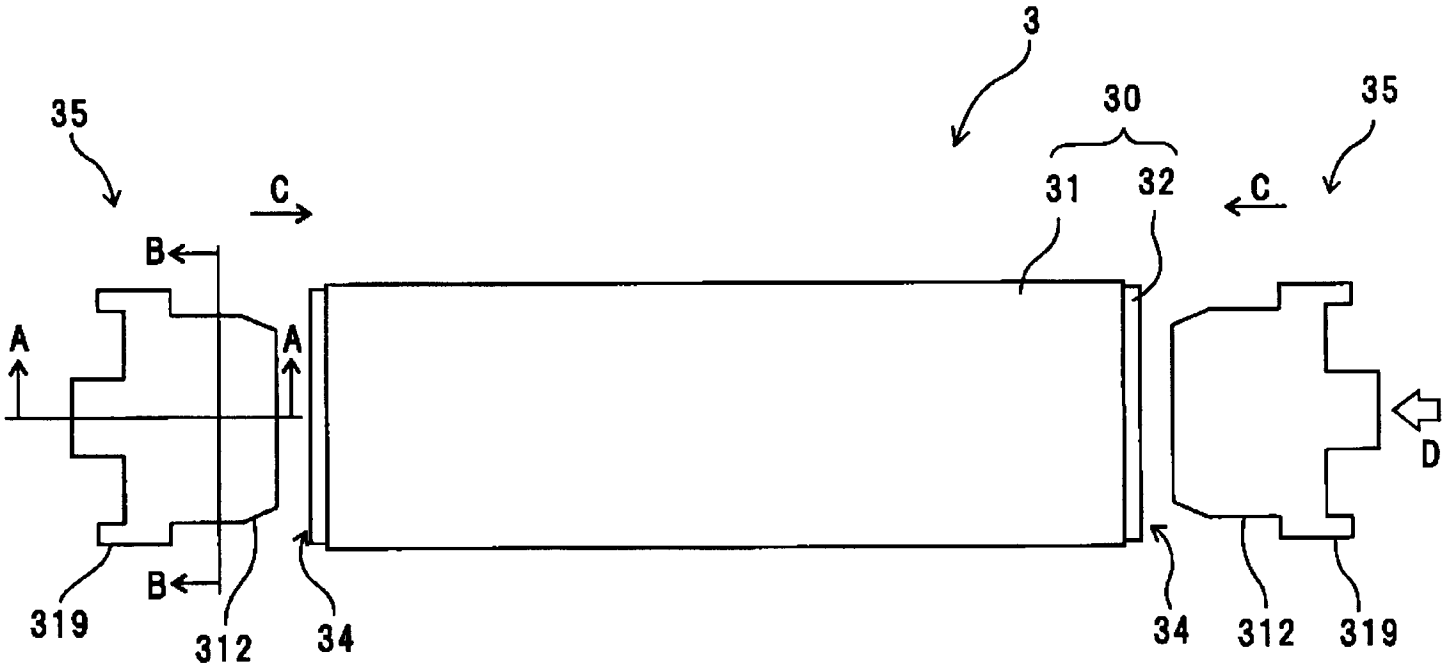
FIG. 5 illustrates the photosensitive drum from which the flange members have been detached.

FIG. 5 illustrates the photosensitive drum 3 with the flange members 35 detached from the sleeve 30. The sleeve 30 includes end-opening portions 34 at the axial ends of the base 32. The flange members 35 include press-fitted portions 312. The photosensitive drum 3 illustrated in FIG. 4 is formed by press-fitting the press-fitting portions 312 of the flange members 35 into the corresponding end-opening portions 34, in a direction indicated by an arrow C.

The material of the flange members 35 is not particularly limited. Preferably, the flange members 35 may be made of a polycarbonate resin or a polycarbonate resin mixed with an additive such as glass for increased strength. By using such resins, the flange members 35 may be made at low cost and their weight may be reduced.

EXAMPLE 1

Figure 1A:
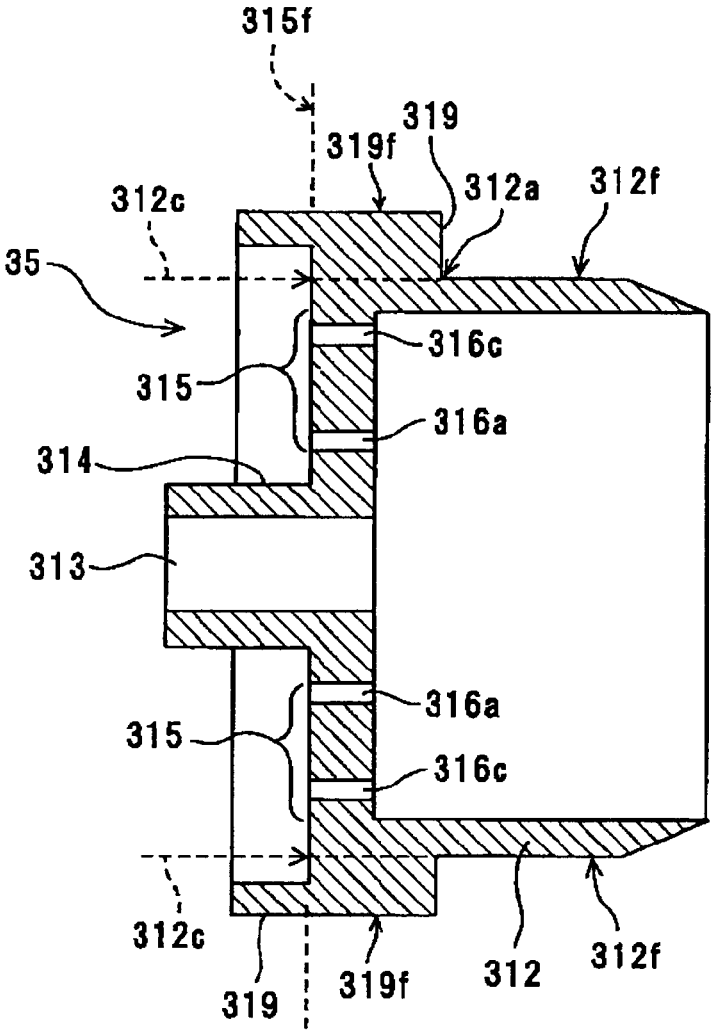
FIG. 1A is a cross section of a flange member according to Example 1 perpendicular to an axial direction.
Figure 1B:
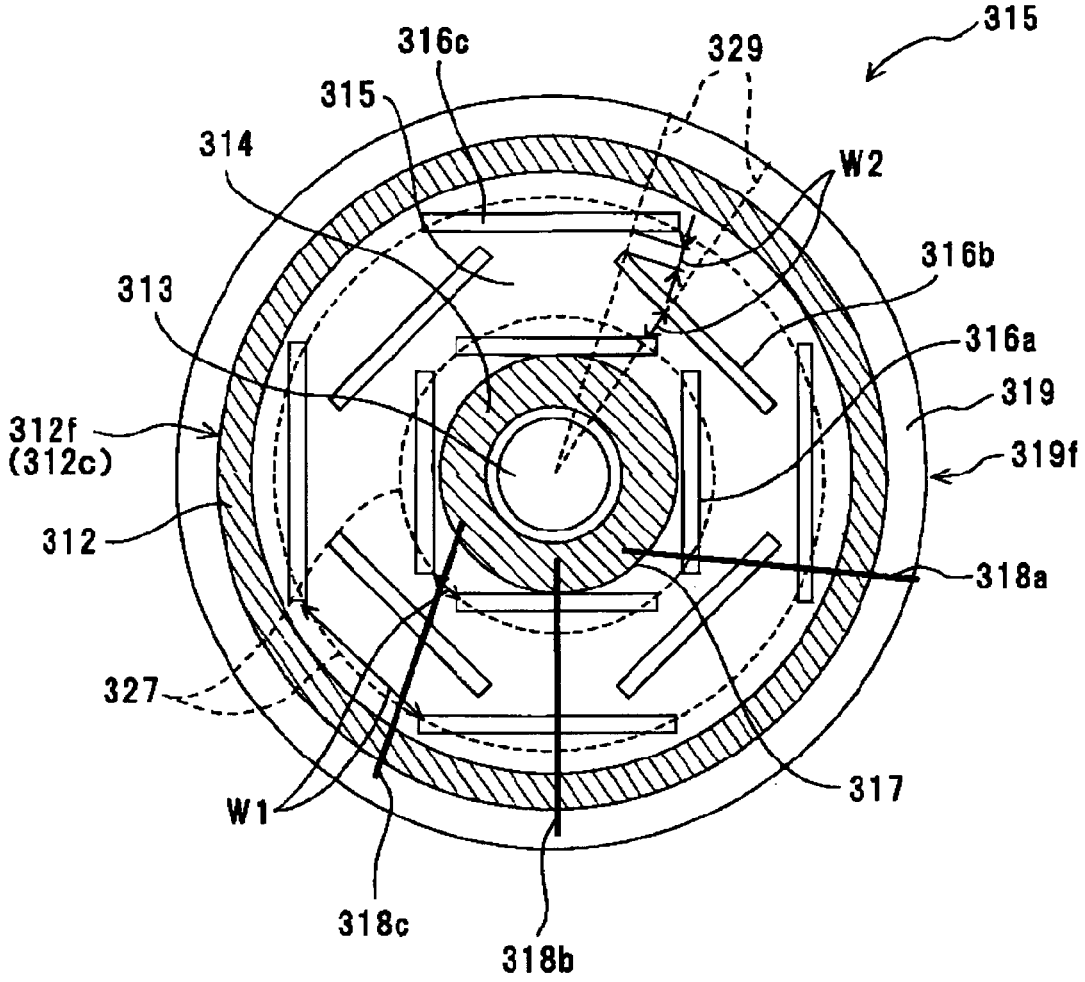
FIG. 1B is a cross section of the flange member parallel to the axial direction.

Next, the flange member 35 according to an embodiment will be described with reference to FIGS. 1A and 1B. FIG. 1A is a cross section of the flange member 35 taken along line A-A of FIG. 5. FIG. 1B is a cross section of the flange member 35 of FIG. 5 taken along line B-B.

The flange member 35 includes a press-fitted portion 312, an axle opening portion 314, a linking portion 315, and an outer-rim portion 319. When the press-fitted portion 312 is press-fitted in the end-opening portion 34 of the sleeve 30 (see also FIGS. 4 and 5), a press-fitted outer peripheral surface 312*f* of the press-fitted portion 312 contacts an inner peripheral surface of the base 32 of the sleeve 30. The axle opening portion 314 includes an axle opening 313 in which a shaft member (not illustrated) is inserted. The outer-rim portion 319 includes an outer rim 319*f* which is an outer-most peripheral portion of the flange member 35 in the radial direction. The linking portion 315 links the axle opening portion 314 with the press-fitted portion 312 and the outer-rim portion 319.

The linking portion 315 includes plural stress-absorbing openings 316*a* through 316*c* as stress-absorbing portions, any of which may be referred to as "the stress-absorbing opening 316". The axle opening portion 314 refers to the portion within a circle 317 having a radius corresponding to the distance between an axial center and the nearest stress absorbing opening, namely the first stress-absorbing opening 316*a*, excepting the axle opening 313.

Thus, the flange member 35 according to Example 1 includes at least one stress-absorbing opening 316 on an arbitrary imaginary line 318 drawn from the axle opening portion 314 toward the outer-rim portion 319. For example, the arbitrary imaginary line 318 includes arbitrary imaginary lines 318*a*, 318*b*, and 318*c* as illustrated in FIG. 1B. In this example, there are three stress-absorbing openings 316 on the arbitrary imaginary line 318*a*, two stress-absorbing openings 316 on the arbitrary imaginary line 318*b*, and one stress-absorbing opening 316 on the arbitrary imaginary line 318*c*. The imaginary line 318 may be drawn from the circumference of an imaginary projected circle 312*c* to the axle opening portion 314. The imaginary projected circle 312*c* is a projection of the press-fitted outer peripheral surface 312*f* of the press-fitted portion 312 on an imaginary plane 315*f* including the linking portion 315 and perpendicular to the axial direction (left-right direction in FIG. 1A).

In the flange member 35 illustrated in FIGS. 1A and 1B, the press-fitted outer peripheral surface 312*f* is formed parallel to the axial direction. When the press-fitted outer peripheral surface 312*f* is inclined with respect to the axial direction, the position of the circumference of the imaginary projected circle 312*c* is determined with respect to the position of the press-fitted outer peripheral surface 312*f* at the root of the press-fitted portion 312 (i.e., the position 312*a* in FIG. 1A).

In accordance with Example 1, when the press-fitted portion 312 is press-fitted in the sleeve 30, the stress that the press-fitted portion 312 may be subjected to from the base 32 of the sleeve 30 can be absorbed by the stress-absorbing opening 316. Thus, the deformation or displacement of the axle opening 313 can be more effectively prevented compared to a structure in which the stress-absorbing portion 316 is not provided.

The flange member 35 also includes at least one stress-absorbing opening 316 on the arbitrary imaginary line 318 drawn from the axle opening portion 314 toward the outer-rim portion 319. Thus, the stress that the press-fitted portion 312 may be subjected to in any direction from the base 32 upon press fitting can be absorbed by the stress-absorbing material 91 of the stress-absorbing opening 316. Accordingly, the stress to which the press-fitted outer peripheral surface 312*f* of the press-fitted portion 312 may be subject can be prevented from directly being transmitted to the axle opening portion 314, and therefore the deformation or displacement of the axle opening 313 can be prevented.

One of the axial-end portions of the photosensitive drum 3 may be referred to as a driving-end portion to which driving force is input from the apparatus main body, while the other end portion may be referred to as a driven-end portion via which the photosensitive drum 3 may be rotatably supported with respect to the apparatus main body. The flange member 35 on the side of the driving-end portion may include a drive-transmitting gear.

Figure 6A:
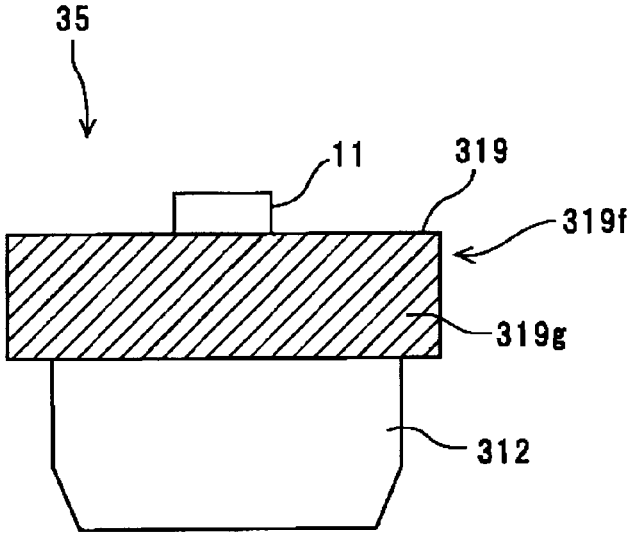
FIG. 6A is a side view of a drive-transmitting gear of the flange member.
Figure 6B:
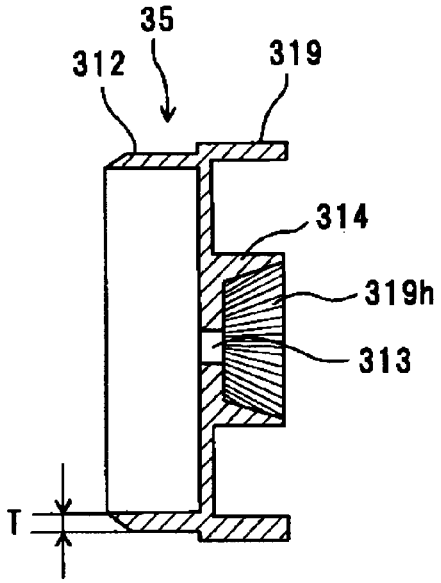
FIG. 6B is a cross section of the flange member.

FIG. 6A is a side view of the flange member 35 illustrating an example of the drive-transmitting gear. FIG. 6B is a cross section of the flange member 35 of FIG. 6A. As illustrated in FIG. 6A, an outer rim gear 319*g* is formed in an outer rim 319*f* of an outer-rim portion 319 of the flange member 35. Further, in an axle opening 313 of the axle opening portion 314, there is provided a drive input gear 319*h*.

The drive input gear 319*h* is engaged with a driving gear (not illustrated) provided on a shaft member (not illustrated) that transmits rotating force from a drive motor (not illustrated) of the apparatus main body of the copy machine 500. The outer rim gear 319*g* may be engaged with a series of gears (not illustrated) of the image forming unit 1.

Thus, the rotating force from the drive motor of the apparatus main body is input via the drive input gear 319*h* to the flange member 35, thereby rotating the photosensitive drum 3. Further, as the photosensitive drum 3 is rotated, the drive force is transmitted via the outer rim gear 319*g* to the series of gears of the image forming unit 1, thereby transmitting the rotating force to the other units in the image forming unit 1, such as the developing unit 5.

Referring back to FIGS. 4 and 5, the base 32 of the sleeve 30 may include a tube made of an electrically conductive metal that exhibits a volume resistance of $10^{10}$ Ω·cm or less, such as aluminum, aluminum alloys, stainless steel, nickel, chromium, nichrome, copper, gold, silver, or platinum. Alternatively, the base 32 may include a plastic cylinder. Examples of the plastic material that may be used in the base 32 include polystyrene, styrene-acrylonitrile copolymer, styrene-butadiene copolymer, styrene maleic anhydride copolymer, polyester, polyvinyl chloride, vinylchloride-vinylacetate copolymer, polyvinyl acetate, polyvinylidene chloride, polyarylate resin, phenoxy resin, polycarbonate, acetylcellulose resin, ethylcellulose resin, polyvinyl butyral, polyvinyl formal, polyvinyl toluene, poly-N-vinylcarbazole, acrylic resin, silicone resin, epoxy resin, melamine resin, urethane resin, phenol resin, and alkyd resin.

The electrical conductivity corresponding to the volume resistance of $10^{10}$ Ω·cm or less may be achieved by vapor deposition of a metal or mixing an electrically conductive powder. Examples of the electrically conductive powder may include a carbon black or acetylene black powder, a metal powder of aluminum, nickel, iron, nichrome, copper, zinc, or silver, and a metal oxide powder of an electrically conductive tin oxide or an indium tin oxide (ITO).

Next, the photosensitive layer 31 of the sleeve 30 will be described. The photosensitive layer 31 may include an intermediate layer, a charge generating layer, a charge transport layer, and a protection layer as needed.

<Intermediate Layer>

The sleeve 30 according to the present embodiment may include an intermediate layer on the base 32. The intermediate layer may include an oxide coating of a binder resin in which a pigment is dispersed. Examples of the binder resin include polyvinyl alcohol, casein, sodium polyacrylate, copolymer nylon, methoxymethyl nylon, polyurethane, polyester, polyamide resin, melamine resin, phenol resin, alkyd-melamine resin, and epoxy resin.

Examples of the pigment include metal oxides such as titanium oxide, silica, alumina, zirconium oxide, tin oxide, and indium oxide. The pigment may be surface-treated. The intermediate layer may have a film thickness on the order of 0 to 5 μm.

<Charge Generating Layer and Charge Transport Layer>

The charge generating layer and the charge transport layer may be provided by a single-layer structure containing both a charge generating substance and a charge transport substance. Alternatively, the charge generating layer and the charge transport layer may be separately formed in layers. For the sake of description, the layered structure will be described first.

<Charge Generating Layer>

The charge generating layer is a layer that contains a charge generating substance as a principal component. The charge generating substance is not particularly limited. Examples include phthalocyanine, azo, and other known materials. The charge generating layer may be formed by dispersing the charge generating substance in an appropriate solvent, mixing a binder resin as needed, by using a bead mill or ultrasound, followed by coating and drying.

The charge generating layer may include a binder resin. Examples of the binder resin include polyamide, polyurethane, epoxy resin, polyketone, polycarbonate, silicone resin, acrylic resin, polyvinyl butyral, polyvinyl formal, polyvinylketone, polystyrene, polysulphone, poly-N-vinylcarbazole, polyacrylamide, poly(vinyl benzal), polyester, phenoxy resin, vinylchloride-vinylacetate copolymer, polyvinyl acetate, polyphenylene oxide, polyamide, polyvinylpyridine, cellulose type resin, casein, polyvinyl alcohol, and polyvinylpyrrolidone. An appropriate amount of the binder resin may be in a range of 0 to 500 parts by weight with respect to 100 parts by weight of the charge generating substance, and may be more preferably in a range of 10 to 300 parts by weight. An appropriate film thickness of the charge generating layer may be in a range of 0.01 to 5 μm and may be preferably in a range of 0.1 to 2 μm.

<Charge Transport Layer>

The charge transport layer may be formed by dissolving or dispersing a charge transport substance and a binder resin in an appropriate solvent, applying the solution or dispersion onto the charge generating layer, and then drying. A plasticizer, a leveling agent, or an antioxidant may be added as needed.

The charge transport substance includes a hole transport substance and an electron transport substance. Examples of the hole transport substance include poly-N-vinylcarbazole and its derivatives, poly-γ-carbazolylethyl glutamate and its derivatives, pyrene-formaldehyde condensate and its derivatives, polyvinyl pyrene, polyvinyl phenanthrene, polysilane, oxazole derivatives, oxadiazole derivatives, imidazole derivatives, monoarylamine derivatives, diaryl amine derivatives, triarylamine derivatives, stilbene derivatives, α-phenylstilbene derivatives, benzidine derivatives, diarylmethane derivatives, triarylmethane derivatives, 9-styryl-anthracene derivatives, pyrazoline derivatives, divinylbenzene derivatives, hydrazone derivatives, indene derivatives, butadiene derivatives, pyrene derivatives or the like, bis-stilbene derivatives, enamine derivatives or the like, and other known materials. These charge transport substances may be used either individually or in combination.

Examples of the electron transport substance include electron-accepting substances such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitro-xanthone, 2,4,8-trinitrothioxanthone, 2,6,8-trinitro-4H-indeno [1,2-b]thiophen-4-one, 1,3,7-trinitro dibenzothiophene-5,5-dioxide, and benzoquinone derivatives.

Examples of the binder resin include thermoplastic or thermosetting resins such as polystyrene, styrene-acrylonitrile copolymer, styrene-butadiene copolymer, styrene maleic anhydride copolymer, polyester, polyvinyl chloride, vinylchloride-vinylacetate copolymer, polyvinyl acetate, polyvinylidene chloride, polyarylate, phenoxy resin, polycarbonate, acetylcellulose resin, ethylcellulose resin, polyvinyl butyral, polyvinyl formal, polyvinyl toluene, poly-N-vinylcarbazole, acrylic resin, silicone resin, epoxy resin, melamine resin, urethane resin, phenol resin, and alkyd resin.

An appropriate amount of the charge transport substance may be in a range of 20 to 300 parts by weight, and preferably 40 to 150 parts by weight, with respect to 100 parts by weight of the binder resin. Preferably, the charge transport layer may have a film thickness in a range of 5 to 100 μm.

The charge transport layer may include a polymer charge transport substance having the function of a charge transport substance and the function of a binder resin. The polymer charge transport substance may improve the abrasion resistance of the charge transport layer. The polymer charge transport substance may include a known material of which a preferable example is polycarbonate containing a triarylamine structure in a main chain and/or a side chain.

Preferably, the polymer charge transport substance that may be used in the charge transport layer may include, in addition to the polymer charge transport substance mentioned above, a polymer that is in the form of a monomer or oligomer having an electron-releasing group at the time of forming the charge transport layer and that eventually possesses a two-dimensional or three-dimensional bridged structure upon curing reaction or bridging reaction after film formation. Such a reactive monomer may include a monomer that is entirely or partly capable of transporting charges. By using such a monomer, a charge transporting region may be formed in a mesh structure, thereby enabling the charge transport layer to fully perform its function. An effective example of the monomer having such charge transporting capability is a reactive monomer having a triarylamine structure.

Other examples of the polymer having an electron-releasing group include a copolymer of known monomers, a block polymer, a graft polymer, a star polymer, and a cross-linked polymer having an electron-releasing group as discussed in Japanese Laid-open Patent Publications No. 3-109406, 2000-206723, and 2001-34001.

In the foregoing, the layered structure in which the photosensitive layer 31 includes the charge generating layer and the charge transport layer separately has been described. Alternatively, the sleeve 30 used in the photosensitive drum 3 may have the single-layer structure. The single-layer structure may be obtained by providing a single layer including at least the above-described charge generating substance and a binder resin. The binder resin may include those examples described above with reference to the charge generating layer or the charge transport layer. Preferably, by using a charge transport substance in combination, high optical sensitivity, high carrier transport characteristics, and a low residual potential may be advantageously exhibited. In this case, the charge transport substance may include either a hole transport substance or an electron transport substance depending on the polarity of the charged surface of the photosensitive drum 3. Preferably, the polymer charge transport substance, because of its binder resin and charge transport substance functions, may be used in the single-layer photosensitive layer.

<Protection Layer>

The sleeve 30 may include a protection layer in order to achieved improved durability. The protection layer may include a resin film, preferably a cross-linked resin. For example, a cross-linked resin is obtained by curing a radical polymerizing monomer.

Examples of the cross-linked resin include 2-ethylhexyl acrylate, 2-hydroxyethyl acrylate, 2-hydroxypropyl acrylate, tetrahydrofurfuryl acrylate, 2-ethylhexyl carbitol acrylate, 3-methoxybutyl acrylate, benzil acrylate, cyclohexyl acrylate, isoamyl acrylate, isobutyl acrylate, methoxy ethylene glycol acrylate, phenoxy tetraethylene glycol acrylate, cetyl acrylate, isostearyl acrylate, stearyl acrylate, styrene monomer, 1,3-butanediol diacrylate, 1,4-butanediol diacrylate, 1,4-butanediol dimethacrylate, 1,6-hexanediol diacrylate, 1,6-hexanediol dimethacrylate, diethylene glycol diacrylate, neopentylglycol diacrylate, bisphenol A-EO-modified diacrylate, bisphenol F-EO-modified diacrylate, neopentylglycol diacrylate, trimethylolpropane triacrylate (TMPTA), trimethylolpropane trimethacrylate, trimethylolpropane alkylene-modified triacrylate, trimethylolpropane ethyleneoxy-modified (hereafter referred to as "EO-modified") triacrylate, trimethylolpropane propyleneoxy-modified (hereafter referred to as "PO-modified") triacrylate, trimethylolpropane caprolactone-modified triacrylate, trimethylolpropane alkylene-modified trimethacrylate, pentaerythritol triacrylate, pentaerythritol tetraacrylate (PETTA), glycerol triacrylate, glycerol epichlorohydrin-modified (hereafter referred to as "ECH-modified) triacrylate, glycerol EO-modified triacrylate, glycerol PO-modified triacrylate, tris(acryloxyethyl) isocyanurate, dipentaerythritol hexaacrylate (DPHA), dipentaerythritol caprolactone-modified hexaacrylate, dipentaerythritol hydroxi pentaacrylate, alkylated dipentaerythritol pentaacrylate, alkylated dipentaerythritol tetraacrylate, alkylated dipentaerythritol triacrylate, dimethylol propane tetraacrylate (DTMPTA), pentaerythritol ethoxy tetraacrylate, phosphoric acid EO-modified triacrylate, and 2,2,5,5,-tetrahydroxymethyl cyclopentanone tetraacrylate. These substances may be used either individually or in combination.

The durability of the protection layer may be improved by containing a filler. Examples of the filler that may be used in the protection layer include silicone resin fine particles, alumina fine particles, silica fine particles, titanium oxide fine particles, DLC, non-crystalline carbon fine particles, fullerene fine particles, colloidal silica, electrically conductive particles (including zinc oxide, titanium oxide, tin oxide, antimony oxide, indium oxide, bismuth oxide, indium oxide doped with tin, tin oxide doped with antimony, and zirconium oxide doped with antimony).

By containing one or more of the above charge transport substance, desirable electric characteristics may be obtained.

Preferably, the protection layer may have a film thickness in the range of 2 to 15 μm.

<Attaching of the Flange Members>

The flange members 35, which are used for retaining and rotating the sleeve 30 with respect to the apparatus main body, are attached to the end-opening portions 34 of the sleeve 30 in the axial direction, thereby forming the photosensitive drum 3. The flange members 35 may be attached to the sleeve 30 before or after providing the photosensitive layer 31 on the base 32 of the sleeve 30. Preferably, a total run-out of the flange members 35 may be equal to or less than 20 μm and more preferably equal to or less than 10 μm.

Embodiment 2

Figure 7:
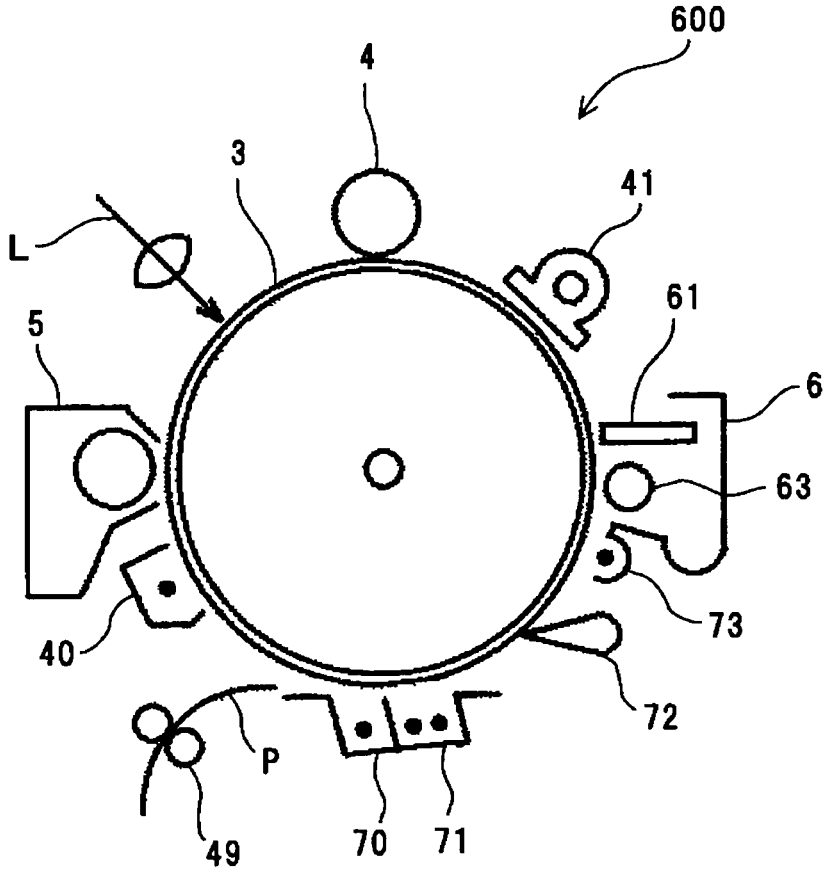
FIG. 7 illustrates a printer according to Embodiment 2.

Next, an image forming apparatus according to Embodiment 2 will be described. FIG. 7 illustrates a printer 600 which is a monochrome printer as an example of the image forming apparatus according to Embodiment 2. The printer 600 includes the photosensitive drum 3 of Embodiment 1 described with reference to FIGS. 1 and 4 through 6. The photosensitive drum 3 includes the cylindrical base on which surface at least a photosensitive layer is provided.

The printer 600 further includes the charging unit 4 including a charging roller, the developing unit 5, a pre-transfer charger 40, a transfer charger 70, a separating charger 71, a separating nail 72, a pre-cleaning charger 73, the drum cleaning unit 6, and a neutralizing lamp 41, which are disposed around the photosensitive drum 3.

In the printer 600, the surface of the photosensitive drum 3 is uniformly charged by the charging unit 4, and the charge surface is irradiated with the laser light beam L from an exposing apparatus (not illustrated in FIG. 7) in accordance with image information, thereby forming an electrostatic latent image on the drum surface. The electrostatic latent image on the photosensitive drum 3 is then developed by the developing unit 5, thereby forming a toner image.

The toner image formed on the surface of the photosensitive drum 3 is then transported to a transfer area opposite the transfer charger 70 by the surface movement of the photosensitive drum 3. On the other hand, a transfer sheet P is fed from a sheet-feeding unit (not illustrated in FIG. 7) and comes to a stop when a front edge of the transfer sheet P is abutted against the registration roller pair 49. The registration roller pair 49 is rotated in accordance with the timing of transport of the toner image on the surface of the photosensitive drum 3, thereby sending the transfer sheet P into the transfer area. The toner image on the surface of the photosensitive drum 3 may be transferred onto the transfer sheet P by using a transfer electric field formed in the transfer area. Thus, a monochrome image is recorded on the transfer sheet P.

The transfer sheet P is then separated from the surface of the photosensitive drum 3 by the separating nail 72 and ejected out of the printer 600. The surface of the photosensitive drum 3 from which the toner image has been transferred onto the transfer sheet P is cleaned by the drum cleaning unit 6, and residual charges on the drum surface are removed by the neutralizing lamp 41. Thereafter, the next image forming operation is performed, starting with the charging of the surface of the photosensitive drum 3 by the charging unit 4.

The various units for providing charges to the surface of the photosensitive drum 3 (including the charging unit 4, the pre-transfer charger 40, the transfer charger 70, the separating charger 71, and the pre-cleaning charger 73) may include known units, such as a corotron, a scorotron, a solid-state charger, a charging roller, or a transfer roller.

Various charging systems, such as a contact charging system or a closely spaced contactless system, may be preferably used. In the contact charging system, a high charging efficiency may be obtained while the amount of ozone produced may be reduced. A contact-type charging member may be configured to contact its surface on the surface of the photosensitive drum 3. Examples of the contact-type charging member include a charging roller, a charging blade, and a charging brush. Preferably, the charging roller or the charging brush may be used.

The "closely disposed charging member" refers to the type that maintains a gap of 200 μm or less between the surface of the photosensitive drum 3 and the surface of the charging member. The closely disposed charging member is different from other known chargers such as the corotron or the scorotron because of the distance of the gap. The closely disposed charging member that may be used in accordance with the present embodiment may have any form as long as the charging member is capable of appropriately controlling the gap from the surface of the photosensitive drum 3.

For example, the rotating shaft of the photosensitive drum 3 and a rotating shaft of the charging member are mechanically fixed such that an appropriate gap can be maintained between them. Preferably, the charging member may include a charging roller. In this case, gap-forming members may be disposed at the ends of the charging member corresponding to non-image-forming areas, such that only the gap-forming members are disposed in contact with the surface of the electrophotographic photosensitive drum 3. Thus, the charge unit can be disposed with respect to the image forming area in a contactless manner. Alternatively, the gap-forming members may be disposed at the ends of the photosensitive drum 3 corresponding to non-image-forming areas, and only the gap-forming members may be disposed in contact with the surface of the charging member such that the charge unit can be disposed with respect to the image forming area in a contactless manner. Using these methods, the required gap may be maintained simply. For example, methods discussed in Japanese Laid-open Patent Publications No. 2002-148904 and 2002-148905 may be used.

Figure 8:
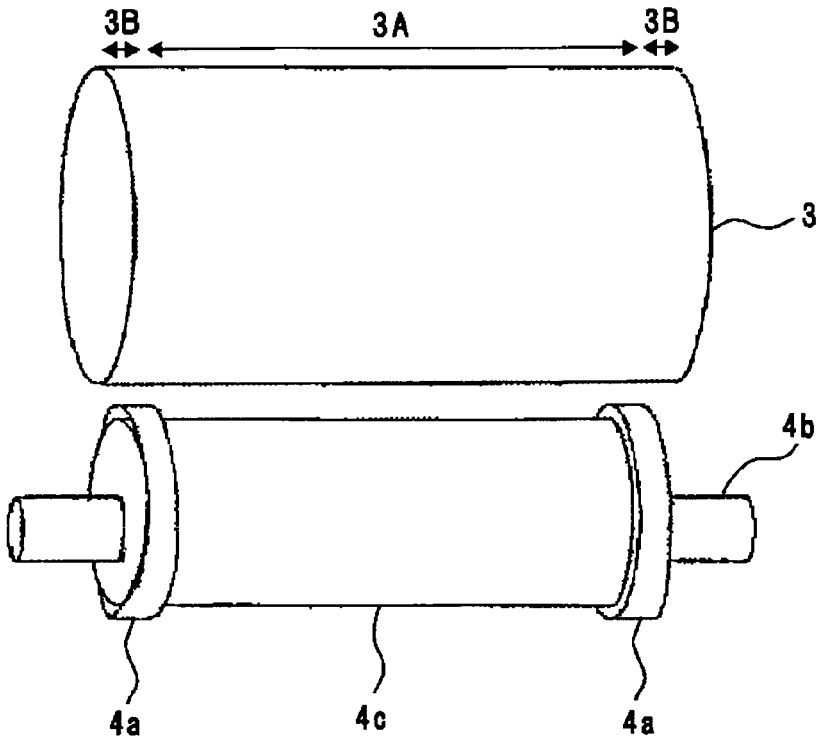
FIG. 8 illustrates a proximate charging mechanism of a charging roller.

FIG. 8 illustrates an example of the proximate charging mechanism in which the gap-forming members are disposed on the side of the charging member. In the proximate charging mechanism illustrated in FIG. 8, gap-forming members 4*a* are disposed at the ends of a charging roller 4*c* in the axial direction of a metal shaft 4*b*, which is a rotating shaft of the charging roller 4*c* disposed opposite the photosensitive drum 3. When the gap-forming members 4*a* are in contact with non-image forming areas 3B at the ends of the photosensitive drum 3 in the axial direction, a constant distance can be maintained between the image forming area 3A of the photosensitive drum 3 and the surface of the charging roller 4*c*.

By using the proximate charging mechanism illustrated in FIG. 8, a high charging efficiency may be achieved, the amount of produced ozone may be reduced, staining by toner and the like may be prevented, and the mechanical wear caused by contacts can be prevented. A voltage may be applied to the charging member by superposing an alternating current, whereby the problem of non-uniform charging may be prevented.

When a charging member of the contact type or the non-contact type is used, a uniform contact state or gap may not be obtained if the runout accuracy is low. However, as will be described in detail later, the photosensitive drum 3 according to the present embodiment has a high runout accuracy such that a uniform contact state or gap can be obtained.

The exposing unit (not illustrated in FIG. 7) that emits the laser light L may include a light source having high luminance, such as a light-emitting diode (LED), a semiconductor laser (LD), and an electroluminescence (EL) device. The light source in the neutralizing lamp 41 may include any light-emitting device, such as a fluorescent lamp, a tungsten lamp, a halogen lamp, a mercury lamp, a sodium-vapor lamp, a light-emitting diode (LED), a semiconductor laser (LD), and an electroluminescence (EL) device. In order to obtain a desired wavelength band of light, various filters may be used, such as a sharp cut filter, a band-pass filter, a near-infrared cut filter, a dichroic filter, an interference filter, and a color conversion filter.

In the printer 600, the toner image formed on the photosensitive drum 3 by the developing unit 5 is transferred onto the transfer sheet P. However, not all of the toner may be transferred and some toner may remain on the photosensitive drum 3. Such residual toner is removed from the surface of the photosensitive drum 3 by the fur brush 63 or the cleaning blade 61 of the drum cleaning unit 6. The drum cleaning unit 6 may include only a cleaning brush, such as a fur brush or a magfur brush.

When the surface of the photosensitive drum 3 is positively (or negatively) charged and then exposed, a positive (or negative) electrostatic latent image is formed on the surface of the photosensitive drum 3. When the electrostatic latent image is developed by a negative toner (electricity-detecting fine particles), a positive image is obtained. When developed by a positive toner, a negative image is obtained. Various types of developing unit may be used, and various types of neutralizing unit may be used.

The various units of the printer 600 according to Embodiment 2 illustrated in FIG. 7 may be fixedly built inside a copy machine, a facsimile machine, or a printer. Alternatively, the units may be provided inside such apparatuses as a process cartridge. The process cartridge refers to a unit that contains a photosensitive body, a charging unit, an exposing unit, a developing unit, a transfer unit, a cleaning unit, and a neutralizing unit, for example. Thus, by using the process cartridge, the various image-forming units can be integrally attached to or detached from the main body of an image forming apparatus.

Figure 9:
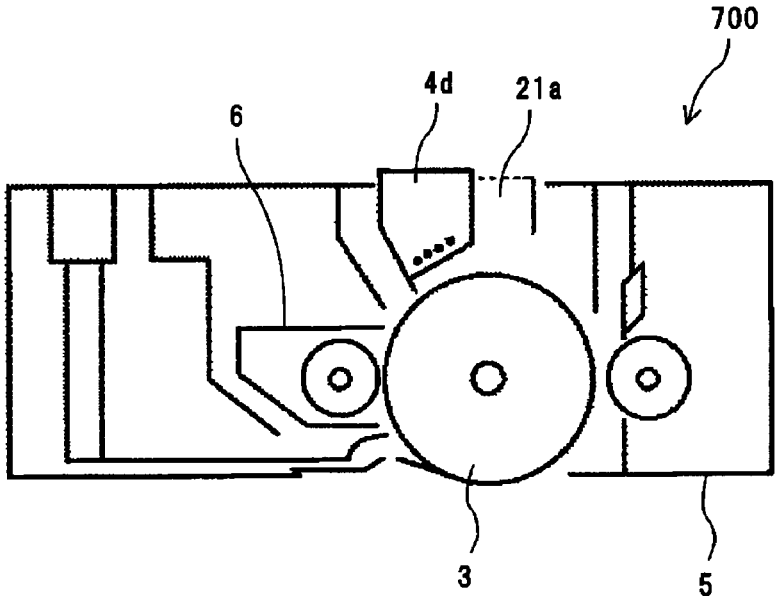
FIG. 9 illustrates a process cartridge that may be used in the printer of Embodiment 2.

FIG. 9 illustrates a process cartridge 700 that may be applied in the printer 600 according to Embodiment 2. The process cartridge 700 includes the photosensitive drum 3, the developing unit 5, a frame member including an image exposing portion 21*a*, a charger 4*d*, and the drum cleaning unit 6. Thus, the various image-forming units can be integrally attached to or detached from the main body of an image forming apparatus.

The embodiments of the present invention are not limited to the tandem-type image forming apparatus having plural photosensitive bodies according to Embodiment 1 illustrated in FIG. 2, or the image forming apparatus according to Embodiment 2 illustrated in FIG. 7 which is configured to transfer a single-color image formed on the single photosensitive body directly onto the recording medium. An image forming apparatus according to another embodiment may include a single photosensitive body and a plurality of developing units disposed opposite the photosensitive body, so that toner images of a plurality of colors can be formed on the photosensitive body and finally transferred onto a recording medium.

EXPERIMENT 1

Next, a description will be given of Experiment 1 in which, with regard to plural examples of the flange member 35 according to Example 1 in which the location, the number, and the outer size of the stress-absorbing opening 316 were varied. Experiment 1 was conducted to determine the amount of runout of the flange member 35 when mounted on the photosensitive drum 3, and the color reproduction characteristics of an image forming apparatus including the photosensitive drum 3. The structure of the flange member 35 is not limited to those of the examples described below. It is noted that the term "parts" refers to "parts by weight".

EXAMPLE 1-1

The base 32 of aluminum and having an outer diameter of 60 mm was coated with an intermediate-layer-coating liquid having a composition described below and then dried at 130° C. for 20 minutes, thereby forming an intermediate layer of about 3.5 μm. Further, a charge-generating-layer coating liquid having a composition described below was applied and then dried at 130° C. for 20 minutes, thereby forming a charge generating layer of about 0.2 μm. Thereafter, a charge transport layer coating liquid having a composition described below was applied and then dried at 130° C. for 20 minutes, thereby forming a charge transport layer of about 30 μm. In this way, the photosensitive layer 31 was formed on the outer peripheral surface of the base 32, thus forming the sleeve 30. Then, the flange member 35 illustrated in FIG. 1 was press-fitted into the end-opening portions 34 of the sleeve 30, thereby forming the photosensitive drum 3 according to Example 1-1.

The composition of the intermediate-layer-coating liquid was as follows:

- Titanium oxide CR-EL (manufactured by Ishihara Sangyo Kaisha, Ltd.): 50 parts
- Alkyd resin Beckolite M6401-50 (solid content 50% by weight, manufactured by Dainippon Ink and Chemicals, Incorporated): 15 parts
- Melamine resin L-145-60 (solid content 60% by weight, manufactured by Dainippon Ink and Chemicals, Incorporated): 8 parts
- 2-butanone: 120 parts The composition of the charge-generating-layer coating liquid was as follows.

- Asymmetric bisazo pigment expressed by the following structural formula (1): 2.5 parts
- Polyvinyl butyral ("XYHL" manufactured by UCC): 0.5 parts
- Methylethylketone: 110 parts
- Cyclohexanone: 260 parts

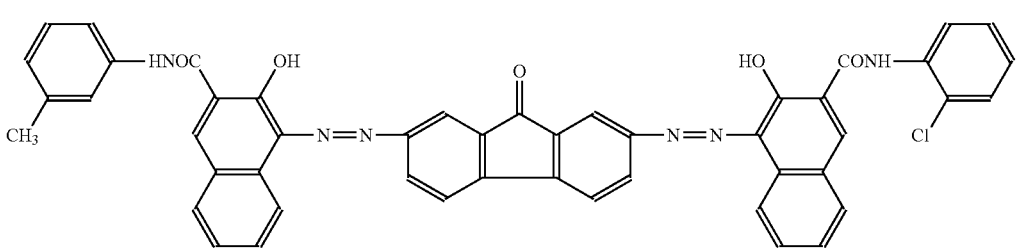

(1)

(1)

The composition of the charge transport layer coating liquid was as follows.

- Polycarbonate (Z Polica, manufactured by Teijin Chemicals, Ltd.): 10 parts
- Charge transport compound having a structural formula (2) indicated below: 7 parts
- Tetrahydrofuran: 80 parts
- Silicone oil (KF50-100cs, manufactured by Shin-Etsu Chemical Co., Ltd.): 0.002 part

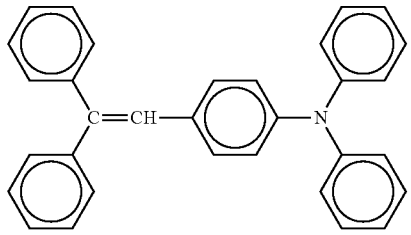

(2)

(2)

EXAMPLE 1-2

Figure 10:
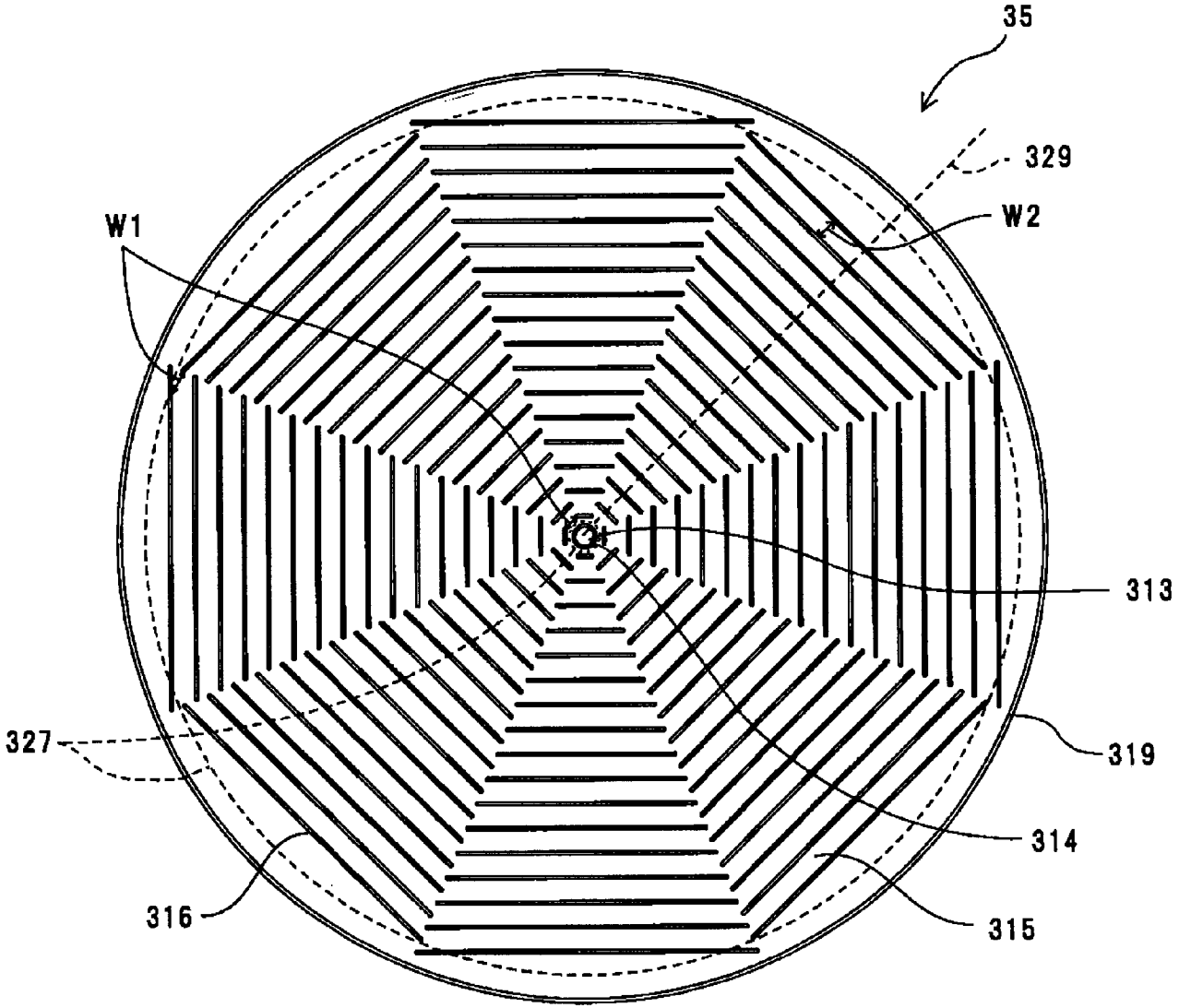
FIG. 10 illustrates the flange member according to Examples 1-2, 2-2, and 3-2.

The photosensitive drum 3 was prepared in the same way as in Example 1-1 with the exception that the base 32 included an aluminum tubular member having an outer diameter of 300 mm and that the flange member 35 had a configuration illustrated in FIG. 10.

FIG. 10 illustrates the flange member 35 as seen from the direction of an arrow D in FIG. 5. The position of the circumference of the imaginary projected circle 312*c* is not illustrated because it substantially corresponds to the position of the inner peripheral surface of the outer-rim portion 319. The same about the orientation of the flange member 35 and the omission of illustration of the imaginary projected circle 312*c* also applies to Examples 1-3 through 1-22 illustrated in FIGS. 11 through 30.

EXAMPLE 1-3

Figure 11:
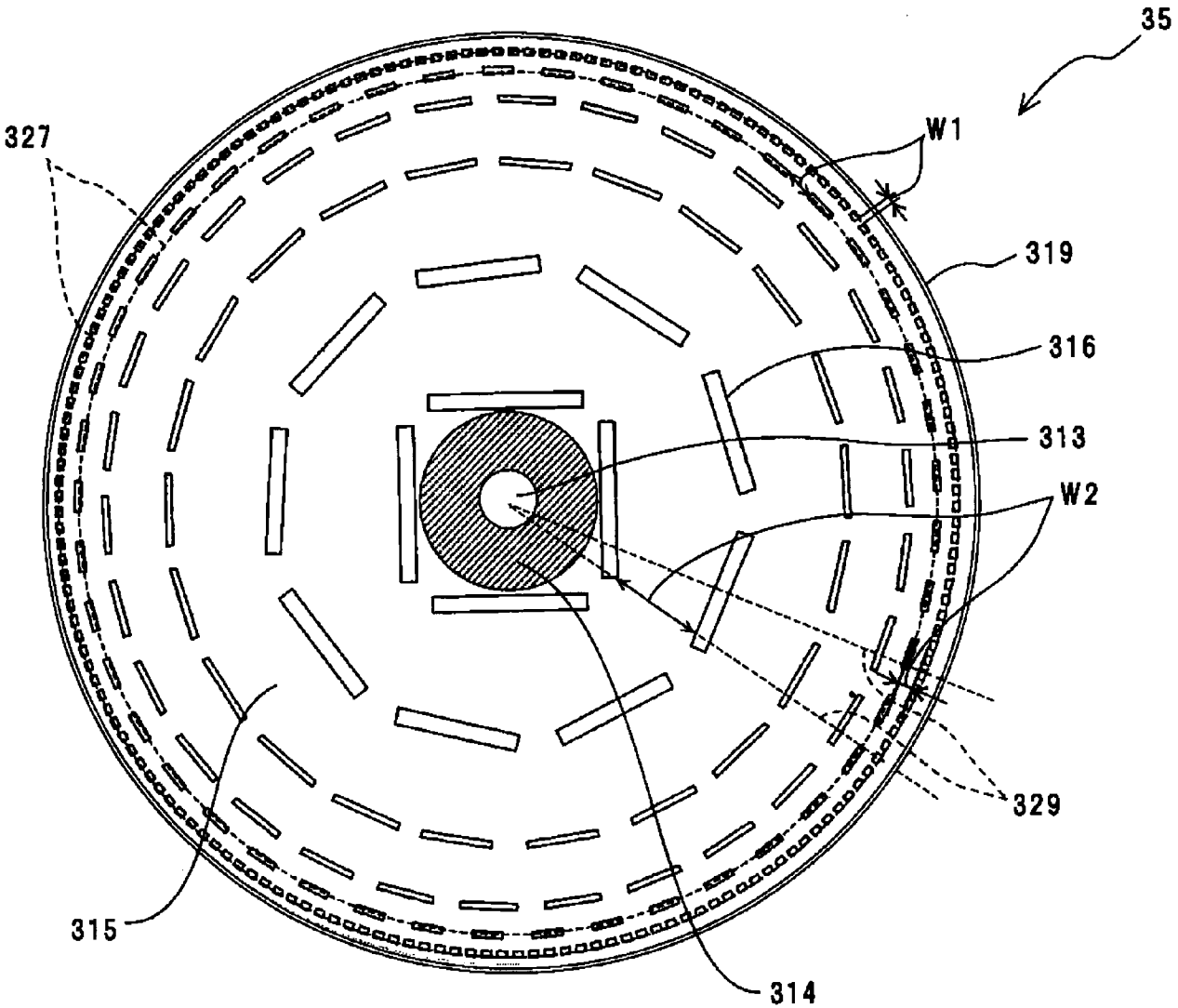
FIG. 11 illustrates the flange member according to Examples 1-3, 2-3, and 3-3.

The photosensitive drum 3 was prepared in the same way as in Example 1-1 with the exception that the base 32 included an aluminum tubular member having an outer diameter of 300 mm and that the flange member 35 had a configuration illustrated in FIG. 11.

EXAMPLE 1-4

Figure 12:
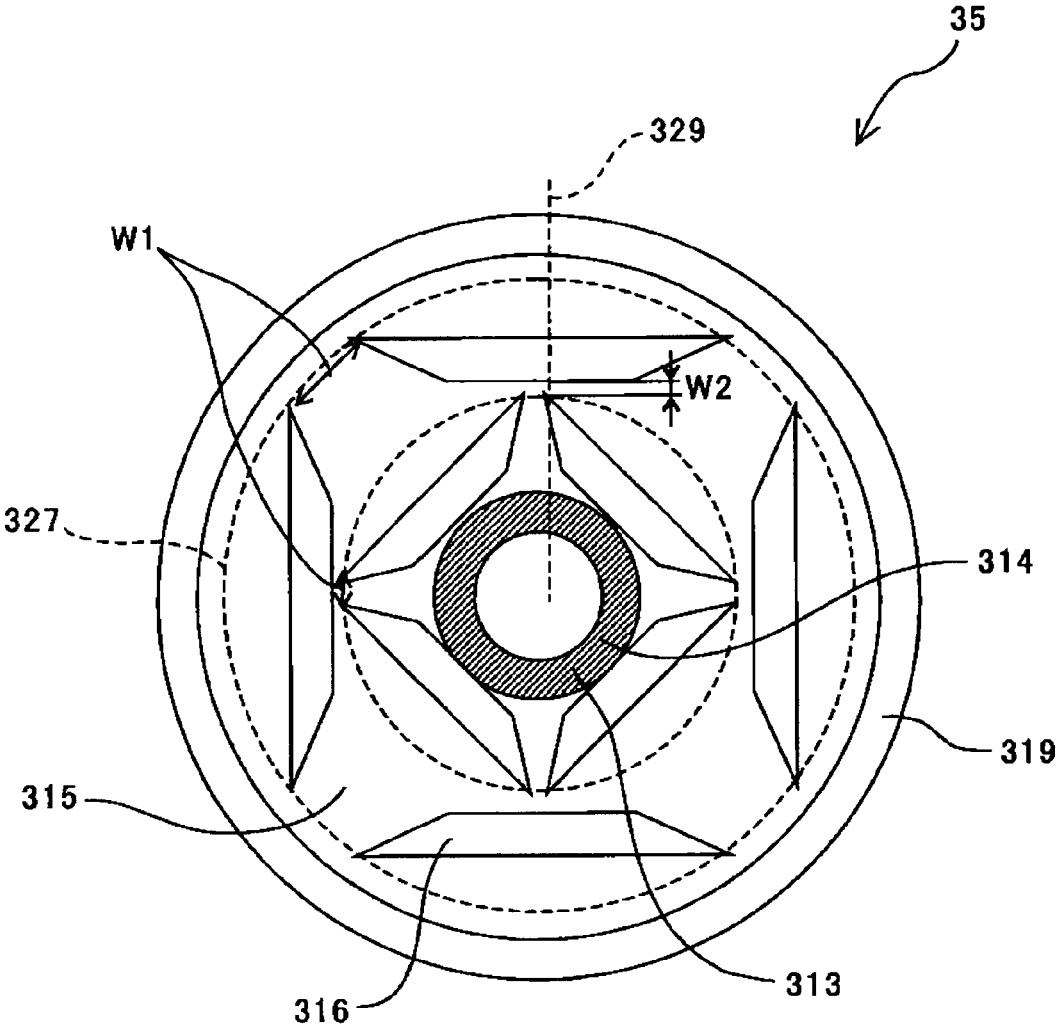
FIG. 12 illustrates the flange member according to Examples 1-4, 2-4, and 3-4.

The photosensitive drum 3 was prepared in the same way as in Example 1-1 with the exception that the base 32 included an aluminum tubular member having an outer diameter of 30 mm and that the flange member 35 had a configuration illustrated in FIG. 12.

EXAMPLE 1-5

Figure 13:
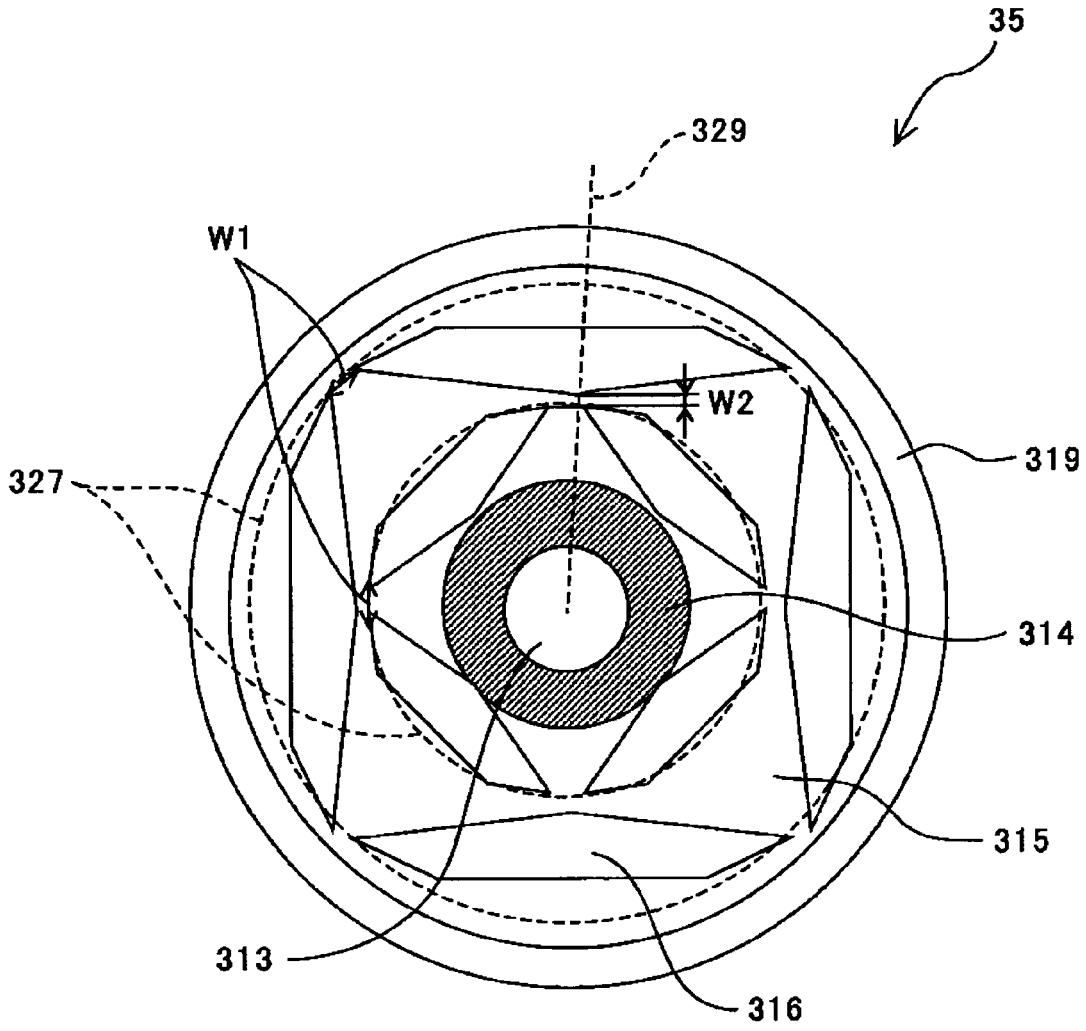
FIG. 13 illustrates the flange member according to Examples 1-5, 2-5, and 3-5.

The photosensitive drum 3 was prepared in the same way as in Example 1-1 with the exception that the base 32 included an aluminum tubular member having an outer diameter of 30 mm and that the flange member 35 had a configuration illustrated in FIG. 13.

EXAMPLE 1-6

Figure 14:
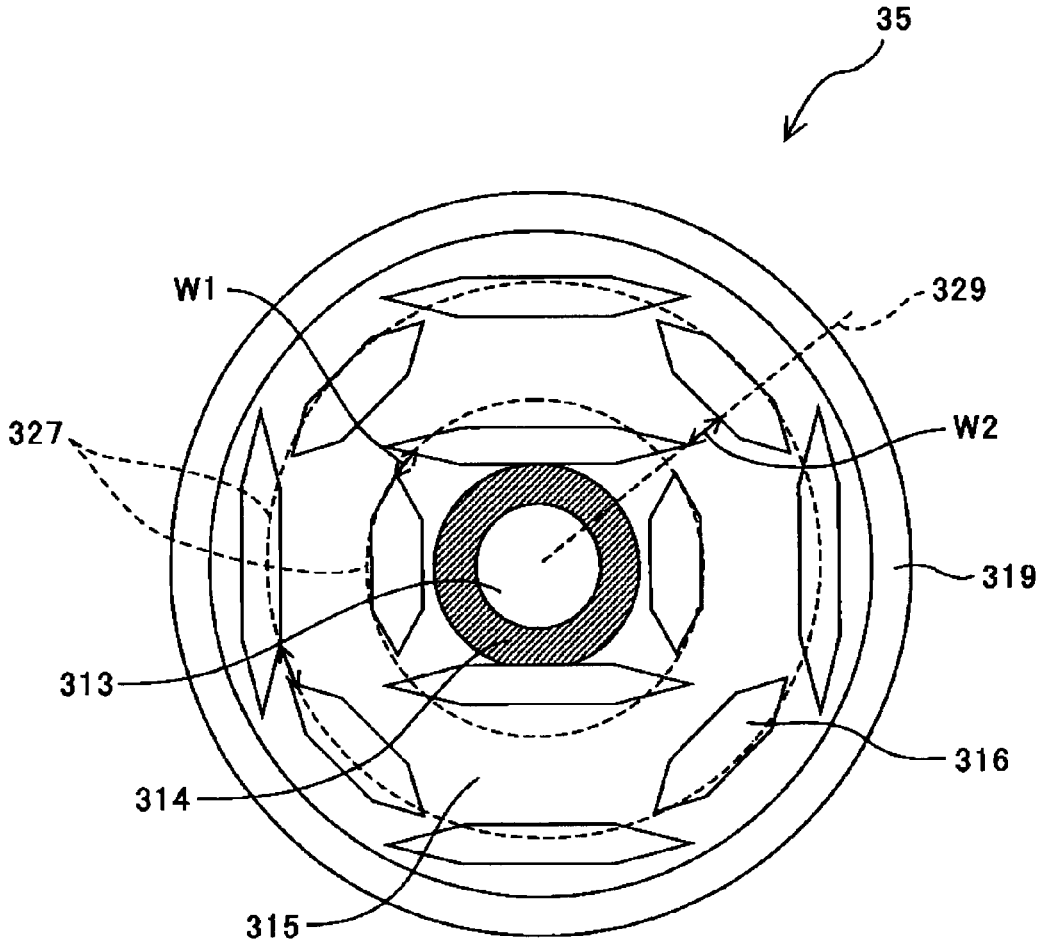
FIG. 14 illustrates the flange member according to Examples 1-6, 2-6, and 3-6.

The photosensitive drum 3 was prepared in the same way as in Example 1-1 with the exception that the base 32 included an aluminum tubular member having an outer diameter of 30 mm and that the flange member 35 had a configuration illustrated in FIG. 14.

EXAMPLE 1-7

Figure 15:
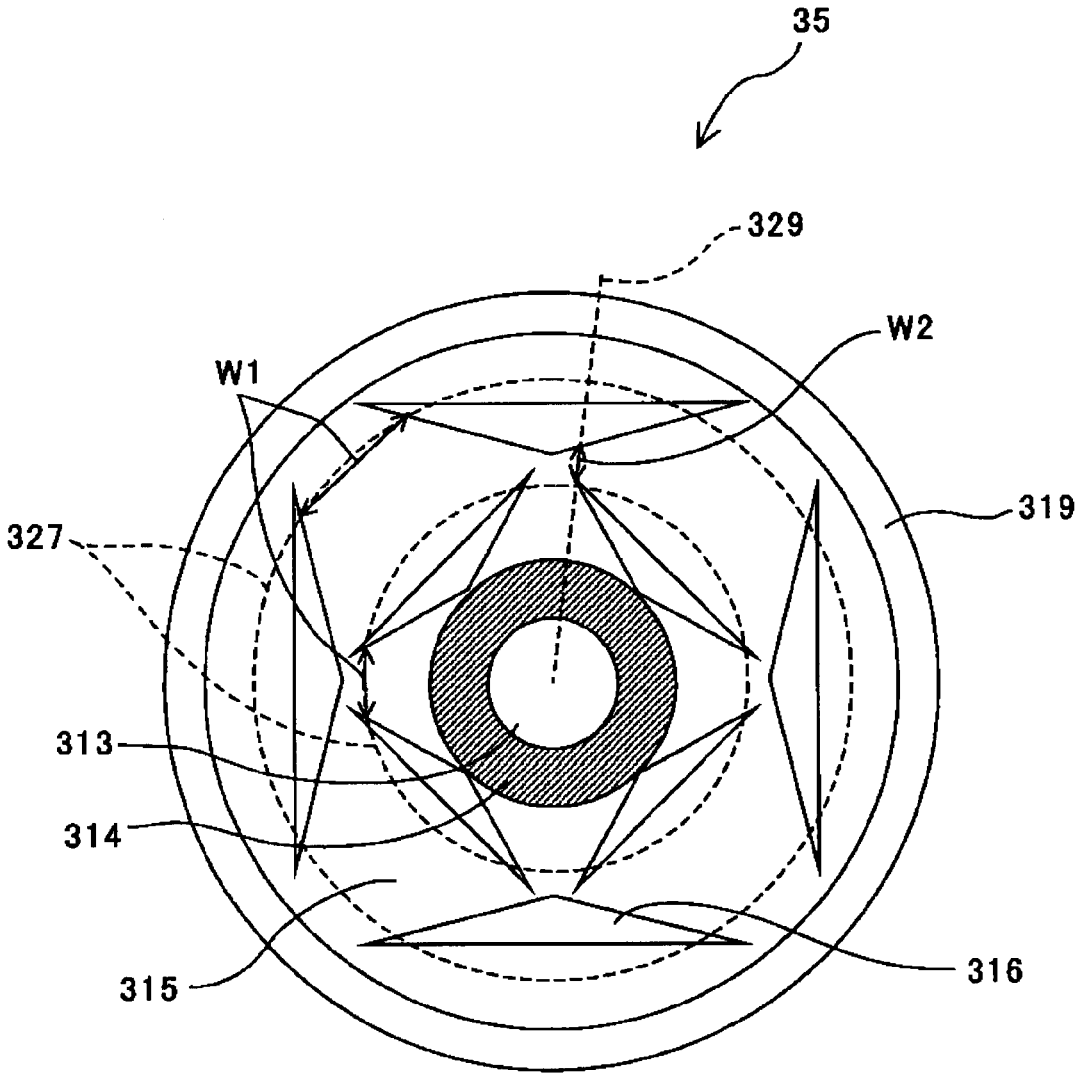
FIG. 15 illustrates the flange member according to Examples 1-7, 2-7, and 3-7.

The photosensitive drum 3 was prepared in the same way as in Example 1-1 with the exception that the base 32 included an aluminum tubular member having an outer diameter of 30 mm, and that the flange member 35 had a configuration illustrated in FIG. 15.

EXAMPLE 1-8

Figure 16:
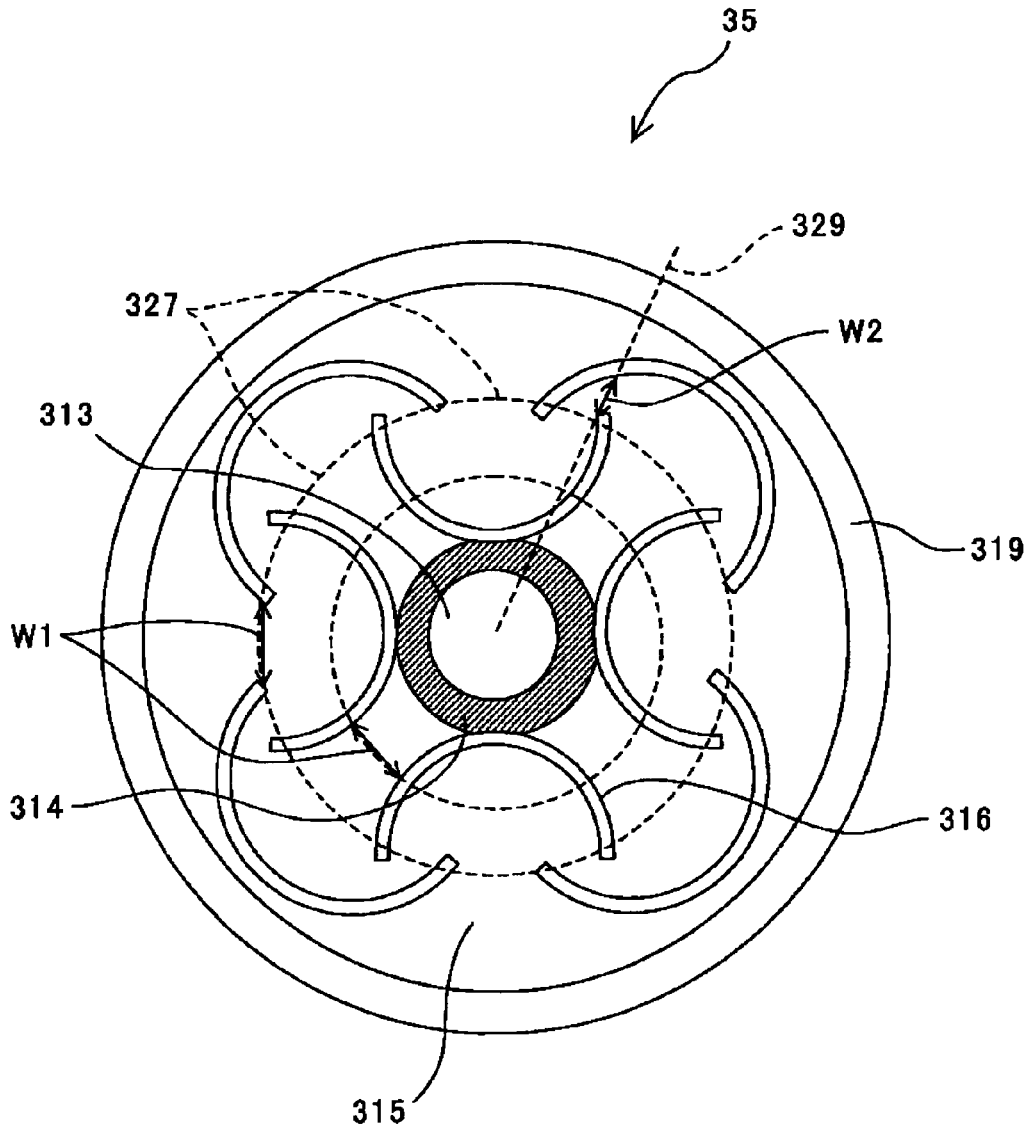
FIG. 16 illustrates the flange member according to Examples 1-8, 2-8, and 3-8.

The photosensitive drum 3 was prepared in the same way as in Example 1-1 with the exception that the base 32 had an aluminum tubular member having an outer diameter of 30 mm and that the flange member 35 had a configuration illustrated in FIG. 16.

EXAMPLE 1-9

Figure 17:
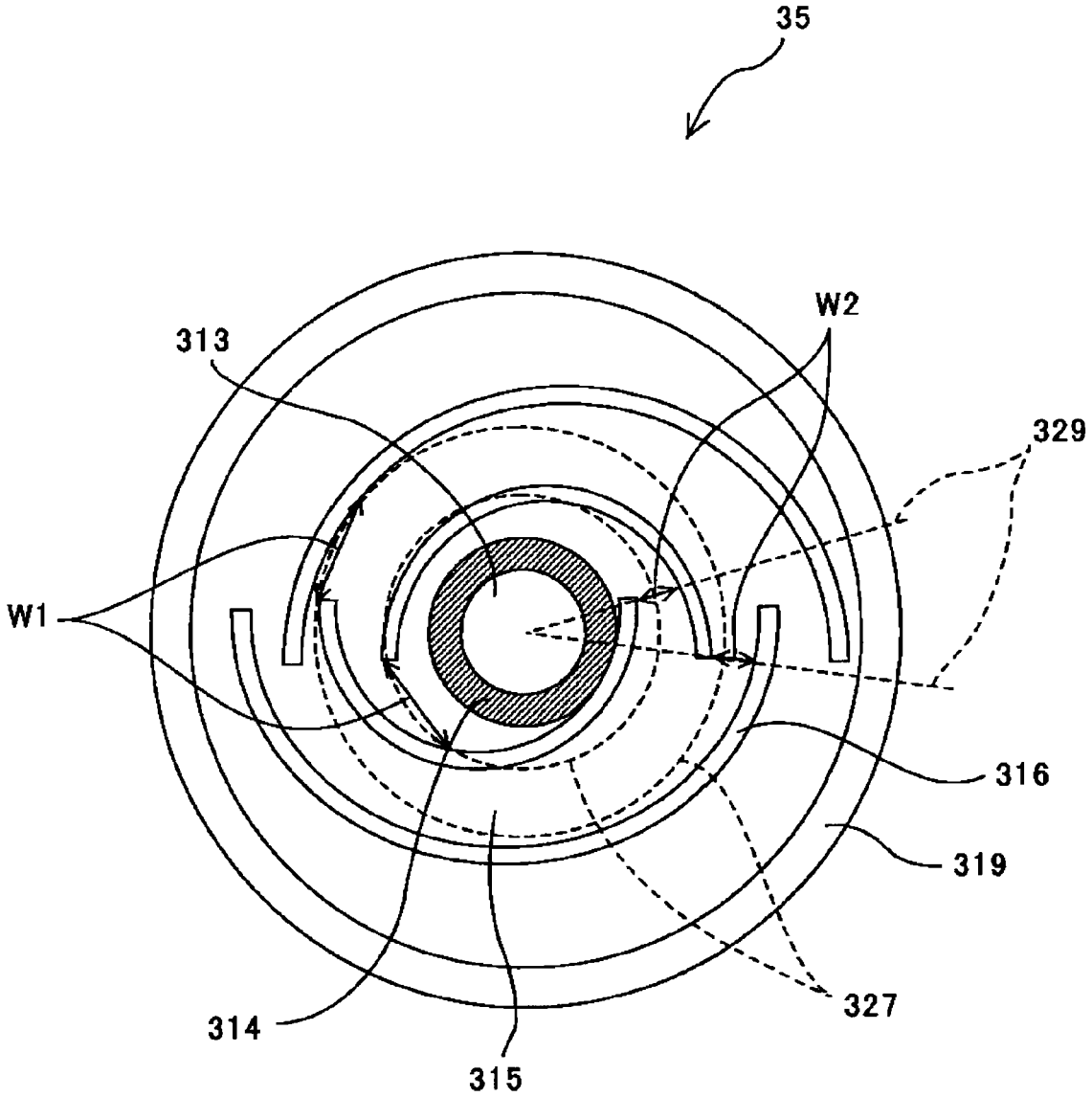
FIG. 17 illustrates the flange member according to Examples 1-9, 2-9, and 3-9.

The photosensitive drum 3 was prepared in the same way as in Example 1-1 with the exception that the base 32 had an aluminum tubular member having an outer diameter of 30 mm and that the flange member 35 had a configuration illustrated in FIG. 17.

EXAMPLE 1-10

Figure 18:
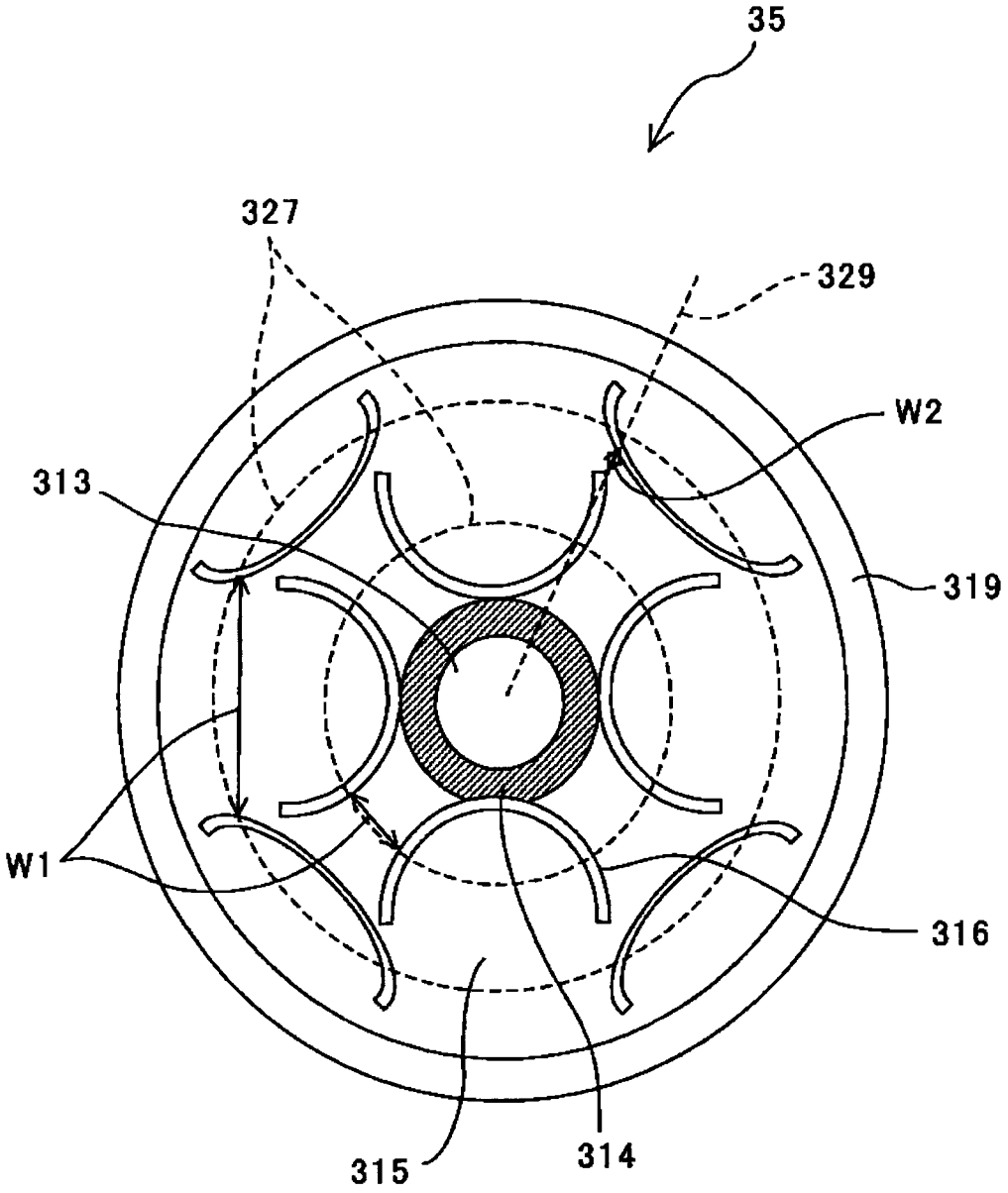
FIG. 18 illustrates the flange member according to Examples 1-10, 2-10, and 3-10.

The photosensitive drum 3 was prepared in the same way as in Example 1-1 with the exception that the base 32 had an aluminum tubular member having an outer diameter of 30 mm and that the flange member 35 had a configuration illustrated in FIG. 18.

EXAMPLE 1-11

Figure 19:
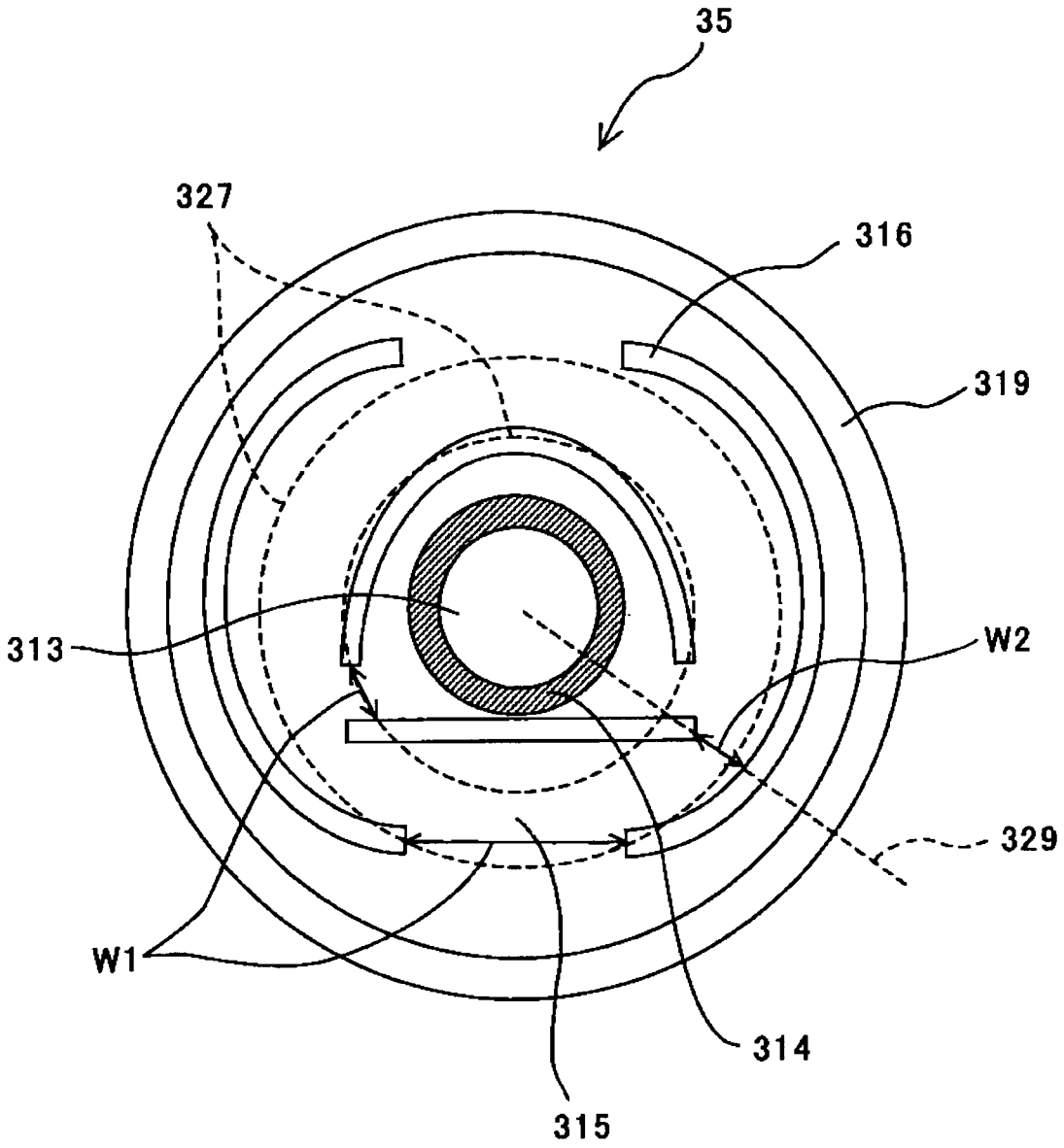
FIG. 19 illustrates the flange member according to Examples 1-11, 2-11, and 3-11.

The photosensitive drum 3 was prepared in the same way as in Example 1-1 with the exception that the base 32 had an aluminum tubular member having an outer diameter of 30 mm and that the flange member 35 had a configuration illustrated in FIG. 19.

EXAMPLE 1-12

Figure 20:
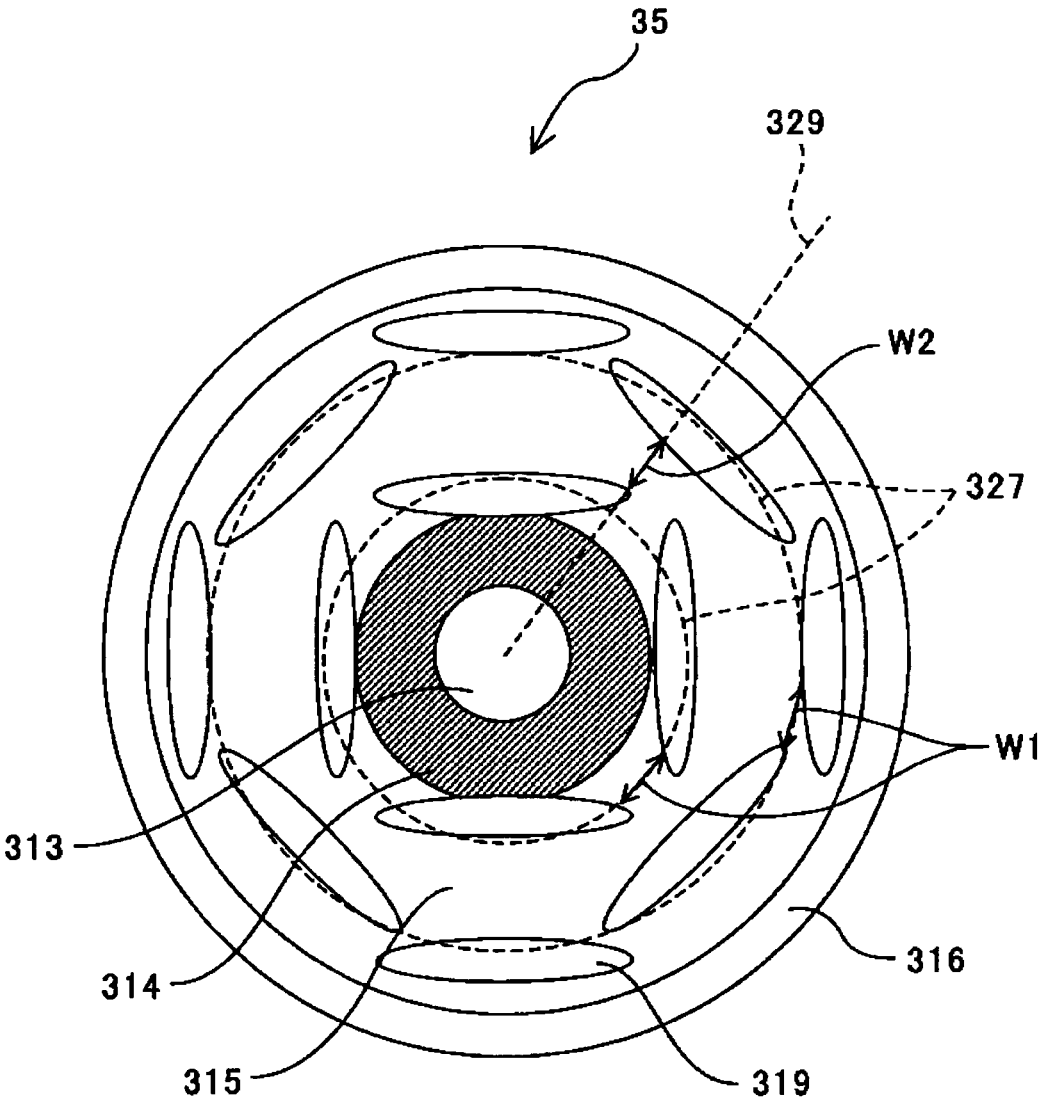
FIG. 20 illustrates the flange member according to Examples 1-12, 2-12, and 3-12.

The photosensitive drum 3 was prepared in the same way as in Example 1-1 with the exception that the base 32 had an aluminum tubular member having an outer diameter of 30 mm and that the flange member 35 had a configuration illustrated in FIG. 20.

EXAMPLE 1-13

Figure 21:
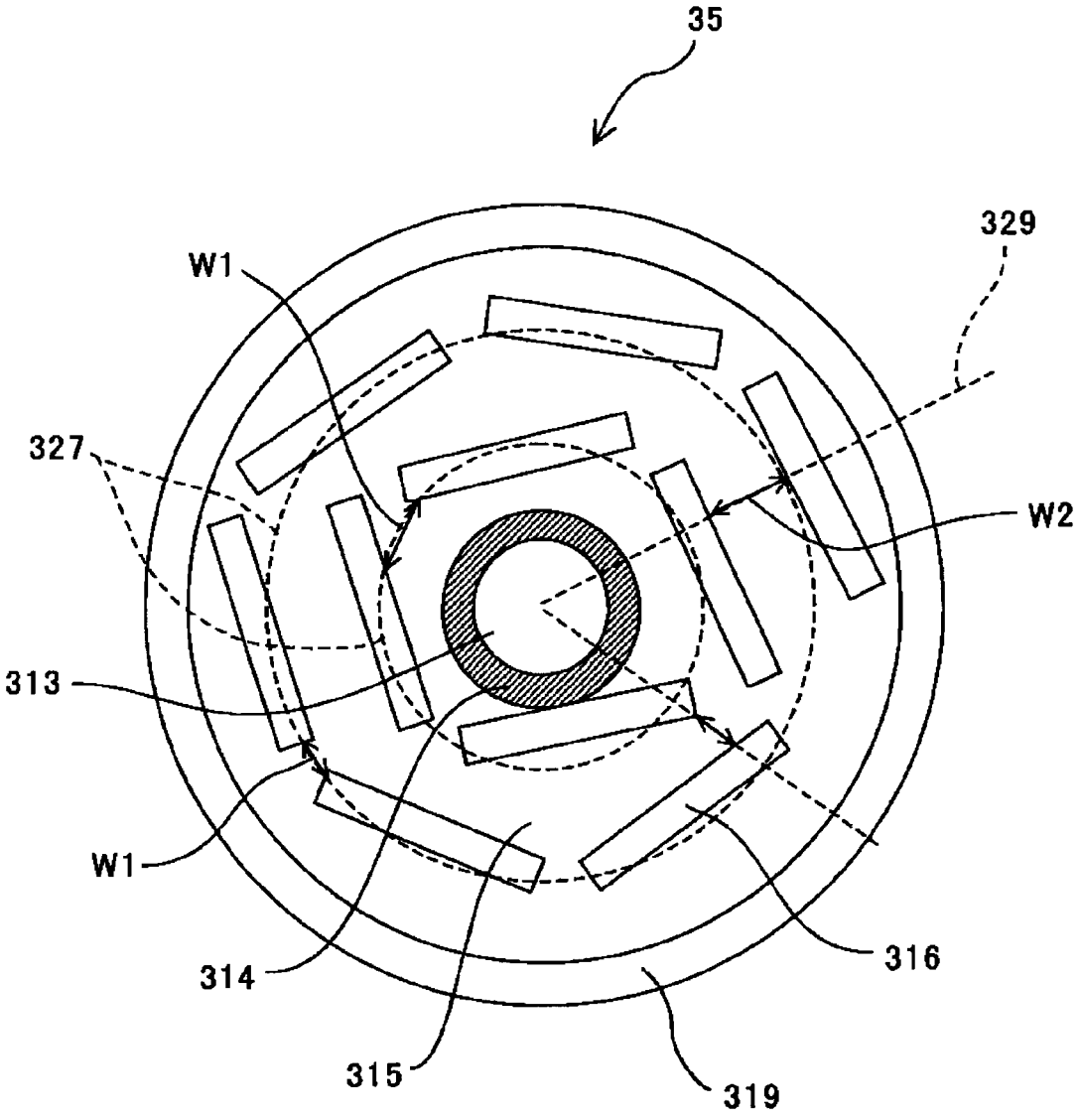
FIG. 21 illustrates the flange member according to Examples 1-13, 2-13, and 3-13.

The photosensitive drum 3 was prepared in the same way as in Example 1-1 with the exception that the base 32 had an aluminum tubular member having an outer diameter of 30 mm, and that the flange member 35 had a configuration illustrated in FIG. 21.

EXAMPLE 1-14

Figure 22:
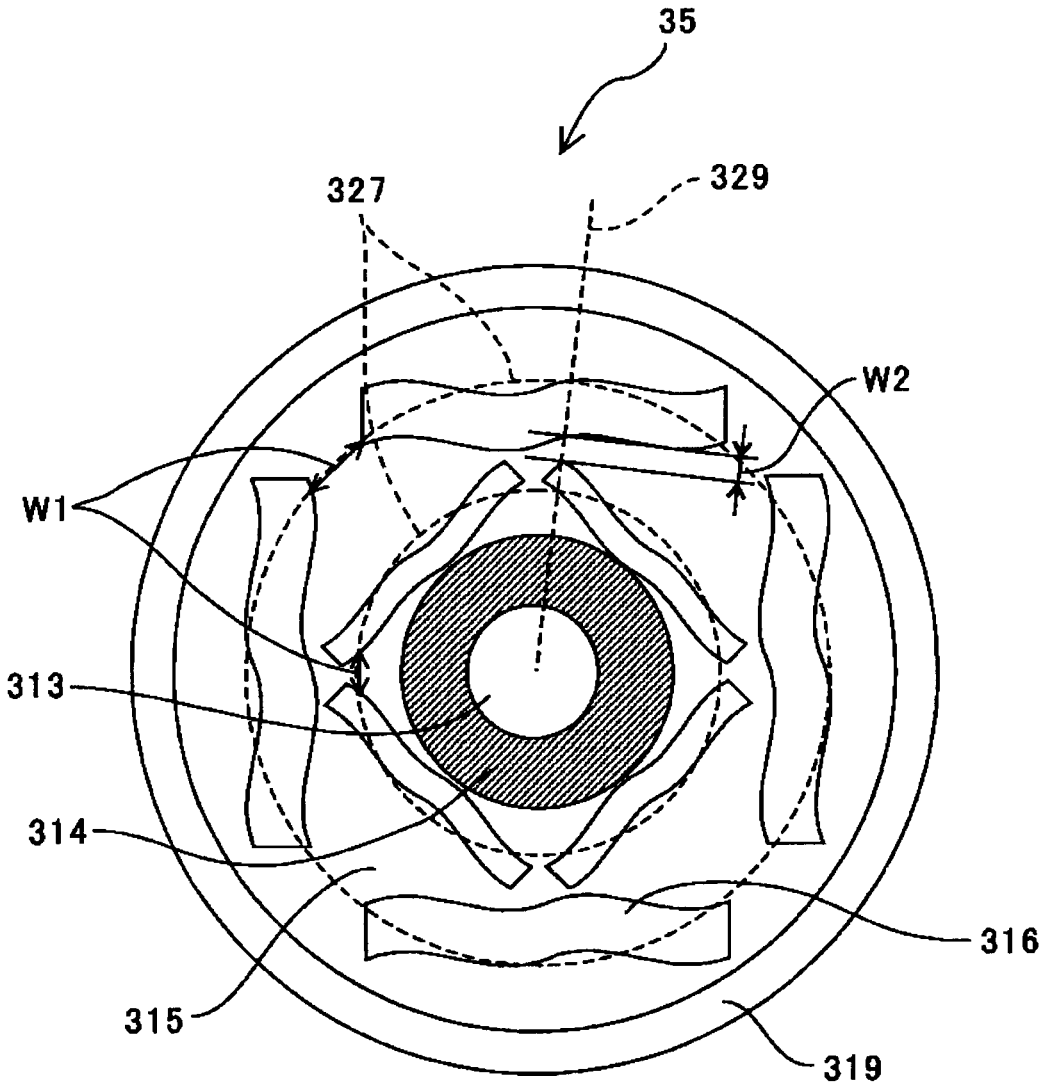
FIG. 22 illustrates the flange member according to Examples 1-14, 2-14, and 3-14.

The photosensitive drum 3 was prepared in the same way as in Example 1-1 with the exception that the base 32 had an aluminum tubular member having an outer diameter of 30 mm, and that the flange member 35 had a configuration illustrated in FIG. 22.

EXAMPLE 1-15

Figure 23:
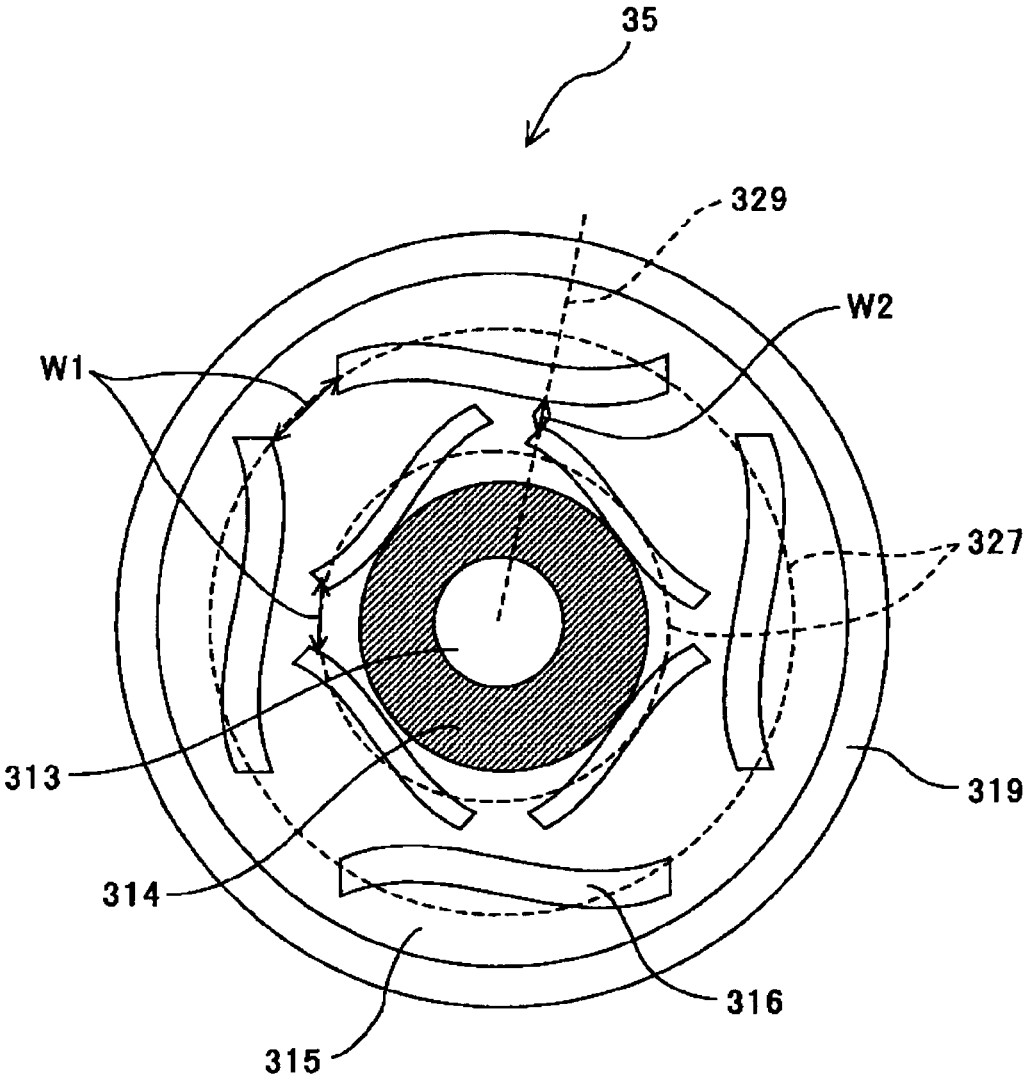
FIG. 23 illustrates the flange member according to Examples 1-15, 2-15, and 3-15.

The photosensitive drum 3 was prepared in the same way as in Example 1-1 with the exception that the base 32 had an aluminum tubular member having an outer diameter of 30 mm, and that the flange member 35 had a configuration illustrated in FIG. 23.

EXAMPLE 1-16

Figure 24:
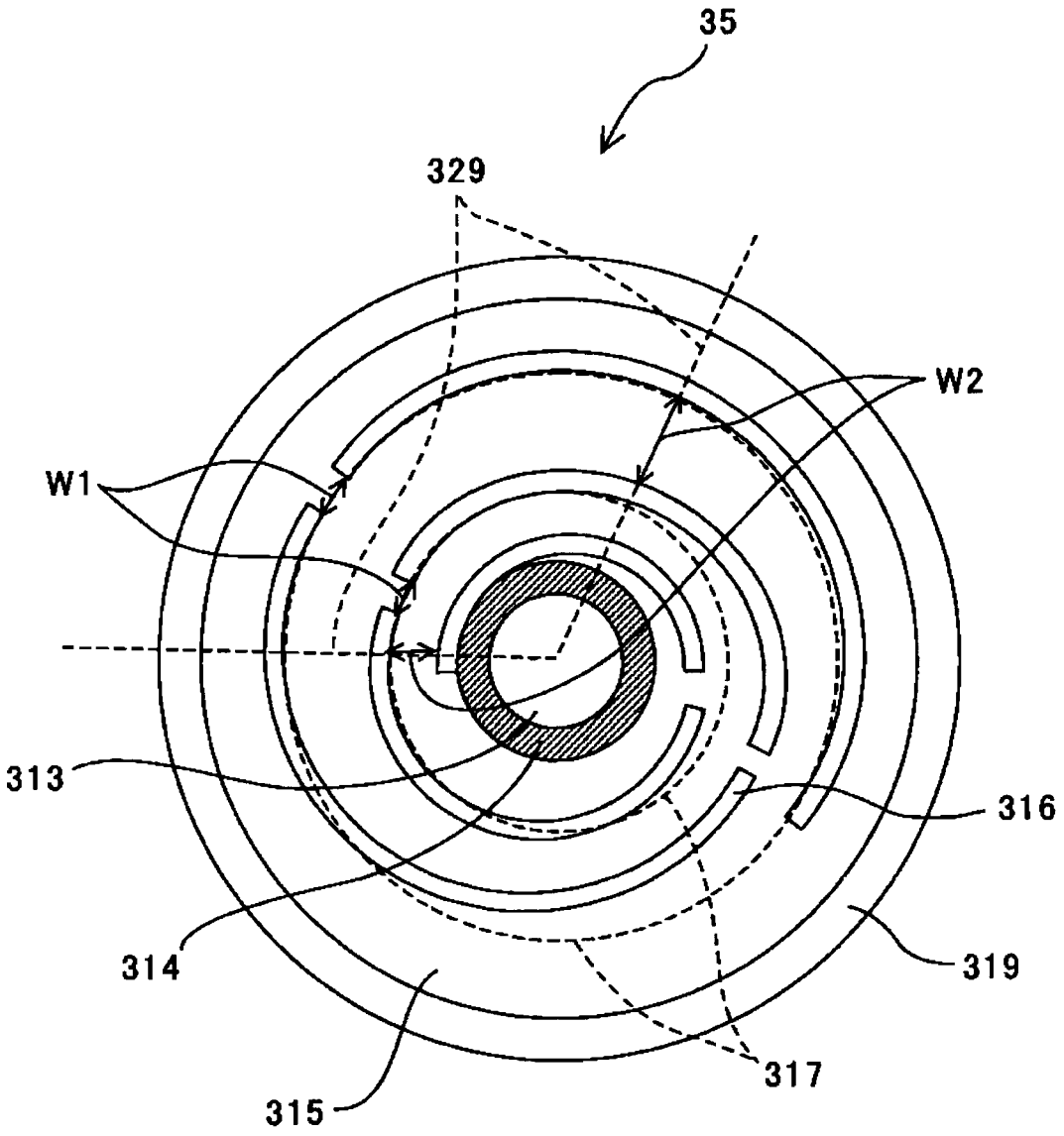
FIG. 24 illustrates the flange member according to Examples 1-16, 2-16, and 3-16.

The photosensitive drum 3 was prepared in the same way as in Example 1-1 with the exception that the base 32 had an aluminum tubular member having an outer diameter of 30 mm, and that the flange member 35 had a configuration illustrated in FIG. 24.

EXAMPLE 1-17

Figure 25:
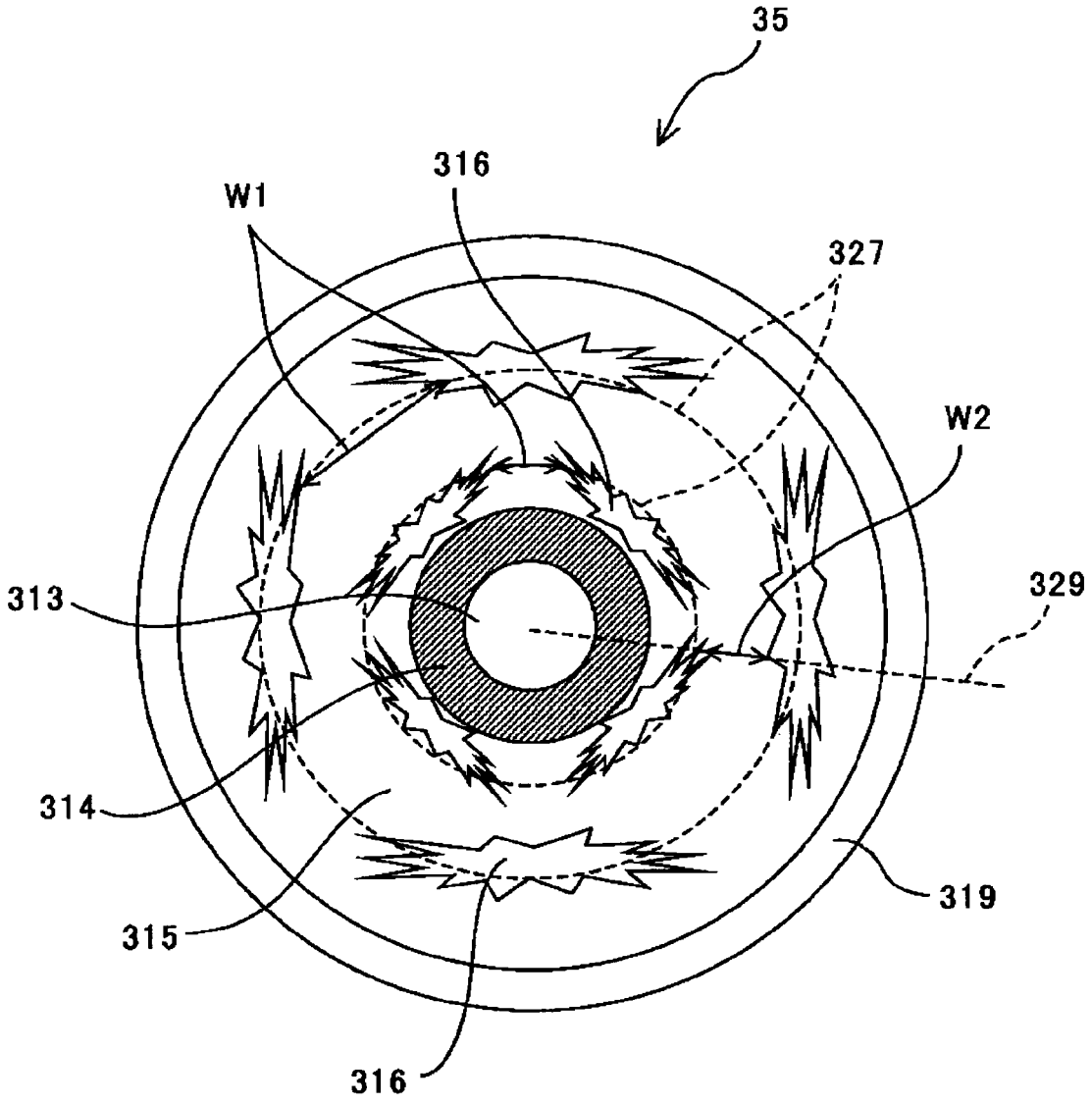
FIG. 25 illustrates the flange member according to Examples 1-17, 2-17, and 3-17.

The photosensitive drum 3 was prepared in the same way as in Example 1-1 with the exception that the base 32 had an aluminum tubular member having an outer diameter of 30 mm, and that the flange member 35 had a configuration illustrated in FIG. 25.

EXAMPLE 1-18

Figure 26:
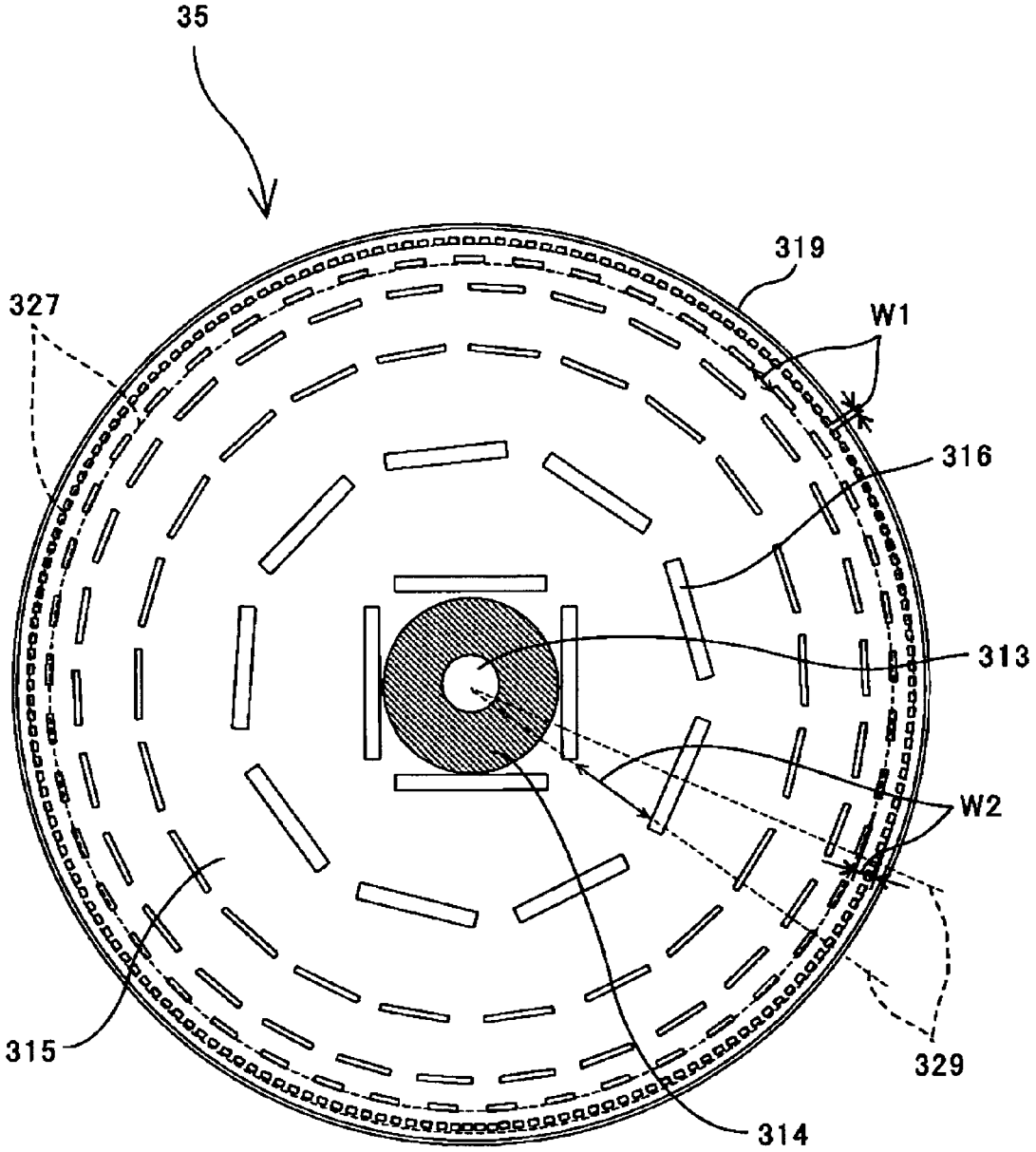
FIG. 26 illustrates the flange member according to Examples 1-18, 2-18, and 3-23.

The photosensitive drum 3 was prepared in the same way as in Example 1-1 with the exception that the base 32 included an aluminum tubular member having an outer diameter of 300 mm, and that the flange member 35 had a configuration illustrated in FIG. 26.

EXAMPLE 1-19

Figure 27:
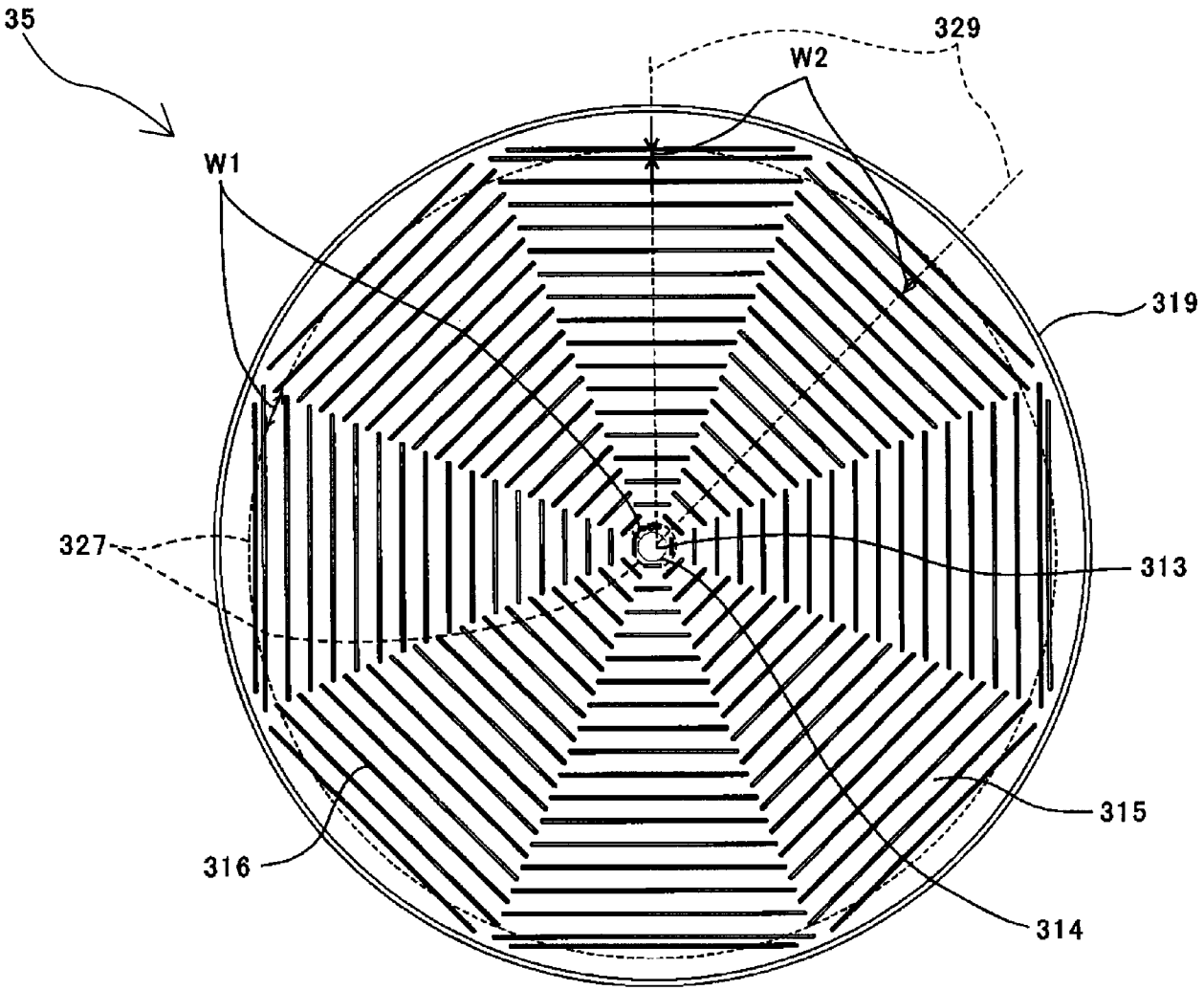
FIG. 27 illustrates the flange member according to Examples 1-19, 2-19, and 3-24.

The photosensitive drum 3 was prepared in the same way as in Example 1-1 with the exception that the base 32 included an aluminum tubular member having an outer diameter of 300 mm, and that the flange member 35 had a configuration illustrated in FIG. 27.

EXAMPLE 1-20

Figure 28:
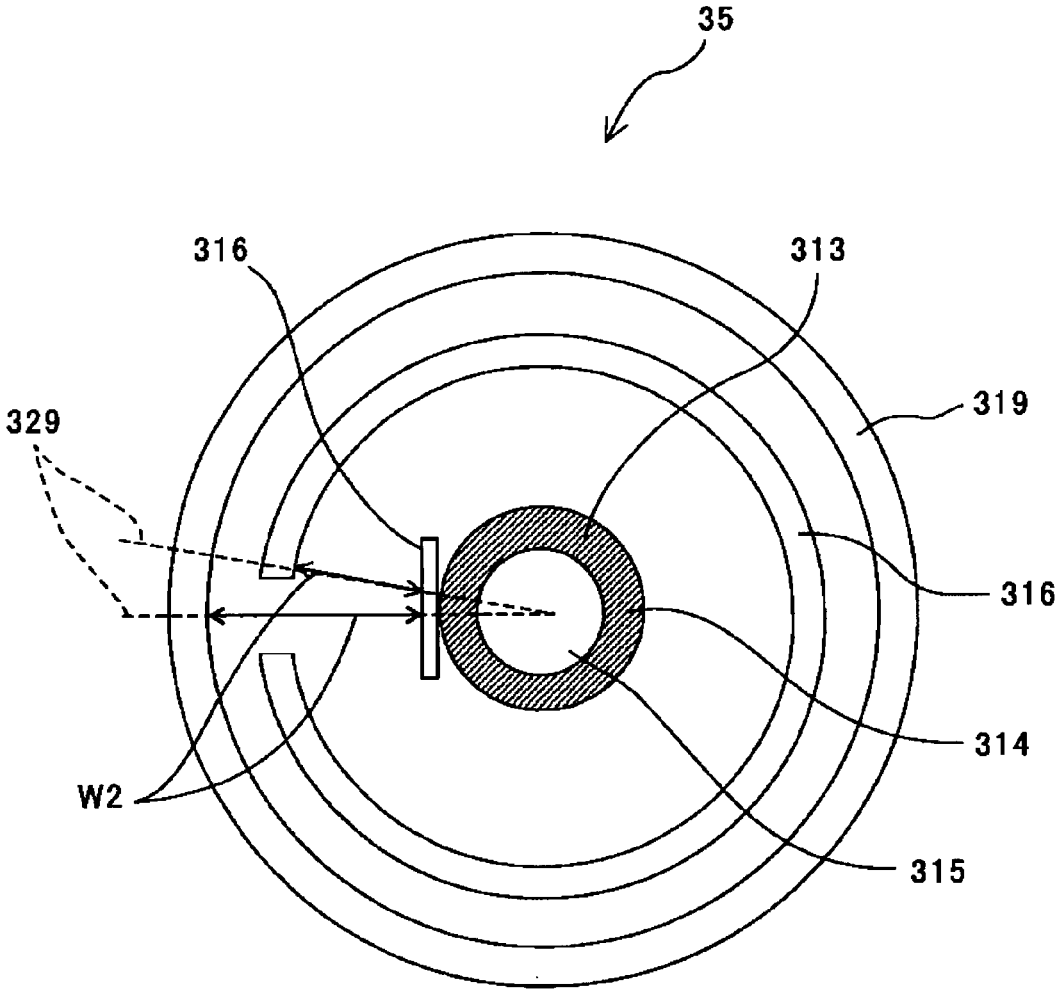
FIG. 28 illustrates the flange member according to Examples 1-20, 2-20, and 3-25.

The photosensitive drum 3 was prepared in the same way as in Example 1-1 with the exception that the base 32 included an aluminum tubular member having an outer diameter of 300 mm, and that the flange member 35 had a configuration illustrated in FIG. 28.

EXAMPLE 1-21

Figure 29:
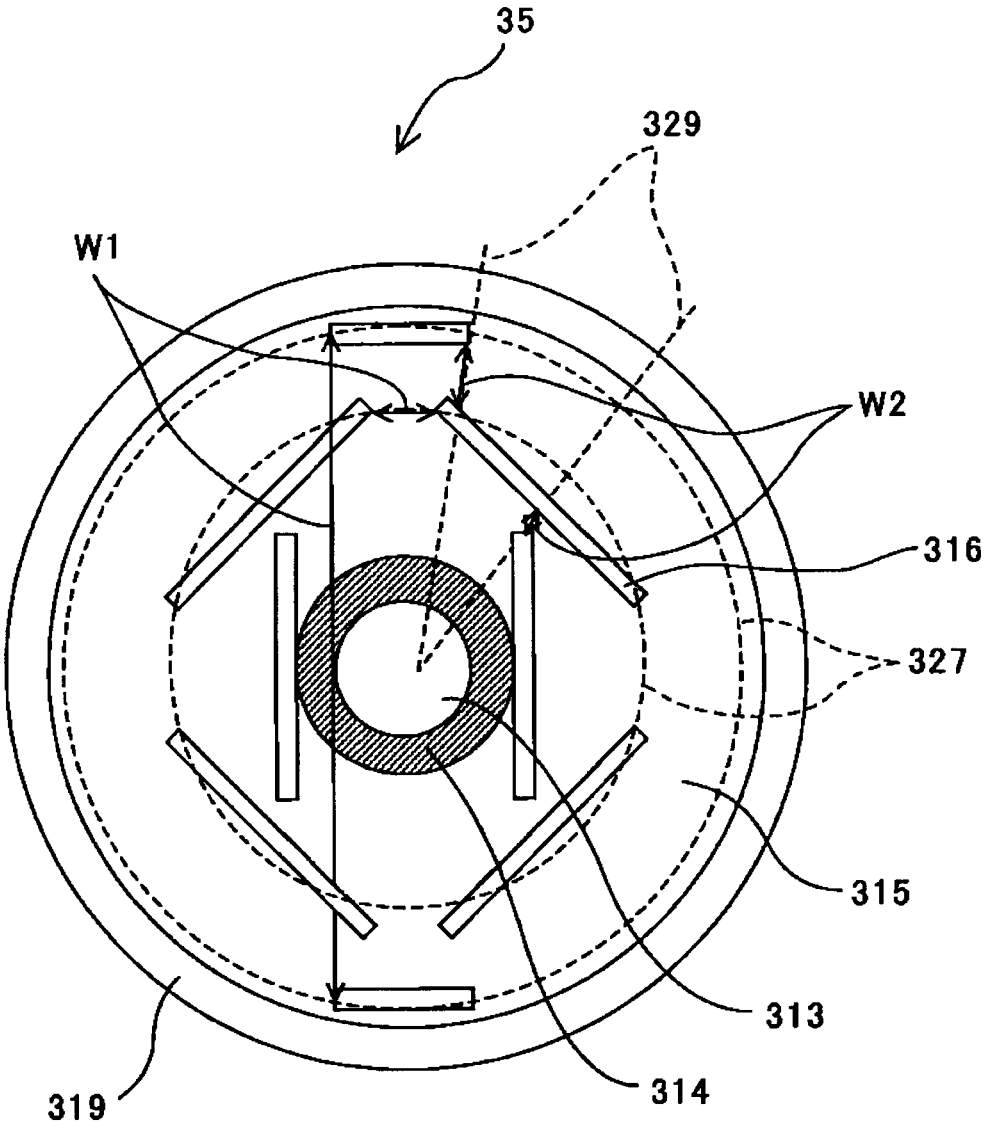
FIG. 29 illustrates the flange member according to Examples 1-21, 2-21, and 3-26.

The photosensitive drum 3 was prepared in the same way as in Example 1-1 with the exception that the base 32 included an aluminum tubular member having an outer diameter of 300 mm, and that the flange member 35 had a configuration illustrated in FIG. 29.

EXAMPLE 1-22

Figure 30:
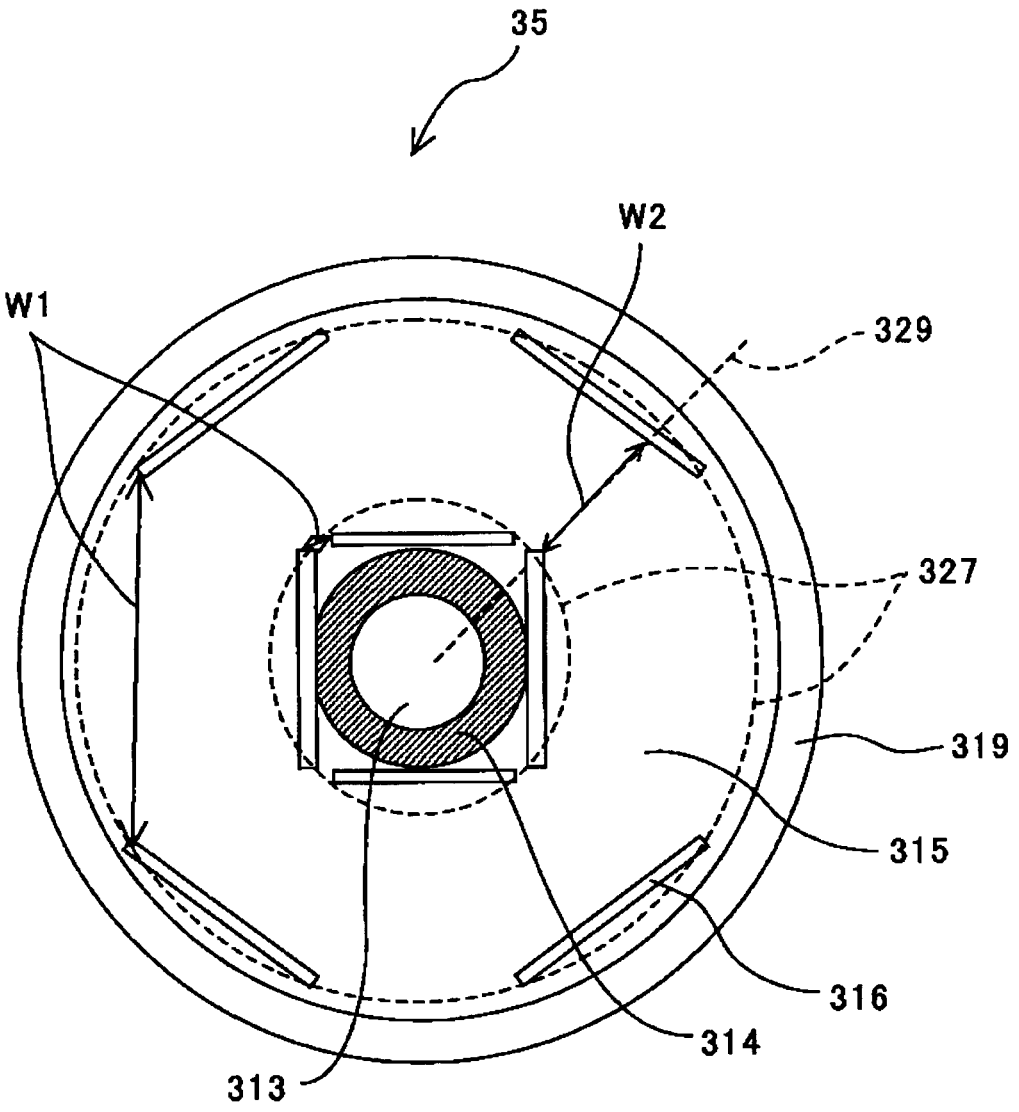
FIG. 30 illustrates the flange member according to Examples 1-22, 2-22, and 3-27.

The photosensitive drum 3 was prepared in the same way as in Example 1-1 with the exception that the base 32 included an aluminum tubular member having an outer diameter of 300 mm, and that the flange member 35 had a configuration illustrated in FIG. 30.

COMPARATIVE EXAMPLE 1

Figure 31A:
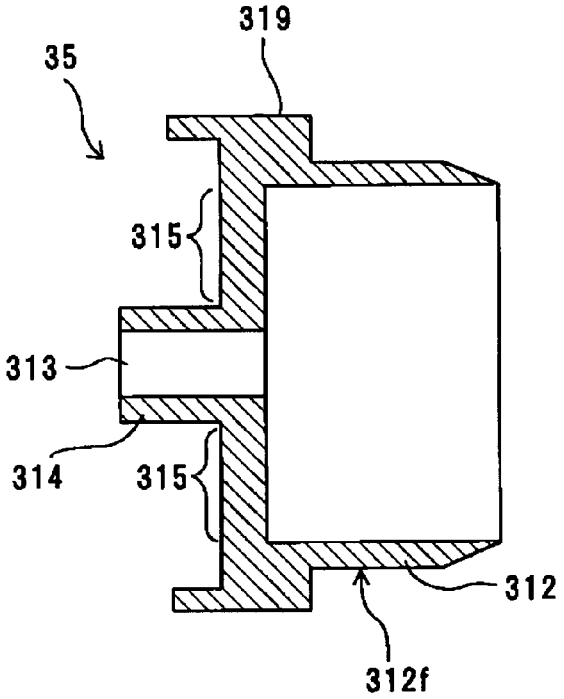
FIG. 31A is a cross section of the flange member according to Comparative Examples 1, 2, and 3 taken perpendicular to the axial direction.
Figure 31B:
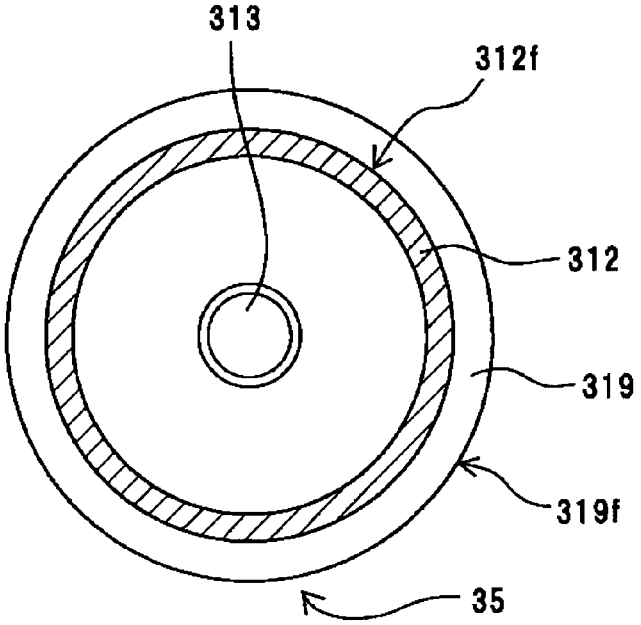
FIG. 31B is a cross section of the flange member according to Comparative Examples 1, 2, and 3 taken along the axial direction.

The photosensitive drum 3 was prepared in the same way as in Example 1-1 with the exception that the flange member 35 had a configuration illustrated in FIGS. 31A and 31B. The flange member 35 illustrated in FIGS. 31A and 31B does not include the stress-absorbing opening 316. FIG. 31A is a cross section of the flange member 35 taken along line A-A of FIG. 5. FIG. 310 is a cross section of the flange member 35 taken along line B-B of FIG. 5.

Table 1 illustrates the measurements of the flange member 35 according to Examples 1-1 through 1-22 and Comparative Example 1, and the results of Experiment 1.

TABLE 1

| | | | | | | F | | G | | | |
|---|---|---|---|---|---|---|---|---|---|---|---|
| Ex | A | B | C | D | E1 | Max | Min | Max | Min | H | I |
| 1 | 60 | 1 | 4 | 3 | Yes | 30 | 8 | 6 | 4 | 10 | 5 |
| 2 | 300 | 10 | 8 | 33 | Yes | 6 | 3 | 4 | 2 | 18 | 4 |
| 3 | 300 | 11 | 180 | 6 | Yes | 8 | 2 | 18 | 4 | 19 | 4 |
| 4 | 30 | 12 | 4 | 2 | Yes | 6 | 2 | 1 | 1 | 9 | 5 |
| 5 | 30 | 13 | 4 | 2 | Yes | 3 | 2 | 1 | 1 | 10 | 5 |
| 6 | 30 | 14 | 8 | 2 | Yes | 3 | 2 | 3 | 3 | 11 | 5 |
| 7 | 30 | 15 | 4 | 2 | Yes | 8 | 4 | 2 | 2 | 12 | 4 |
| 8 | 30 | 16 | 4 | 2 | No | 6 | 5 | 3 | 3 | 16 | 4 |
| 9 | 30 | 17 | 2 | 4 | No | 10 | 8 | 4 | 2 | 14 | 5 |
| 10 | 30 | 18 | 4 | 2 | No | 20 | 8 | 2 | 2 | 14 | 5 |
| 11 | 30 | 19 | 2 | 2 | No | 18 | 4 | 4 | 4 | 17 | 4 |
| 12 | 30 | 20 | 8 | 2 | No | 5 | 4 | 4 | 4 | 12 | 5 |
| 13 | 30 | 21 | 5 | 2 | No | 6 | 4 | 8 | 4 | 14 | 4 |
| 14 | 30 | 22 | 4 | 2 | No | 6 | 3 | 2 | 2 | 11 | 5 |
| 15 | 30 | 23 | 4 | 2 | No | 8 | 6 | 2 | 2 | 12 | 4 |
| 16 | 30 | 24 | 2 | 3 | No | 4 | 2 | 12 | 4 | 14 | 5 |
| 17 | 30 | 25 | 4 | 2 | No | 12 | 4 | 4 | 4 | 16 | 4 |
| 18 | 300 | 26 | 181 | 6 | Yes | 3 | 0.9 | 15 | 0.9 | 25 | 3 |
| 19 | 300 | 27 | 8 | 34 | Yes | 2 | 4 | 4 | 1 | 21 | 3 |
| 20 | 300 | 28 | 1 | 2 | Yes | — | — | 100 | 50 | 29 | 3 |
| 21 | 300 | 29 | 4 | 2 | Yes | 281 | 16 | 16 | 8 | 25 | 3 |
| 22 | 300 | 30 | 4 | 2 | Yes | 100 | 8 | 141 | 141 | 22 | 3 |
| CE1 | 60 | 31 | 0 | 0 | No | — | — | — | — | 36 | 2 |

Ex: Example
CE: Comparative Example
A: Outer diameter of the base (mm)
B: Figure of flange used
C: Circumferential maximum number
D: Radial maximum number
E1: Does the stress-absorbing opening have an edge that perpendicularly intersects the radius?
F: Circumferential interval (mm)
G: Radial interval (mm)
H: Runout (μm)
I: Color reproduction characteristics
(The same designations also apply to Tables 2 and 3 below.)

In Table 1, the "Circumferential maximum number" (C) indicates the number of the stress-absorbing openings 316 that intersect one of imaginary circles 327, each of which is formed by a set of points at the same distance from the center of the flange member 35, that is intersected by the maximum number of the stress-absorbing openings 316.

The "Radial maximum number" (D) indicates the number of the stress-absorbing openings 316 that intersect one of arbitrary radii 329 drawn from the center of the flange member 35 to the outer-rim portion 319 that is intersected by the maximum number of the stress-absorbing openings 316.

The "Circumferential interval" (F) indicates an interval W1 between the stress-absorbing openings 316 adjacent to each other on the imaginary circles 327.

The "Radial interval" (G) indicates an interval W2 between the stress-absorbing openings 316 adjacent to each other on the arbitrary radii 329.

The "Runout" (H) indicates the amount of displacement in the distance between a reference position opposite the surface of the photosensitive drum 3 and the surface of the photosensitive drum 3 when the photosensitive drum 3 was rotated about the rotating axis. Specifically, the runout indicates a "total run-out" value obtained by subtracting a minimum value of the distance between the reference position and the surface of the photosensitive drum 3 from its maximum value when the photosensitive drum 3 makes a full rotation. The runout value was measured by using equipment including a mechanism for holding and rotating the assembled photosensitive body while aligning the axial center between the left and right ends of the drum, and a laser meter (Type LS-7030 manufactured by KEYENCE CORPORATION).

Figure 32A:
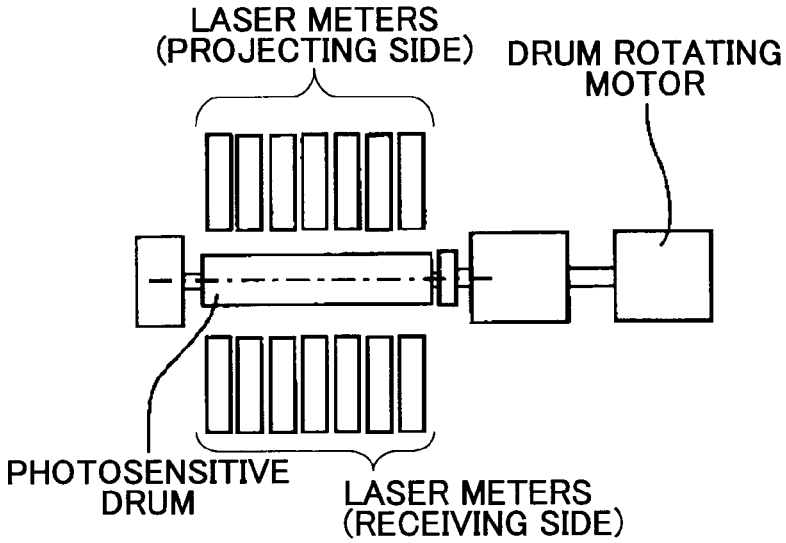
FIG. 32A is an upper view of a measuring apparatus used for measuring the runout of the photosensitive drum.
Figure 32B:
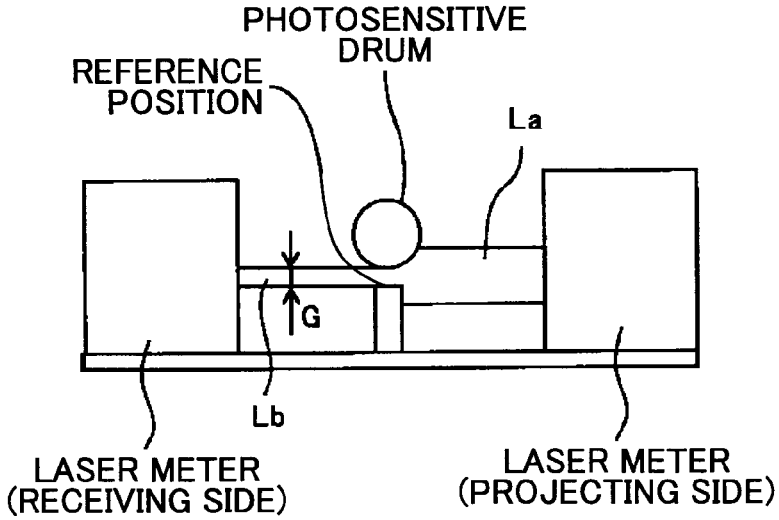
FIG. 32B is a side view of the measuring apparatus.

FIGS. 32A and 32B illustrate the equipment used for measuring the runout of the photosensitive drum 3. FIG. 32A is a plan view, and FIG. 32B is a side view. As illustrated in FIG. 32B, a set of seven laser meters disposed on a light-projecting side emitted irradiating light beam La having a sufficient vertical (up-down in FIG. 32B) width into the gap between the lower edge of the photosensitive drum and the reference position. Of the irradiating light La, passed light Lb that passed the gap was received on a set of seven receiving-end laser meters. By measuring a vertical width G of the passed light beam Lb, the distance between the surface of the photosensitive drum 3 and the reference position was detected. Further, by measuring the vertical width G for the entire circumference of the photosensitive drum by using the seven sets of the laser meters, and then determining the difference between the maximum value and the minimum value of all of the measured values of the vertical width G, the "Runout" values in Table 1 were obtained.

When the runout value increases, the gap between a unit disposed near the surface of the photosensitive drum 3 and the surface of the photosensitive drum 3 becomes more and more uneven, resulting in greater density irregularities due to charge irregularities or development irregularities. The "Color reproduction characteristics" in Table 1 indicate the result of evaluation of color reproducibility of an image N1 (portrait) according to ISO/JIS-SCID output from an image forming apparatus equipped with the photosensitive drum 3 according to the Examples and Comparative Example 1.

As the image forming apparatus including the photosensitive drum 3, the Imagio Neo C325 manufactured by Ricoh Company, Ltd. was used for evaluating the photosensitive drum 3 having the base outer diameter of 30 mm. For evaluating the photosensitive drum 3 having the base outer diameter of 60 mm, the Imagio MP C6000 from Ricoh Company, Ltd. was used. For evaluating the photosensitive drum 3 having the base outer diameter of 300 mm, the image forming apparatus according to Embodiment 2 illustrated in FIG. 7 was used.

The color reproduction characteristics were evaluated on a scale of five ranks, as defined below. The ranks or evaluation references indicate the amount of error between images on the transfer sheet P when the same images were superposed on the transfer sheet P on an individual color basis.

Rank 1: Image error is 100 μm or more.
Rank 2: Image error is 70 μm or more and less than 100 μm.
Rank 3: Image error is 50 μm or more and less than 70 μm
Rank 4: Image error is 30 μm or more and less than 50 μm.
Rank 5: Image error is less than 30 μm.

Thus, in the flange member 35 according to Example 1, the stress-absorbing opening 316 includes a side that intersects the radius 329. Accordingly, the stress upon press fitting can be absorbed efficiently, and the deformation or displacement of the axle opening 313 can be reduced.

When the maximum number of the stress-absorbing openings 316 in the circumference direction is 2 or more and 180 or less, the deformation or displacement of the axle opening 313 may be further reduced. The term "circumference" herein refers to a circular line made up of a set of points having the same distance from the center of the flange. In the illustrated examples, the circumference may correspond to any of the imaginary circles 327.

Preferably, when the internal diameter of the base 32 for the photosensitive drum 3 is 40 mm or less, the maximum number of the stress-absorbing openings 316 in the circumference direction may be 2 or more and 30 or less. More preferably, the maximum number may be 3 or more and 12 or less in view of the balance between the prevention of deformation or displacement of the axle opening 313 and the difficulty of forming the flange member 35.

Preferably, when the internal diameter of the base 32 for the photosensitive drum 3 is 40 mm or more and 150 mm or less, the maximum number of the stress-absorbing openings 316 in the circumference direction may be 2 or more and 100 or less. More preferably, the maximum number may be 12 or more and 24 or less in view of the balance between the prevention of deformation or displacement of the axle opening 313 and the difficulty of forming the flange member 35. Further preferably, when the internal diameter of the base 32 for the photosensitive drum 3 is more than 150 mm, the maximum number of the stress-absorbing openings 316 in the circumference direction may be 2 or more and 180 or less. More preferably, the maximum number may be 24 or more and 48 or less in view of the balance between the prevention of deformation or displacement of the axle opening 313 and the difficulty of forming the flange member 35.

When the maximum number of the stress-absorbing openings 316 on the arbitrary radius 329 is 2 or more and 33 or less, the deformation or displacement of the axle opening may be further reduced. The "arbitrary radius 329" refers to a line connecting the center of the flange and an arbitrary point on the circumference. In accordance with the present embodiment, the flange member 35 includes at least one stress-absorbing portion 316 on the arbitrary imaginary line 318 drawn from the axle opening portion 314 to the imaginary projected circle 312*c*. Thus, there is at least one stress-absorbing opening in the radial direction.

Preferably, when the internal diameter of the base 32 for the photosensitive drum 30 is 40 mm or less, the maximum number of the stress-absorbing openings 316 in the radial direction may be 2 or more and 5 or less. More preferably, from the viewpoint of balance between the prevention of deformation or displacement of the axle opening 313 and the difficulty of forming the flange member 35, the maximum number may be 3 or more and 5 or less.

Preferably, when the internal diameter of the base 32 for the photosensitive drum 3 is 40 mm or more and 150 mm or less, the maximum number of the stress-absorbing openings 316 in the radial direction may be 2 or more and 20 or less. More preferably, from the viewpoint of balance between the prevention of deformation or displacement of the axle opening 313 and the difficulty of forming the flange member 35, the maximum number may be 4 or more and 10 or less.

Preferably, when the internal diameter of the base 32 for the photosensitive drum 3 is more than 150 mm, the maximum number of the stress-absorbing openings 316 in the radial direction may be 2 or more and 33 or less. More preferably, from the viewpoint of balance between the prevention of deformation or displacement of the axle opening 313 and the difficulty of forming the flange member 35, the maximum number may be 6 or more and 20 or less.

When the interval of the stress-absorbing openings 316 adjacent to each other in the circumference direction is 1 mm or more and 280 mm or less, the deformation or displacement of the axle opening 313 may be further reduced. The "interval" herein refers to the circumferential interval W1 indicated in FIG. 1 and other figures corresponding to the various examples. More specifically, the interval W1 refers to a minimum distance between the stress-absorbing low-rigidity portions 316 adjacent to each other in the circumference direction. In the flange member 35 according to Example 20 illustrated in FIG. 28, there is no such circumferential interval.

Preferably, when the internal diameter of the base 32 for the photosensitive drum 3 is 40 mm or less, the circumferential interval W1 may be 1 mm or more and 30 mm or less. More preferably, from the viewpoint of balance between the prevention of deformation or displacement of the axle opening 313 and the difficulty of forming the flange member 35, the circumferential interval W1 may be 1 mm or more and 10 mm or less.

Preferably, when the internal diameter of the base 32 for the photosensitive drum 3 is 40 mm or more and 150 mm or less, the circumferential interval W1 is 1 mm or more and 50 mm or less. More preferably, from the viewpoint of balance between the prevention of deformation or displacement of the axle opening 313 and the difficulty of forming the flange member 35, the circumferential interval W1 may be 1 mm or more and 30 mm or less.

Further preferably, when the internal diameter of the base 32 for the photosensitive drum 3 is more than 150 mm, the circumferential interval W1 is 1 mm or more and 280 mm or less. More preferably, from the viewpoint of balance between the prevention of deformation or displacement of the axle opening 313 and the difficulty of forming the flange member 35, the circumferential interval W1 may be 1 mm or more and 50 mm or less.

When the interval between the stress-absorbing openings 316 adjacent to each other in the radial direction may be 1 mm or more and 130 mm or less, the deformation or displacement of the axle opening 313 may be further reduced. The interval herein refers to the radial interval W2 illustrated in FIG. 1 and other figures corresponding to the various examples. Specifically, the radial interval W2 indicates a minimum distance between the stress-absorbing openings 316 adjacent to each other in the radial direction.

Preferably, when the internal diameter of the base 32 for the photosensitive drum 3 is 40 mm or less, the radial interval W2 may be 1 mm or more and 10 mm or less. More preferably, from the viewpoint of balance between the prevention of deformation or displacement of the axle opening 313 and the difficulty of forming the flange member 35, the radial interval W2 may be 1 mm or more and 5 mm or less.

Preferably, when the internal diameter of the base 32 for the photosensitive drum 3 is 40 mm or more and 150 mm or less, the radial interval W2 may be 1 mm or more and 70 mm or less. More preferably, from the viewpoint of balance between the prevention of deformation or displacement of the axle opening 313 and the difficulty of forming the flange member 35, the radial interval W2 may be 1 mm or more and 30 mm or less.

Preferably, when the internal diameter of the base 32 for the photosensitive drum 3 is more than 150 mm, the radial interval W2 may be 1 mm or more and 130 mm or less. More preferably, from the viewpoint of balance between the prevention of deformation or displacement of the axle opening 313 and the difficulty of forming the flange member 35, the radial interval W2 may be 1 mm or more and 80 mm or less.

EXPERIMENT 2

Figure 33:
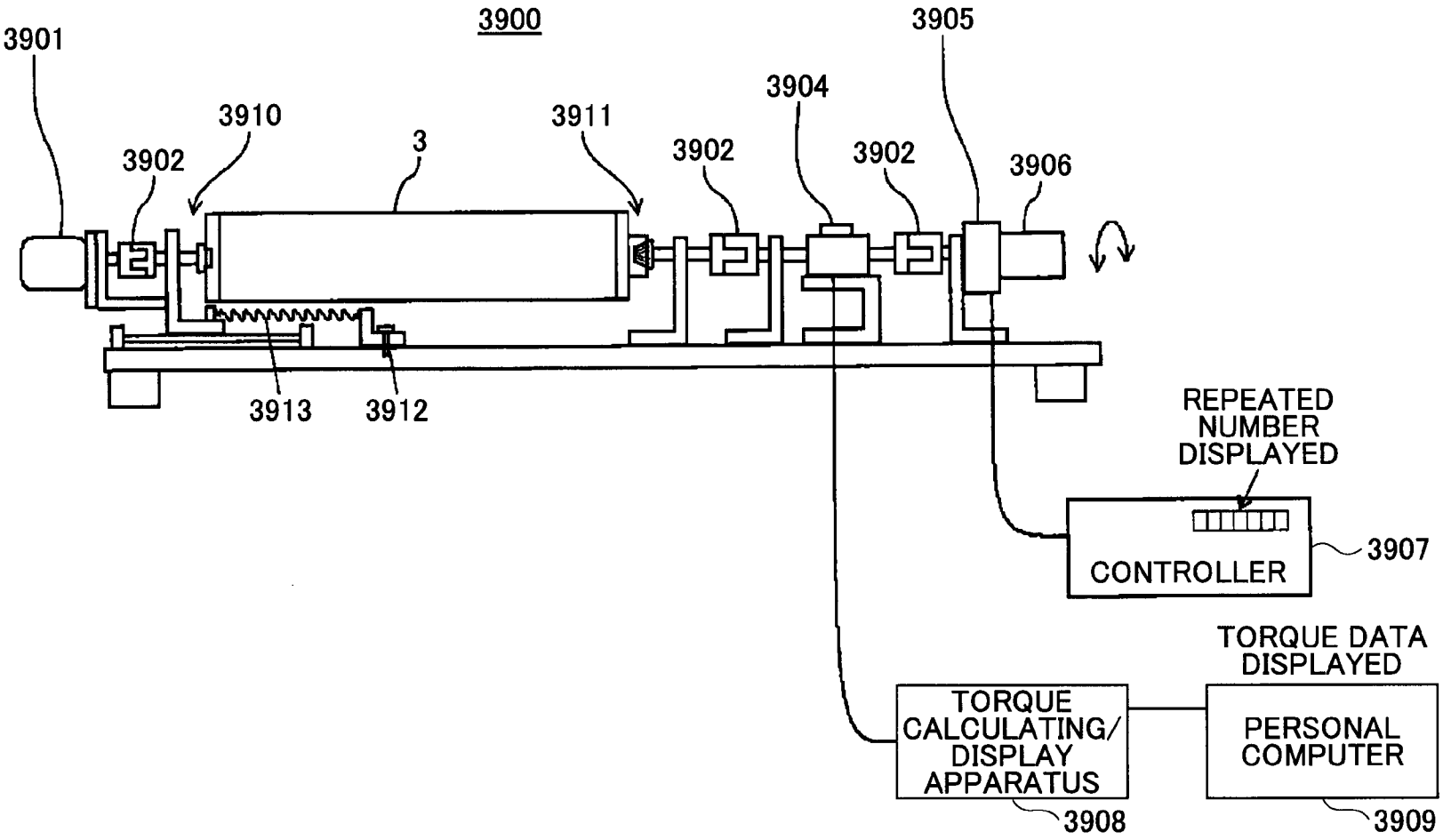
FIG. 33 illustrates a flange testing apparatus.

The flange member 35 according to the present embodiment includes the stress-absorbing openings 316 in the linking portion 315. Thus, the durability of the flange member 35 was tested in Experiment 2. FIG. 33 illustrates a flange testing apparatus 3900 used in Experiment 2. Specifically, in order to determine the durability of the flange member 35 during an actual operation in a machine, an amount of torque comparable to that during an actual machine operation was applied to the photosensitive drum 3 including the flange members 35, and the torque was measured while the photosensitive drum 3 was repeatedly started and then stopped.

In Experiment 2, after the size of the photosensitive drum 3 including the flange members 35 was accurately measured, the photosensitive drum 3 was repeatedly given rotating and stopping loads by the flange testing apparatus 3900 of FIG. 33. Thereafter, the photosensitive drum 3 was detached from the flange testing apparatus 3900 and then accurately measured again in order to determine any changes in its size.

Figure 34:
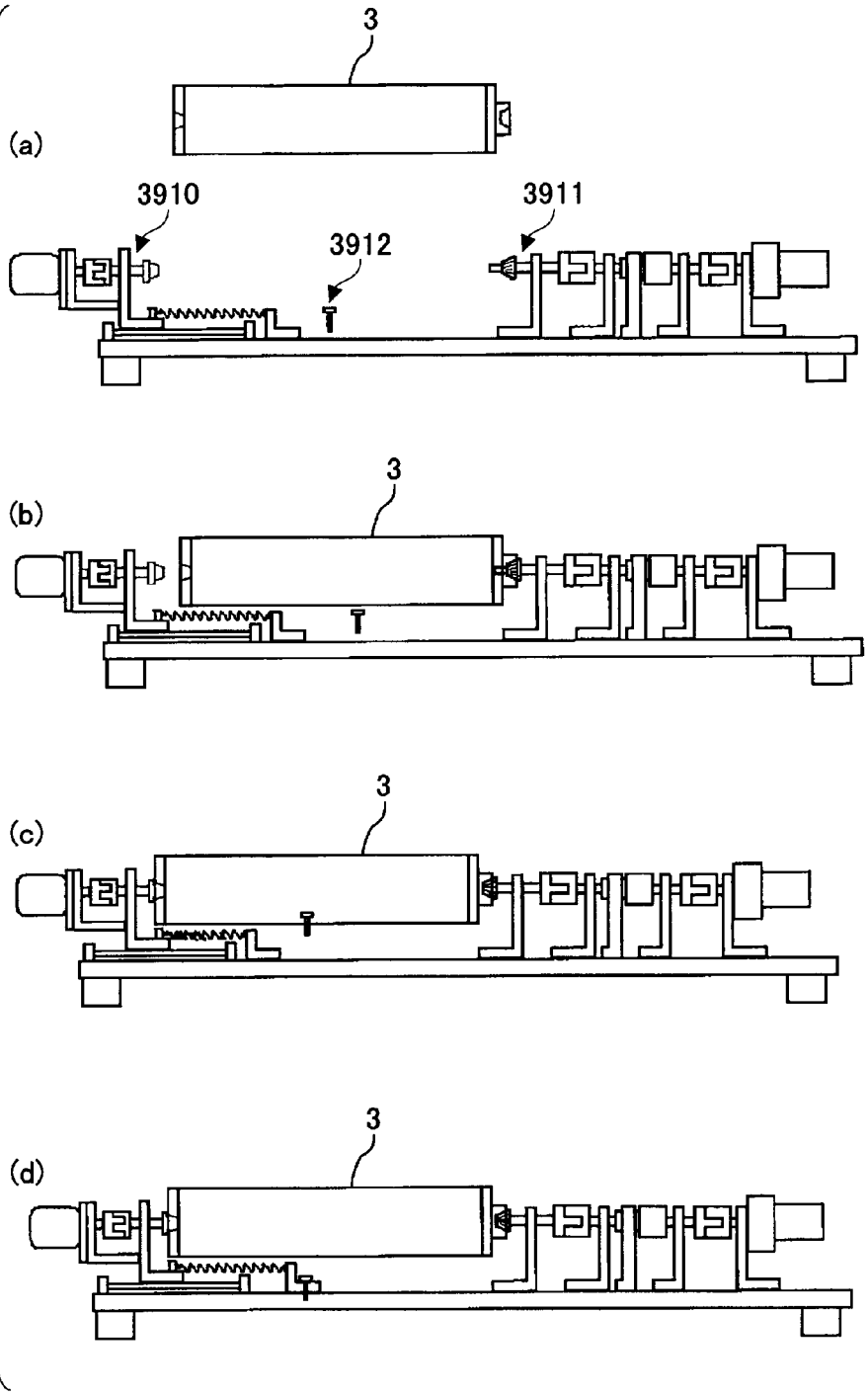
FIG. 34, parts (*a*) through (*d*), illustrates a procedure for attaching the photosensitive drum to the flange testing apparatus.

FIG. 34, parts (*a*) through (*d*), illustrates a procedure for attaching the photosensitive drum 3 to the flange testing apparatus 3900 of FIG. 33. First, as illustrated in FIG. 34(*a*), a spring-fixing screw 3912 is removed, and a driven-side holder 3910 is moved to a withdrawn position by the resilience of a spring 3913 (see FIG. 33). Then, as illustrated in FIG. 34(*b*), the photosensitive drum 3 is attached to a driving-side holder 3911. The driven-side holder 3910 is then attached to the driven-side of the flange member 35 of the photosensitive drum 3 as illustrated in FIG. 34(*c*). Finally, the spring-fixing screw 3912 is fixed, as illustrated in FIG. 34(*d*).

The flange testing apparatus 3900 illustrated in FIG. 33 included a motor 3906, specifically a variable-speed reversible motor that could be instantaneously activated. The rotation speed and a sequence of forward rotation, stop, reverse rotation, and stop of the motor 3906 were controlled by a controller 3907. The controller 3907 may be configured to display the number of times of repetition of the sequence by using an electromagnetic/mechanical display device that could retain the count value even after the controller 3907 was turned off. A dummy load 3901, which included a motor to which no power supply was connected, was attached to the driven-side holder 3910. The torque value was measured by a torque detector SS-050 from ONO SOKKI CO., LTD and then displayed by a torque calculation/display unit 3908. The history of accumulated torque data was displayed by and stored in a personal computer 3909.

The flange testing apparatus 3900 was used under the following conditions.

Range of rotation speed adjustment: 0.3 to 4.6 rotations/sec (motor rotation speed: 90 to 1400 rpm, speed reduction ratio: 5)

Range of torque measurement: 0 to 5 N·m.

Rotational load: The motor was selected so that a desired rotational load could be obtained.

Next, calculation of the number of repetitions will be described. When the cycle of forward rotation, stop, reverse rotation, and stop takes 3 seconds, 20 cycles can be performed per minute, which is 1,200 cycles per hour and 28,800 cycles in 24 hours. Thus, about 200,000 cycles of the test sequence can be performed in a week (seven days).

For achieving 120,000 cycles of the sequence, it takes about four days of continuous operation because 120,000/28,800=4.1.

Figure 35:
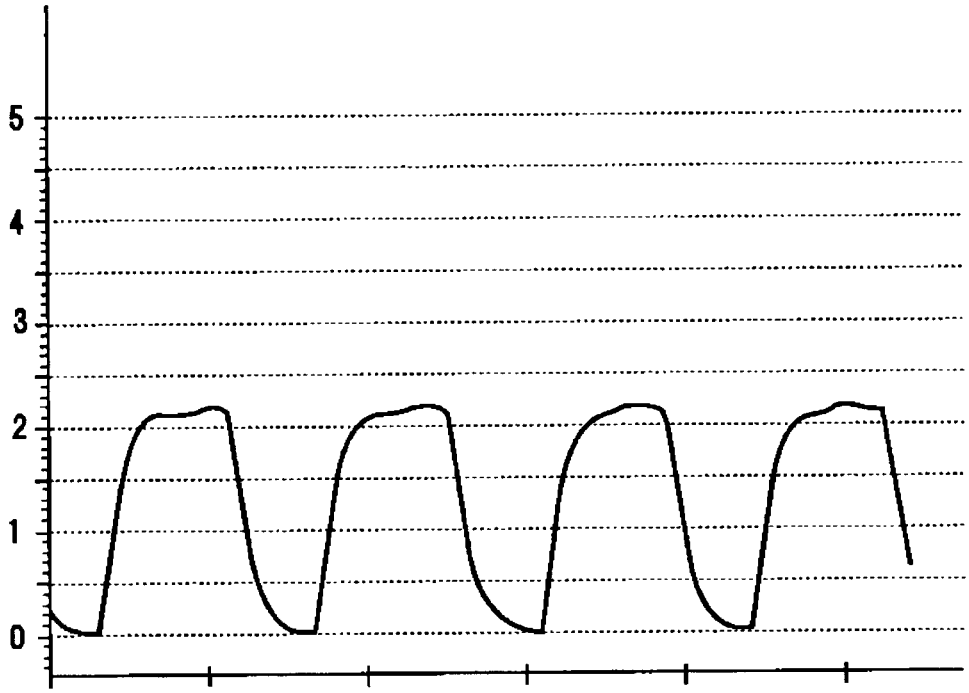
FIG. 35 is a graph plotting torque data for durability evaluation.

In Experiment 2, the sequence of starting and stopping was conducted 4,800 cycles under a maximum torque of 2 N·m upon starting or stopping, on the assumption of an operation life of 1200 K (24[P/J]). FIG. 35 illustrates the torque data for durability evaluation. In Experiment 2, instead of the photosensitive drum 3, an aluminum element tube that did not have a photosensitive layer on the surface was used.

Figure 36A:
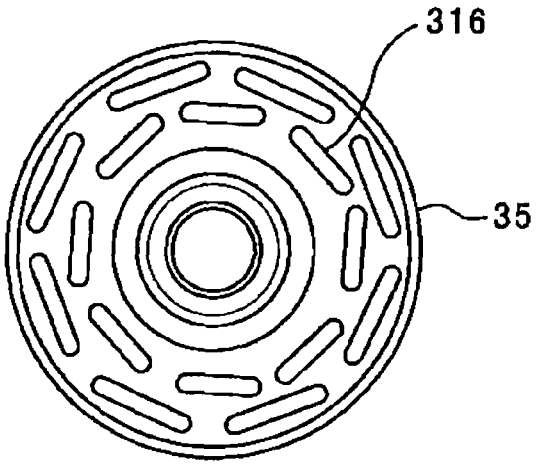
FIG. 36A illustrates a flange member on a driving side used in Experiment 2.
Figure 36B:
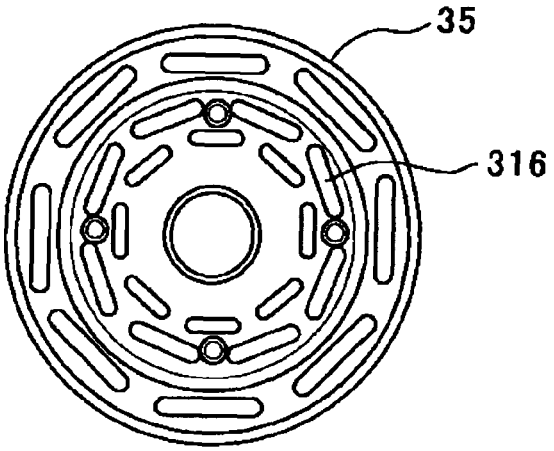
FIG. 36B illustrates a flange member on a grounded side used in Experiment 2.

FIGS. 36A and 36B illustrate a combination of the flange members 35 used in Experiment 2. FIG. 36A illustrates the flange member 35 on the driving side via which driving force is input. FIG. 36B illustrates the flange member 35 disposed on the opposite side, i.e., an electrically grounded side. In the illustrated combination of the flange members 35, both the flange member 35 on the driving side and the flange member 35 on the grounded side include the stress-absorbing reduced-rigidity portion 316.

In the two flange members 35 illustrated in FIGS. 36A and 36B, a rib width is determined by simulation such that an optimum configuration of the flange members 35 can be obtained for firmness and strength. In both the flange members 35 on the driving side (FIG. 36A) and the grounded side (FIG. 36B), the engaging portion has a thickness of 1.5 mm.

The two flange members 35 illustrated in FIGS. 36A and 36B were combined with an element tube having an outer diameter of 60 mm, a thickness of 2 mm, a countersunk portion, and a length of 380 mm. The element tube had an internal diameter of 56.5 mm at the countersunk portion.

The flange members 35 of FIGS. 36A and 36B were fitted in the element tube under a press fitting condition of 0.3 MPa.

The results of the durability evaluation of the flange member 35 revealed no whitening or fracture in the linking portion 315 around the stress-absorbing reduced-rigidity portion 316. Thus, it is concluded that there was no quality change between before and after the evaluation test.

EXPERIMENT 3

Figure 37:
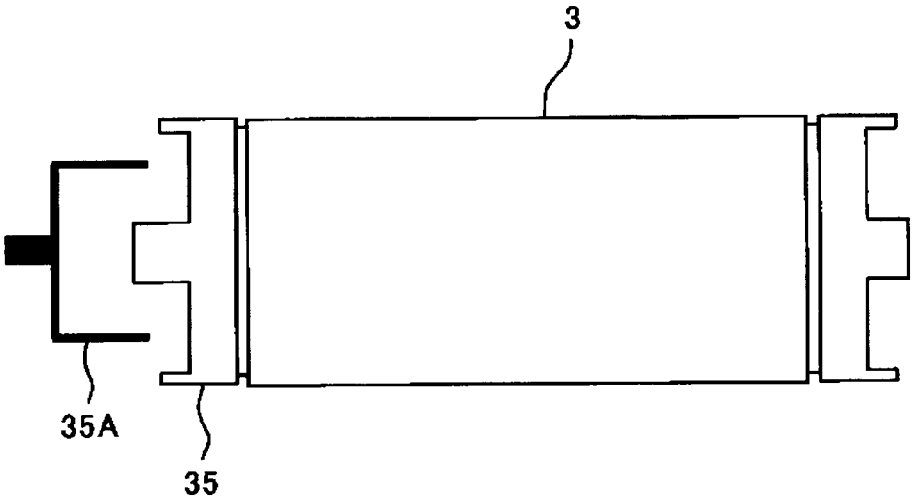
FIG. 37 illustrates a method of applying torque to the flange member in Experiment 3.

The strength of the flange member 35 itself was determined in Experiment 3. FIG. 37 illustrates a method of applying torque to the flange member 35 in Experiment 3. In Experiment 3, it was determined that the flange member 35 had sufficient strength if no whitening, fracture, or idle rotation occurred after the flange member 35 was subjected to a certain amount or more of torque.

Specifically, as illustrated in FIG. 37, after assembling the flange members 35 and the sleeve 30 into the photosensitive drum 3, the left side portion of a torque measuring jig 35*a* was attached to a torque meter (not illustrated), specifically the torque meter HDP-50 from HIOS Inc. The right-hand side part of the torque measuring jig 35*a* had two prongs with shapes adapted to be inserted into the stress-absorbing reduced-rigidity portion 316 of the flange member 35. The flange members 35 had the configuration according to Experiment 2 illustrated in FIG. 36. The two prongs of the right-hand side part of the torque measuring jig 35*a* were inserted into two of the eight outer-most stress-absorbing reduced-rigidity portions 316 of the flange member 35 illustrated in FIG. 36 opposite to each other across the center of the flange member 35. Then, the torque meter and the photosensitive drum 3 were held by hand, and, with the photosensitive drum 3 fixed in position, force was applied from the torque meter in a direction of rotation of the photosensitive body. When the torque meter indicated a predetermined value, the flange member 35 was inspected for problems such as whitening, fracture, or idle rotation.

A torque resistance standard value of a high precision photosensitive body is 0.5 N·m or more on the grounded side and 2.0 N·m or more on the driving side, for example. In Experiment 4, even when the torque meter value was 2 N·m or more, no problem of whitening, fracture, or idle rotation occurred in the flange member 35. Thus, it was determined that the flange member 35 by itself had sufficient strength for actual operation in a machine.

EXPERIMENT 4

The flange member discussed in Patent Document 3 referred to above includes a stress absorbing structure in the linking portion that connected the press-fitted portion with the axle opening portion. In Experiment 4, a simulation was conducted to compare the flange member according to Patent Document 3 and the flange member according to an embodiment of the present invention in terms of deformation or displacement of the axle opening.

Figure 38:
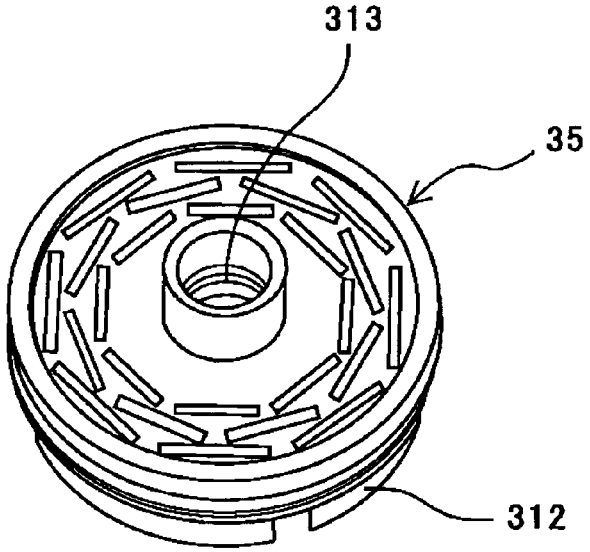
FIG. 38 illustrates the flange member having an inventive feature used in Experiment 4.

FIGS. 38 through 42 are perspective views illustrating the data of the flange members 35 used in the simulation of Experiment 4. FIG. 38 is a perspective view of the flange member 35 having the features according to an embodiment of the invention.

Figure 39A:
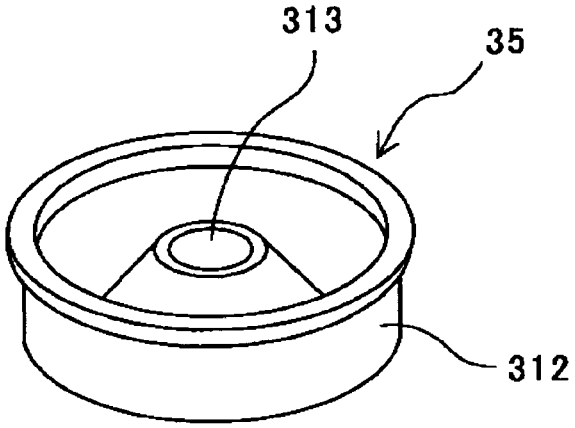
FIG. 39A is a perspective view of the flange member used in Experiment 4 having a stress absorbing structure illustrates in FIG. 2 of Patent Document 3, seen from the outside in an axial direction.
Figure 39B:
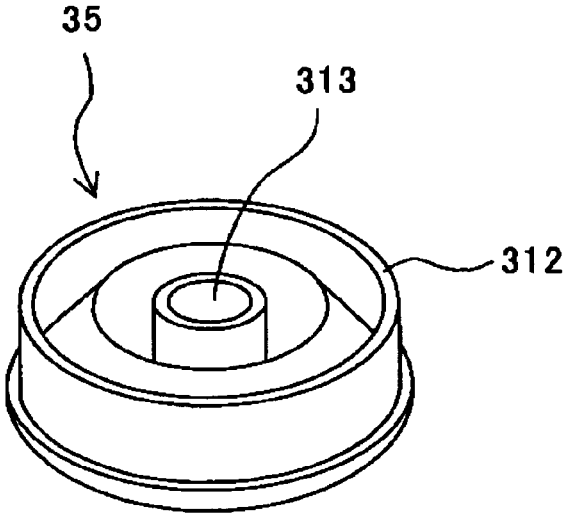
FIG. 39B is a perspective view of the flange member seen from a press-fitted portion side.

FIGS. 39A and 39B illustrate the flange member 35 having the stress absorbing structure illustrated in FIG. 2 of Patent Document 3. FIG. 39A is a perspective view of the flange member 35 seen from the outside in the axial direction. FIG. 39B is a perspective view of the flange member 35 seen from the press-fitted portion side.

Figure 40A:
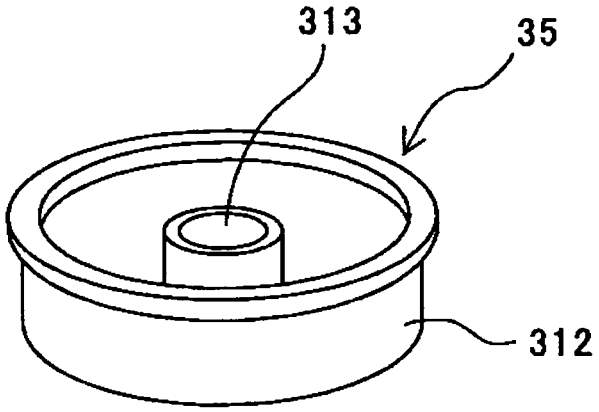
FIG. 40A is a perspective view of the flange member used in Experiment 4 having a stress absorbing structure illustrated in FIG. 1 of Patent Document 3, seen from the outside in the axial direction.
Figure 40B:
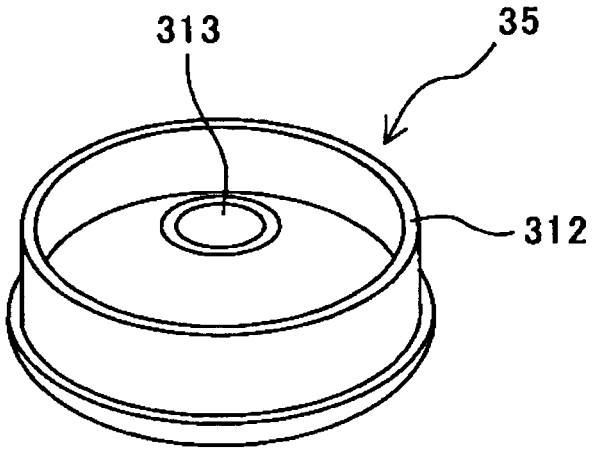
FIG. 40B is a perspective view of the flange member seen from a press-fitted portion side.

FIGS. 40A and 40B illustrate the flange member 35 having the stress absorbing structure illustrated in FIG. 1 of Patent Document 3. FIG. 40A is a perspective view of the flange member 35 from the outside in the axial direction. FIG. 40B is a perspective view of the flange member 35 from the press-fitted portion side.

Figure 41:
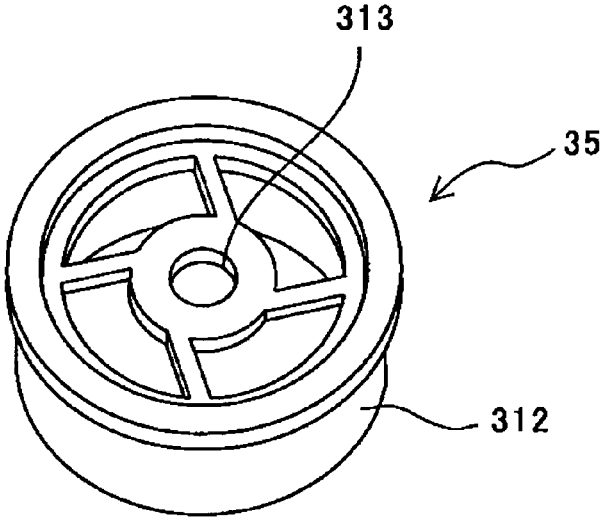
FIG. 41 illustrates the flange member used in Experiment 4 having a stress absorbing structure illustrated in FIG. 3 of Patent Document 3.
Figure 42:
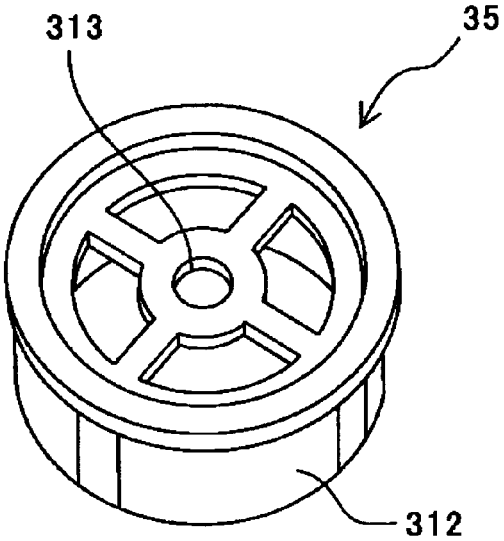
FIG. 42 illustrates the flange member used in Experiment 4 and having a stress absorbing structure illustrated in FIG. 6 of Patent Document 3.

FIG. 41 illustrates the flange member 35 having the stress absorbing structure illustrated in FIG. 3 of Patent Document 3. FIG. 42 illustrates the flange member 35 having the stress absorbing structure illustrated in FIG. 6 of Patent Document 3.

In Experiment 4, the simulation was conducted under the conditions such that, in addition to uniformly applying force to the entire areas of the press-fitted outer peripheral surface 312*f* of the press-fitted portion 312 toward the center, a larger amount of force is applied to one point on the press-fitted outer peripheral surface 312*f* than the other points. This condition of applying a greater force to the one point than to the other points is intended to reflect the development of an error that may be actually caused between the flange member 35 and the sleeve 30.

Figure 43:
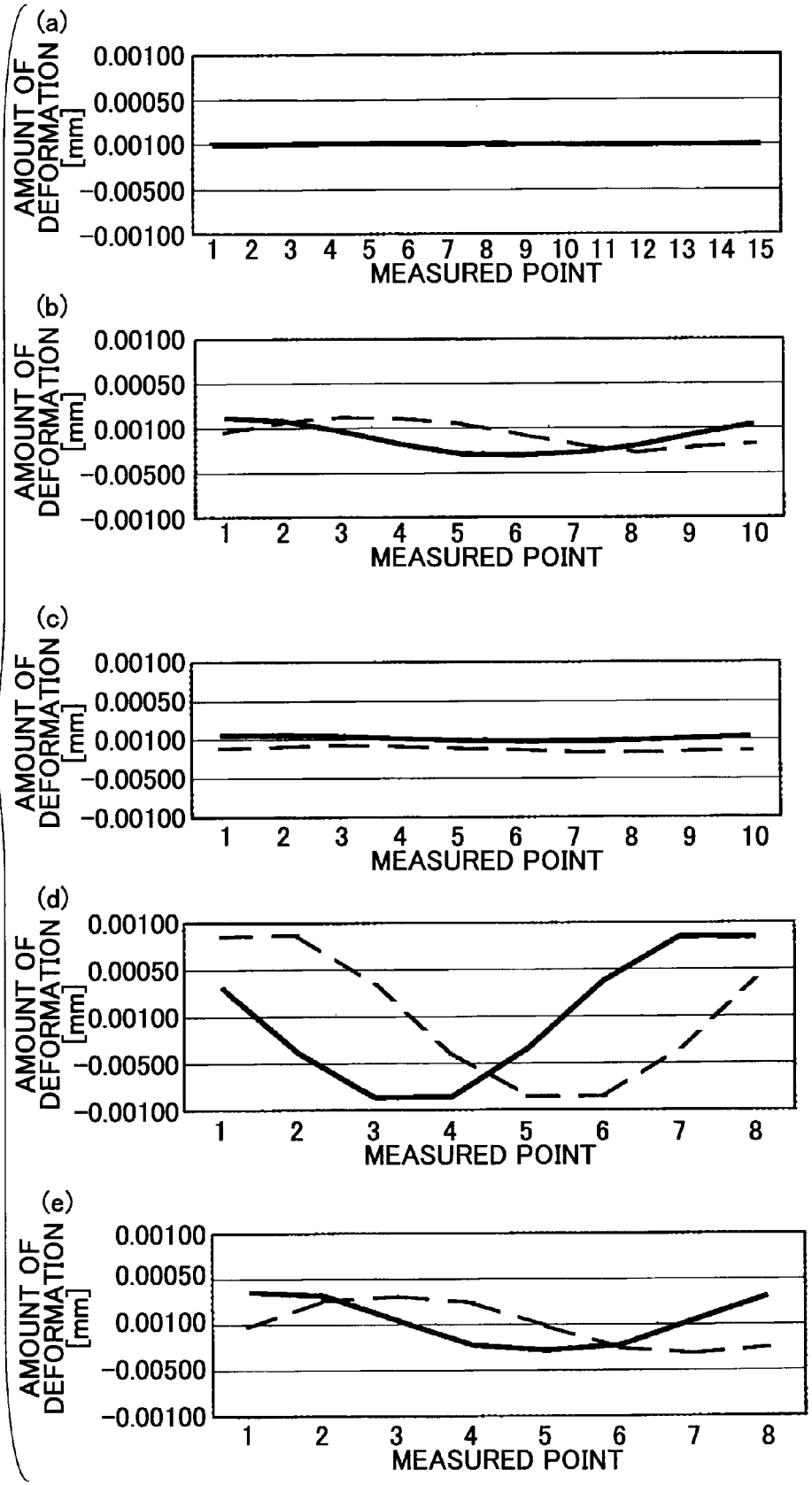
FIG. 43, parts (*a*) through (*e*), illustrates graphs plotting the amount of movement of the axle opening of the flange members used in Experiment 4.

FIG. 43, parts (*a*) through (*e*), illustrates graphs plotting the amount of movement of the axle opening 313 according to the simulation conducted with regard to the flange members 35 illustrated in FIGS. 38 through 42 under the above conditions.

FIG. 43(*a*) is the graph indicating the result of simulation using the data of the flange member 35 having the features according to the embodiment illustrated in FIG. 38.

FIG. 43(*b*) is the graph indicating the result of simulation using the data of the flange member 35 of FIGS. 39A and 39B having the stress absorbing structure illustrated in FIG. 2 of Patent Document 3.

FIG. 43(*c*) is the graph indicating the result of simulation using the data of the flange member 35 of FIGS. 40A and 40B having the stress absorbing structure illustrated in FIG. 1 of Patent Document 3.

FIG. 43(*d*) is the graph indicating the result of simulation using the data of the flange member 35 of FIG. 41 having the stress absorbing structure illustrated in FIG. 3 of Patent Document 3.

FIG. 43(*e*) is the graph indicating the result of simulation using the data of the flange member 35 of FIG. 42 having the stress absorbing structure illustrated in FIG. 6 of Patent Document 3.

The horizontal axis of the graphs of FIG. 43 shows the measured point indicating the point of intersection of portions of a mesh corresponding to the axle opening 313 when the shape of the flange member 35 is represented by a fine mesh during simulation. For example, the graph of FIG. 43(*a*) indicates measured points 1 through 16, indicating that the edges of the axle opening 313 of the flange member 35 of FIG. 38 are represented by a mesh of 16 grids.

The vertical axis shows the amount of deformation indicating the position of the respective measured points when the force under the above conditions is applied to the press-fitted outer peripheral surface 312*f* with respect to the position "0" of the measured points on a plane ("X-Y plane") orthogonal to the central axis prior to the application of the force to the press-fitted outer peripheral surface 312*f*. In the graphs of FIG. 43, the solid lines indicate the amount of movement of the measured points in an X direction, and the dashed lines indicate the amount of movement in a Y direction. For example, FIG. 43(*d*) indicates that the measured point 1 is moved by 0.00032 mm in the X direction and by 0.00086 mm in the Y direction, and that the measured point 2 is moved by −0.00038 mm in the X direction and by 0.00087 mm in the Y direction.

Thus, from the graphs of FIG. 43, it is seen that the amount of deformation or displacement of the axle opening 313 of the flange member 35 according to the embodiment of the present invention is reduced.

EXPERIMENT 5

As illustrated in Table 1 for Experiment 1, the amount of runout due to deformation or displacement of the axle opening 313 is varied even among the flange members 35 having the features according to the embodiments and having the same diameter, depending on the number or location of the stress-absorbing openings 316.

In Experiment 5, simulation was conducted by using three types of the flange member 35 having the features of the present embodiment and different shapes of the stress-absorbing openings 316 in order to compare the deformation or displacement of the axle opening 313 among the different types.

In order to eliminate or reduce the influence of the size or number of the stress-absorbing openings 316, the number of the stress-absorbing openings 316 is set to 24, and the data used of the three types of the flange member 35 has the same ratio of the stress-absorbing openings 316 in the linking portion 315 of the flange member 35.

Figure 44:
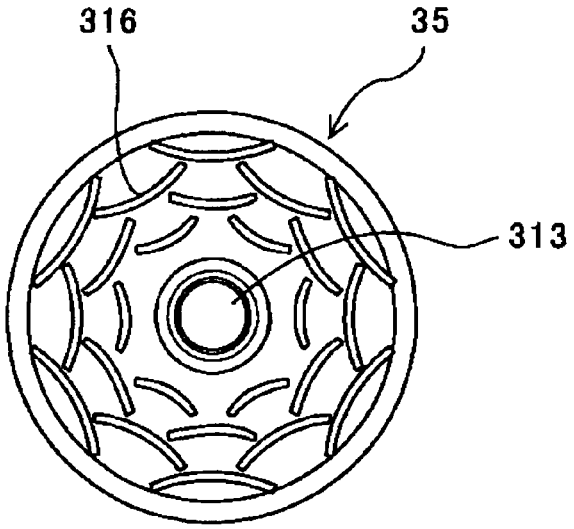
FIG. 44 illustrates the flange member used in Experiment 5 having an inverted-arch shaped stress absorbing opening.
Figure 45:
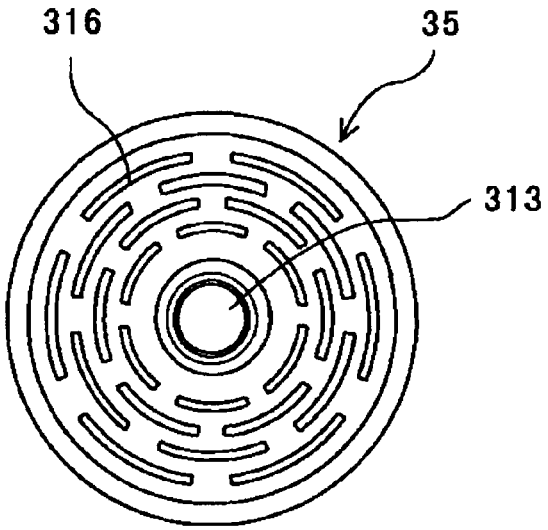
FIG. 45 illustrates the flange member used in Experiment 5 having an arch-shaped stress absorbing opening.
Figure 46:
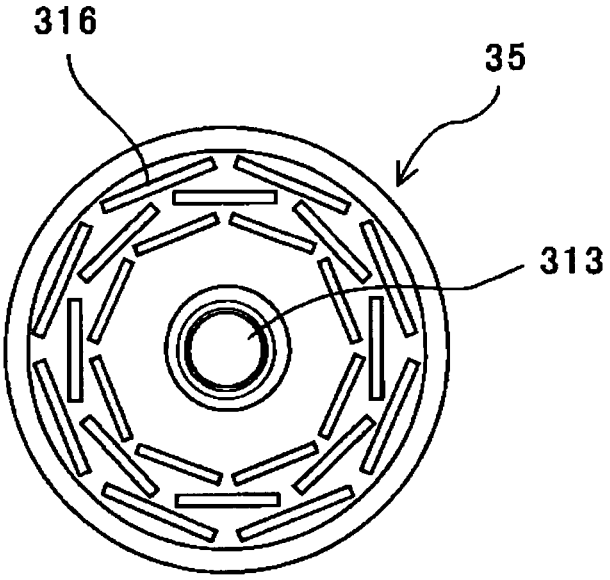
FIG. 46 illustrates the flange member used in Experiment 5 having a rectangular stress absorbing opening.

FIGS. 44 through 46 are plan views illustrating the data of the flange members 35 used in the simulation of Experiment 5. FIG. 44 illustrates the flange member 35 in which the stress-absorbing openings 316 are arched in a direction opposite to the direction along the circumference of the flange member 35. FIG. 45 illustrates the flange member 35 in which the stress-absorbing openings 316 are arched in a direction along the circumference of the flange member 35. FIG. 46 illustrates the flange member 35 in which the stress-absorbing openings 316 are rectangular.

Figure 47:
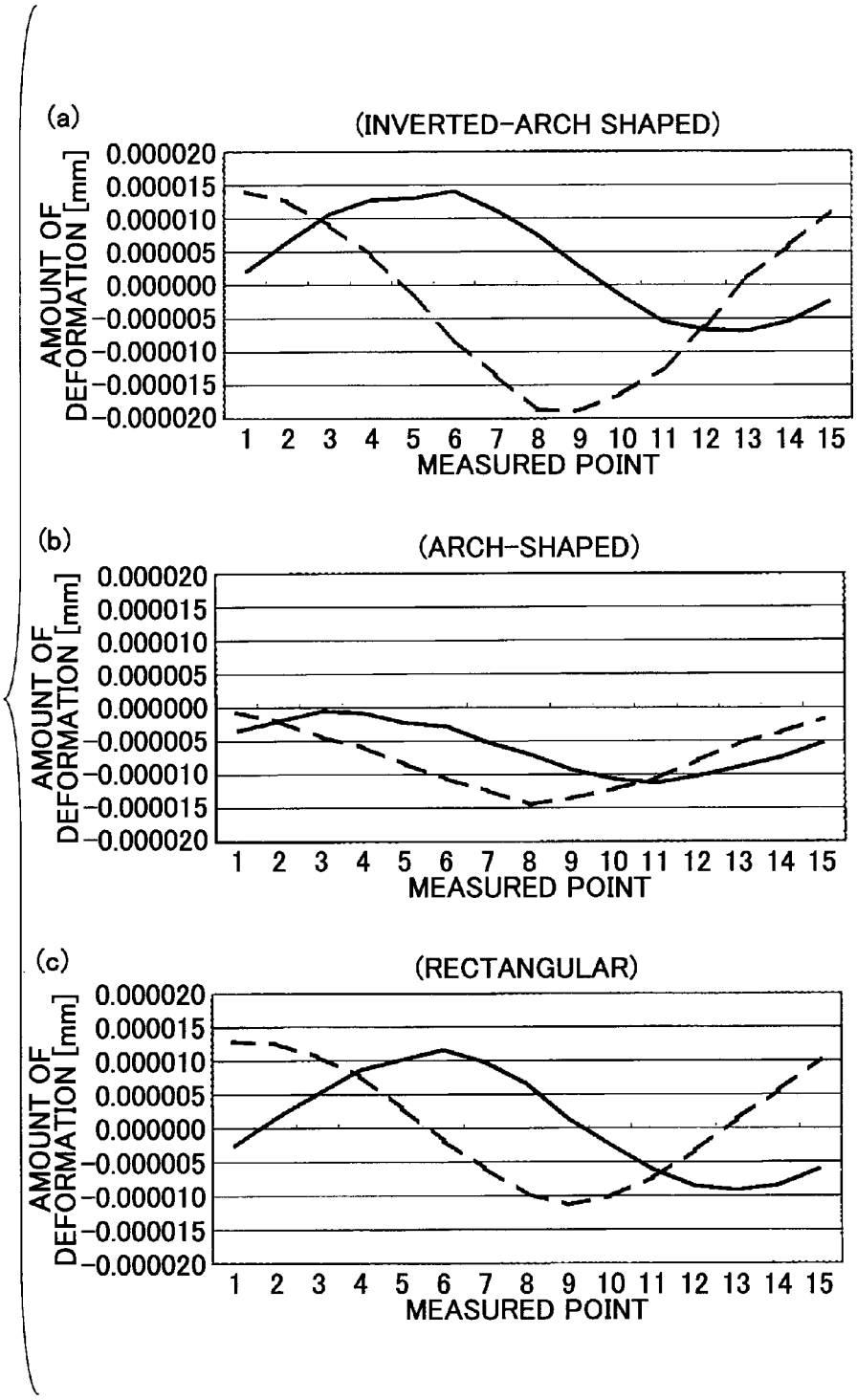
FIG. 47, parts (*a*) through (*c*), illustrates graphs plotting the amount of movement of the axle opening of the flange members used in Experiment 5.

FIG. 47, parts (*a*) through (*c*), illustrates graphs indicating the amount of movement of the axle opening 313 when the simulation is conducted using the flange members 35 illustrated in FIGS. 50 through 52 under the same conditions as in Experiment 5.

FIG. 47(*a*) illustrates the result of simulation using the data of the flange member 35 of FIG. 44 where the stress-absorbing openings 316 have the inverted-arch shape. FIG. 47(*b*) illustrates the result of simulation using the data of the flange member 35 illustrated in FIG. 45 where the stress-absorbing openings 316 have the arched shape.

FIG. 47(*c*) illustrates the result of simulation using the data of the flange member 35 illustrated in FIG. 46 where the stress-absorbing openings 316 have the rectangular shape.

It is seen from the graphs of FIG. 47 that the flange member 35 of the arched-shape or rectangular-shape has a smaller amount of deformation than the flange member 35 of the inverted-arch shape.

Although the difference in the amount of deformation between the arched-shape type and the rectangular-shape type is not large, the deformation is distributed in the negative direction in the case of the arch-shaped flange member 35, whereas the rectangular-shaped flange member 35 exhibited deformations in the both positive and negative directions. When the deformation is exclusively distributed in the negative direction as in the case of the arch-shaped flange member 35, the central position of the axle opening 313 is also moved in the negative direction, resulting in an increase of runout. On the other hand, when the deformation of the measured points is caused in both the negative and positive directions, as in the case of the rectangular-shaped flange member 35, deformation of the axle opening 313 may be caused but is less likely to result in the movement of the central position, so that the development of runout can be more effectively prevented.

EXAMPLE 2

Figure 48A:
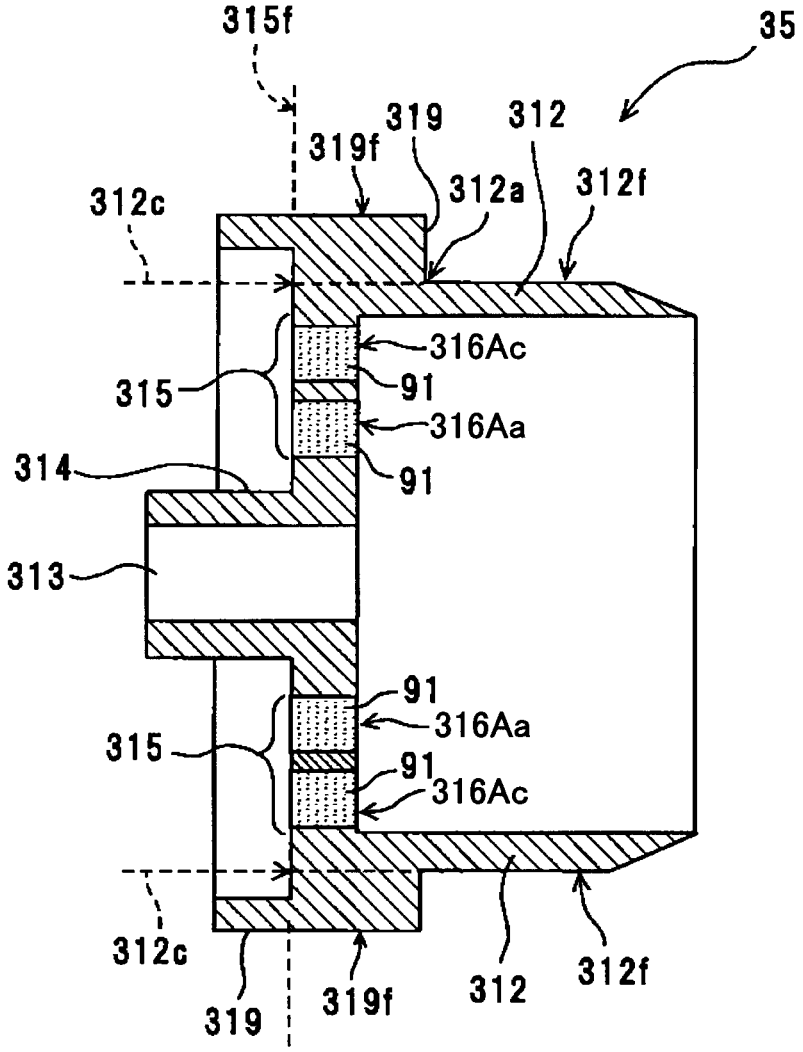
FIG. 48A is a cross section of the flange member according to Example 2 taken perpendicular to the axial direction.
Figure 48B:
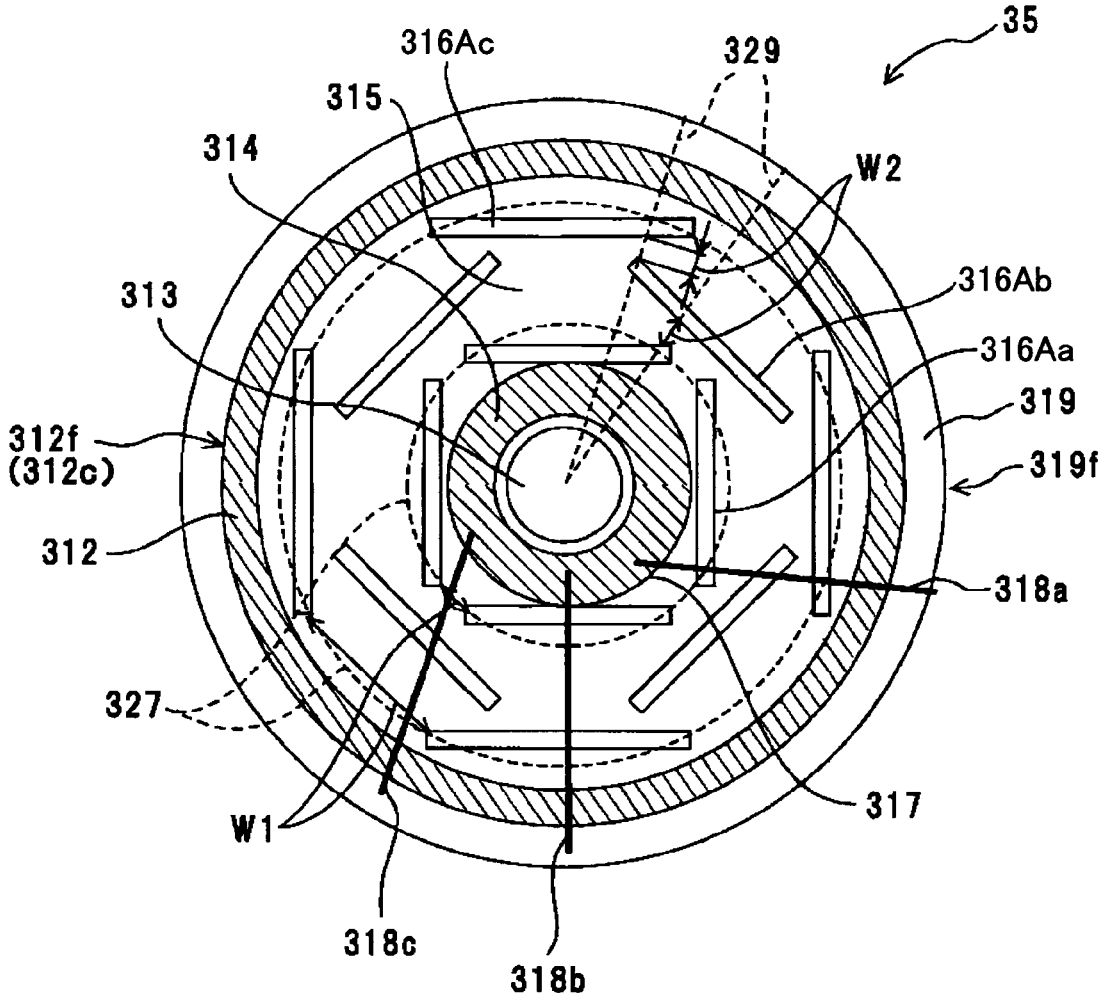
FIG. 48B is a cross section of the flange member according to Example 2 taken along the axial direction.

Next, the flange member 35 according to Example 2 will be described with reference to FIGS. 48A and 48B. FIG. 48A is a cross section of the flange member 35 taken along line A-A of FIG. 5. FIG. 48B is a cross section of the flange member 35 of FIG. 5 taken along line B-B.

The flange member 35 includes a press-fitted portion 312, an axle opening portion 314, a linking portion 315, and an outer-rim portion 319. When the press-fitted portion 312 is press-fitted in the end-opening portion 34 of the sleeve 30 (see also FIGS. 4 and 5), a press-fitted outer peripheral surface 312*f* of the press-fitted portion 312 contacts an inner peripheral surface of the base 32 of the sleeve 30. The axle opening portion 314 includes an axle opening 313 in which a shaft member (not illustrated) is inserted. The outer-rim portion 319 includes an outer rim 319*f* which is an outer-most peripheral portion of the flange member 35 in the radial direction. The linking portion 315 links the axle opening portion 314 with the press-fitted portion 312 and the outer-rim portion 319.

The linking portion 315 includes plural stress-absorbing low-rigidity portions 316Aa through 316Ac as stress-absorbing portions, any of which may be referred to as "the stress-absorbing low-rigidity portion 316A". The stress-absorbing low-rigidity portion 316A has a lower rigidity than the portions around it. The stress-absorbing low-rigidity portion 316A according to Example 2 includes one or more stress absorbing openings through the linking portion 315 in the axial direction. The stress absorbing openings are filled with a stress-absorbing material 91 made of a resilient material that is more readily deformable than the material of the linking portion 315.

The axle opening portion 314 refers to the portion within a circle 317 having a radius corresponding to the distance between an axial center and the nearest stress absorbing opening, namely the first stress-absorbing low-rigidity portion 316Aa, excepting the axle opening 313.

Thus, when the press-fitted portion 312 is press-fitted inside the end-opening portion 34, the stress-absorbing material 91 can be deformed, thereby absorbing the stress to which the press-fitted outer peripheral surface 312*f* may be subject from the inner peripheral surface of the sleeve 30. Accordingly, the stress from the inner peripheral surface of the sleeve 30 upon press fitting can be prevented from being transmitted to the axle opening portion 314 via the linking portion 315.

Thus, the flange member 35 according to Example 2 includes at least one stress-absorbing low-rigidity portion 316A on an arbitrary imaginary line 318 drawn from the axle opening portion 314 toward the outer-rim portion 319. For example, the arbitrary imaginary line 318 includes arbitrary imaginary lines 318*a*, 318*b*, and 318*c* as illustrated in FIG. 48B. In this example, there are three stress-absorbing low-rigidity portions 316A on the arbitrary imaginary line 318*a*, two stress-absorbing low-rigidity portions 316A on the arbitrary imaginary line 318*b*, and one stress-absorbing low-rigidity portion 316A on the arbitrary imaginary line 318*c*. The imaginary line 318 may be drawn from the circumference of an imaginary projected circle 312*c* to the axle opening portion 314. The imaginary projected circle 312*c* is a projection of the press-fitted outer peripheral surface 312*f* of the press-fitted portion 312 on an imaginary plane 315*f* including the linking portion 315 and perpendicular to the axial direction (left-right direction in FIG. 48A).

In the flange member 35 illustrated in FIGS. 48A and 48B, the press-fitted outer peripheral surface 312*f* is formed parallel to the axial direction. When the press-fitted outer peripheral surface 312*f* is inclined with respect to the axial direction, the position of the circumference of the imaginary projected circle 312*c* is determined with respect to the position of the press-fitted outer peripheral surface 312*f* at the root of the press-fitted portion 312 (i.e., the position 312*a* in FIG. 48A).

In accordance with Example 2, when the press-fitted portion 312 is press-fitted in the sleeve 30, the stress that the press-fitted portion 312 may be subjected to from the base 32 of the sleeve 30 can be absorbed by the stress-absorbing material 91 of the stress-absorbing low-rigidity portion 316A. Thus, the deformation or displacement of the axle opening 313 can be more effectively prevented compared to a structure in which the stress-absorbing low-rigidity portion 316A is not provided.

The flange member 35 also includes at least one stress-absorbing low-rigidity portion 316A on the arbitrary imaginary line 318 drawn from the axle opening portion 314 toward the outer-rim portion 319. Thus, the stress the press-fitted portion 312 may be subjected to in any direction from the base 32 upon press fitting can be absorbed by the stress-absorbing material 91 of the stress-absorbing low-rigidity portion 316A. Accordingly, the stress to which the press-fitted outer peripheral surface 312*f* of the press-fitted portion 312 may be subject can be prevented from directly being transmitted to the axle opening portion 314, and therefore the deformation or displacement of the axle opening 313 can be prevented.

The flange member 35 according to Example 2 may be manufactured by molding a flange having the stress absorbing openings with a resin, such as polycarbonate as mentioned above, and then filling the stress absorbing openings with the stress-absorbing material 91.

The stress-absorbing material 91 is not particularly limited. Preferably, the stress-absorbing material 91 may include a substance having a lower hardness than the material of the flange member 35. Examples of the resilient material include phenol resin, epoxy resin, melamine resin, urea resin, unsaturated polyester resin, alkyd resin, polyurethane, polyimide, high-density polyethylene, intermediate-density polyethylene, low-density polyethylene, polypropylene, polyvinyl chloride, polystyrene, polyvinyl acetate, Teflon (registered trademark), ABS resin, AS resin, acrylic resin, polyamide, polycarbonate, modified polyphenylene ether, polyethylene-terephthalate, polybutylene terephthalate, polyphenylene-sulfide, polytetrafluoroethylene, polysulphone, non-crystalline polyarylate, liquid crystal polymer, polyether ketone, polyamide-imide, acrylic rubber, urethane rubber, ethylene-propylene rubber, chloroprene rubber, silicon rubber, styrene-butadiene rubber, natural rubber, nitrile rubber, Hypalon (registered trademark), butyl rubber, and fluoro-rubber, which may be used either individually or combination.

EXPERIMENT 6

Next, a description will be given of Experiment 6 in which, with regard to plural examples of the flange member 35 according to Example 2 in which the location, the number, and the outer size of the stress-absorbing low-rigidity portion 316A were varied. Experiment 6 was conducted to determine the amount of runout of the flange member 35 when mounted on the photosensitive drum 3, and the color reproduction characteristics of an image forming apparatus including the photosensitive drum 3. The structure of the flange member 35 is not limited to those of the examples described below. It is noted that the term "parts" refers to "parts by weight".

EXAMPLE 2-1

The base 32 of aluminum and having an outer diameter of 60 mm was coated with an intermediate-layer-coating liquid having the composition according to Example 1-1 and then dried at 130° C. for 20 minutes, thereby forming an intermediate layer of about 3.5 μm. Further, a charge-generating-layer coating liquid having the composition according to Example 1-1 was applied and then dried at 130° C. for 20 minutes, thereby forming a charge generating layer of about 0.2 μm. Thereafter, a charge transport layer coating liquid having the composition according to Example 1-1 was applied and then dried at 130° C. for 20 minutes, thereby forming a charge transport layer of about 30 μm. In this way, the photosensitive layer 31 was formed on the outer peripheral surface of the base 32, thus forming the sleeve 30. Then, the flange member 35 illustrated in FIG. 48 was press-fitted into the end-opening portions 34 of the sleeve 30, thereby forming the photosensitive drum 3 according to Example 2.

EXAMPLE 2-2

The photosensitive drum 3 was prepared in the same way as in Example 2-1 with the exception that the base 32 included an aluminum tubular member having an outer diameter of 300 mm and that the flange member 35 had a configuration illustrated in FIG. 10.

FIG. 10 illustrates the flange member 35 as seen from the direction of an arrow D in FIG. 5. The position of the circumference of the imaginary projected circle 312*c* is not illustrated because it substantially corresponds to the position of the inner peripheral surface of the outer-rim portion 319. The same about the orientation of the flange member 35 and the omission of illustration of the imaginary projected circle 312*c* also applies to Examples 2-3 through 2-22 illustrated in FIGS. 11 through 30.

EXAMPLE 2-3

The photosensitive drum 3 was prepared in the same way as in Example 2-1 with the exception that the base 32 included an aluminum tubular member having an outer diameter of 300 mm and that the flange member 35 had a configuration illustrated in FIG. 11.

EXAMPLE 2-4

The photosensitive drum 3 was prepared in the same way as in Example 2-1 with the exception that the base 32 included an aluminum tubular member having an outer diameter of 30 mm and that the flange member 35 had a configuration illustrated in FIG. 12.

EXAMPLE 2-5

The photosensitive drum 3 was prepared in the same way as in Example 2-1 with the exception that the base 32 included an aluminum tubular member having an outer diameter of 30 mm and that the flange member 35 had a configuration illustrated in FIG. 13.

EXAMPLE 2-6

The photosensitive drum 3 was prepared in the same way as in Example 2-1 with the exception that the base 32 included an aluminum tubular member having an outer diameter of 30 mm and that the flange member 35 had a configuration illustrated in FIG. 14.

EXAMPLE 2-7

The photosensitive drum 3 was prepared in the same way as in Example 2-1 with the exception that the base 32 included an aluminum tubular member having an outer diameter of 30 mm, and that the flange member 35 had a configuration illustrated in FIG. 15.

EXAMPLE 2-8

The photosensitive drum 3 was prepared in the same way as in Example 2-1 with the exception that the base 32 had an aluminum tubular member having an outer diameter of 30 mm and that the flange member 35 had a configuration illustrated in FIG. 16.

EXAMPLE 2-9

The photosensitive drum 3 was prepared in the same way as in Example 2-1 with the exception that the base 32 had an aluminum tubular member having an outer diameter of 30 mm and that the flange member 35 had a configuration illustrated in FIG. 17.

EXAMPLE 2-10

The photosensitive drum 3 was prepared in the same way as in Example 2-1 with the exception that the base 32 had an aluminum tubular member having an outer diameter of 30 mm and that the flange member 35 had a configuration illustrated in FIG. 18.

EXAMPLE 2-11

The photosensitive drum 3 was prepared in the same way as in Example 2-1 with the exception that the base 32 had an aluminum tubular member having an outer diameter of 30 mm and that the flange member 35 had a configuration illustrated in FIG. 19.

EXAMPLE 2-12

The photosensitive drum 3 was prepared in the same way as in Example 2-1 with the exception that the base 32 had an aluminum tubular member having an outer diameter of 30 mm and that the flange member 35 had a configuration illustrated in FIG. 20.

EXAMPLE 2-13

The photosensitive drum 3 was prepared in the same way as in Example 2-1 with the exception that the base 32 had an aluminum tubular member having an outer diameter of 30 mm, and that the flange member 35 had a configuration illustrated in FIG. 21.

EXAMPLE 2-14

The photosensitive drum 3 was prepared in the same way as in Example 2-1 with the exception that the base 32 had an aluminum tubular member having an outer diameter of 30 mm, and that the flange member 35 had a configuration illustrated in FIG. 22.

EXAMPLE 2-15

The photosensitive drum 3 was prepared in the same way as in Example 2-1 with the exception that the base 32 had an aluminum tubular member having an outer diameter of 30 mm, and that the flange member 35 had a configuration illustrated in FIG. 23.

EXAMPLE 2-16

The photosensitive drum 3 was prepared in the same way as in Example 2-1 with the exception that the base 32 had an aluminum tubular member having an outer diameter of 30 mm, and that the flange member 35 had a configuration illustrated in FIG. 24.

EXAMPLE 2-17

The photosensitive drum 3 was prepared in the same way as in Example 2-1 with the exception that the base 32 had an aluminum tubular member having an outer diameter of 30 mm, and that the flange member 35 had a configuration illustrated in FIG. 25.

EXAMPLE 2-18

The photosensitive drum 3 was prepared in the same way as in Example 2-1 with the exception that the base 32 included an aluminum tubular member having an outer diameter of 300 mm, and that the flange member 35 had a configuration illustrated in FIG. 26.

EXAMPLE 2-19

The photosensitive drum 3 was prepared in the same way as in Example 2-1 with the exception that the base 32 included an aluminum tubular member having an outer diameter of 300 mm, and that the flange member 35 had a configuration illustrated in FIG. 27.

EXAMPLE 2-20

The photosensitive drum 3 was prepared in the same way as in Example 2-1 with the exception that the base 32 included an aluminum tubular member having an outer diameter of 300 mm, and that the flange member 35 had a configuration illustrated in FIG. 28.

EXAMPLE 2-21

The photosensitive drum 3 was prepared in the same way as in Example 2-1 with the exception that the base 32 included an aluminum tubular member having an outer diameter of 300 mm, and that the flange member 35 had a configuration illustrated in FIG. 29.

EXAMPLE 2-22

The photosensitive drum 3 was prepared in the same way as in Example 2-1 with the exception that the base 32 included an aluminum tubular member having an outer diameter of 300 mm, and that the flange member 35 had a configuration illustrated in FIG. 30.

COMPARATIVE EXAMPLE 2

The photosensitive drum 3 was prepared in the same way as in Example 2-1 with the exception that the flange member 35 had a configuration illustrated in FIGS. 31A and 31B. The flange member 35 illustrated in FIGS. 31A and 31B does not include the stress-absorbing portion 316. FIG. 31A is a cross section of the flange member 35 taken along line A-A of FIG. 5. FIG. 31B is a cross section of the flange member 35 taken along line B-B of FIG. 5.

Table 2 illustrates the measurements of the flange member 35 according to Examples 2-1 through 2-22 and Comparative Example 2, and the results of Experiment 6.

TABLE 2

| | | | | | | F | | G | | | |
|---|---|---|---|---|---|---|---|---|---|---|---|
| Ex | A | B | C | D | E2 | Max | Min | Max | Min | H | I |
| 2-1 | 60 | 1 | 4 | 3 | Yes | 30 | 8 | 6 | 4 | 9 | 5 |
| 2-2 | 300 | 10 | 8 | 33 | Yes | 6 | 3 | 4 | 2 | 16 | 4 |
| 2-3 | 300 | 11 | 180 | 6 | Yes | 8 | 2 | 18 | 4 | 13 | 5 |
| 2-4 | 30 | 12 | 4 | 2 | Yes | 6 | 2 | 1 | 1 | 12 | 4 |
| 2-5 | 30 | 13 | 4 | 2 | Yes | 3 | 2 | 1 | 1 | 11 | 5 |
| 2-6 | 30 | 14 | 8 | 2 | Yes | 3 | 2 | 3 | 3 | 11 | 5 |
| 2-7 | 30 | 15 | 4 | 2 | Yes | 8 | 4 | 2 | 2 | 12 | 4 |
| 2-8 | 30 | 16 | 4 | 2 | No | 6 | 5 | 3 | 3 | 16 | 4 |
| 2-9 | 30 | 17 | 2 | 4 | No | 10 | 8 | 4 | 2 | 15 | 5 |
| 2-10 | 30 | 18 | 4 | 2 | No | 20 | 8 | 2 | 2 | 14 | 5 |
| 2-11 | 30 | 19 | 2 | 2 | No | 18 | 4 | 4 | 4 | 15 | 4 |
| 2-12 | 30 | 20 | 8 | 2 | No | 5 | 4 | 4 | 4 | 14 | 5 |
| 2-13 | 30 | 21 | 5 | 2 | No | 6 | 4 | 8 | 4 | 13 | 4 |
| 2-14 | 30 | 22 | 4 | 2 | No | 6 | 3 | 2 | 2 | 10 | 5 |
| 2-15 | 30 | 23 | 4 | 2 | No | 8 | 6 | 2 | 2 | 14 | 4 |
| 2-16 | 30 | 24 | 2 | 3 | No | 4 | 2 | 12 | 4 | 14 | 5 |
| 2-17 | 30 | 25 | 4 | 2 | No | 12 | 4 | 4 | 4 | 11 | 4 |
| 2-18 | 300 | 26 | 181 | 6 | Yes | 3 | 0.9 | 15 | 0.9 | 28 | 3 |
| 2-19 | 300 | 27 | 8 | 34 | Yes | 2 | 4 | 4 | 1 | 21 | 3 |
| 2-20 | 300 | 28 | 1 | 2 | Yes | — | — | 100 | 50 | 29 | 3 |
| 2-21 | 300 | 29 | 4 | 2 | Yes | 281 | 16 | 16 | 8 | 22 | 3 |
| 2-22 | 300 | 30 | 4 | 2 | Yes | 100 | 8 | 141 | 141 | 24 | 3 |
| CE2 | 60 | 31 | 0 | 0 | No | — | — | — | — | 35 | 2 |

E2: Does the stress-absorbing low-rigidity portion have a boundary that perpendicularly intersects the radius?

In Table 2, the "Circumferential maximum number (C)" indicates the number of the stress-absorbing low-rigidity portions 316A that intersect one of imaginary circles 327, each of which is formed by a set of points at the same distance from the center of the flange member 35, that is intersected by the maximum number of the stress-absorbing low-rigidity portions 316A.

The "Radial maximum number (D)" indicates the number of the stress-absorbing low-rigidity portions 316A that intersect one of arbitrary radii 329 drawn from the center of the flange member 35 to the outer-rim portion 319 that is intersected by the maximum number of the stress-absorbing low-rigidity portions 316A.

The "Circumferential interval (F)" indicates an interval W1 between the stress-absorbing low-rigidity portions 316A adjacent to each other on the imaginary circles 327.

The "Radial interval (G)" indicates an interval W2 between the stress-absorbing low-rigidity portions 316A adjacent to each other on the arbitrary radii 329.

The "Runout (H)" indicates the amount of displacement in the distance between a reference position opposite the surface of the photosensitive drum 3 and the surface of the photosensitive drum 3 when the photosensitive drum 3 was rotated about the rotating axis. Specifically, the runout indicates a "total run-out" value obtained by subtracting a minimum value of the distance between the reference position and the surface of the photosensitive drum 3 from its maximum value when the photosensitive drum 3 makes a full rotation. The runout value was measured by using equipment including a mechanism for holding and rotating the assembled photosensitive body while aligning the axial center between the left and right ends of the drum, and a laser meter (Type LS-7030 manufactured by KEYENCE CORPORATION).

FIGS. 32A and 32B illustrate the equipment used for measuring the runout of the photosensitive drum 3. FIG. 32A is a plan view, and FIG. 32B is a side view. As illustrated in FIG. 32B, a set of seven laser meters disposed on a light-projecting side emitted irradiating light beam La having a sufficient vertical (up-down in FIG. 32B) width into the gap between the lower edge of the photosensitive drum and the reference position. Of the irradiating light La, passed light Lb that passed the gap was received on a set of seven receiving-end laser meters. By measuring a vertical width G of the passed light beam Lb, the distance between the surface of the photosensitive drum 3 and the reference position was detected. Further, by measuring the vertical width G for the entire circumference of the photosensitive drum by using the seven sets of the laser meters, and then determining the difference between the maximum value and the minimum value of all of the measured values of the vertical width G, the "Runout" values in Table 2 were obtained.

When the runout value increases, the gap between a unit disposed near the surface of the photosensitive drum 3 and the surface of the photosensitive drum 3 becomes more and more uneven, resulting in greater density irregularities due to charge irregularities or development irregularities. The "Color reproduction characteristics" in Table 2 indicate the result of evaluation of color reproducibility of an image N1 (portrait) according to ISO/JIS-SCID output from an image forming apparatus equipped with the photosensitive drum 3 according to Examples 2-1 through 2-22 and Comparative Example 2.

As the image forming apparatus including the photosensitive drum 3, the Imagio Neo C325 manufactured by Ricoh Company, Ltd. was used for evaluating the photosensitive drum 3 having the base outer diameter of 30 mm. For evaluating the photosensitive drum 3 having the base outer diameter of 60 mm, the Imagio MP C6000 from Ricoh Company, Ltd. was used. For evaluating the photosensitive drum 3 having the base outer diameter of 300 mm, the image forming apparatus according to Embodiment 2 illustrated in FIG. 7 was used.

The color reproduction characteristics were evaluated on a scale of five ranks, as defined below. The ranks or evaluation references indicate the amount of error between images on the transfer sheet P when the same images were superposed on the transfer sheet P on an individual color basis.

Rank 1: Image error is 100 μm or more.
Rank 2: Image error is 70 μm or more and less than 100 μm.
Rank 3: Image error is 50 μm or more and less than 70 μm
Rank 4: Image error is 30 μm or more and less than 50 μm.
Rank 5: Image error is less than 30 μm.

EXAMPLE 3

Figure 49A:
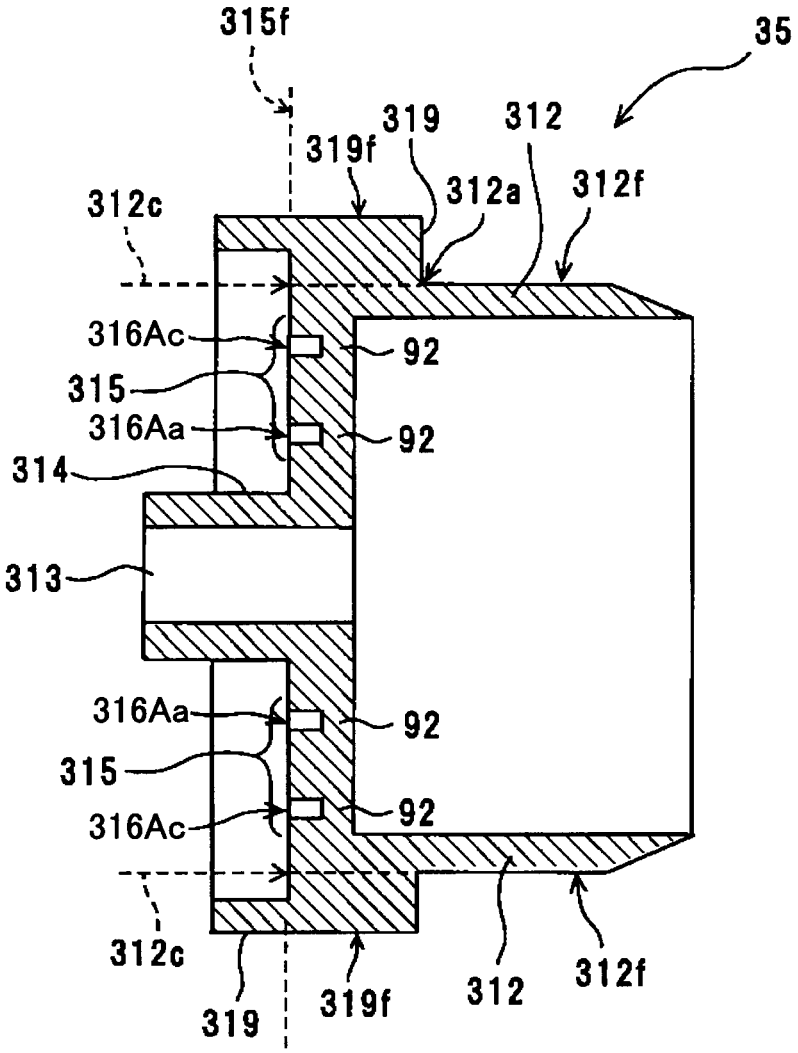
FIG. 49A is a cross section of the flange member according to Example 3 taken perpendicular to the axial direction.
Figure 49B:
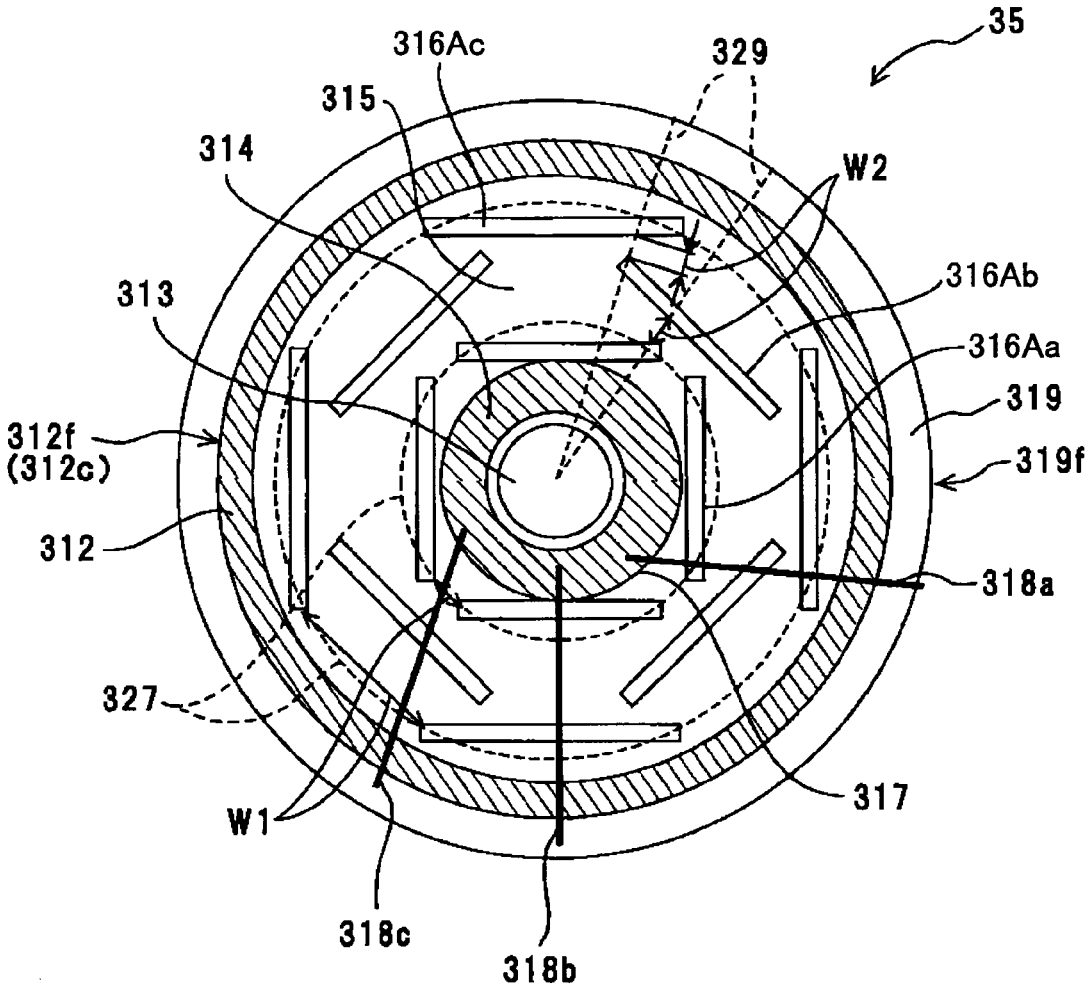
FIG. 49B is a cross section of the flange member according to Example 3 taken along the axial direction.

Next, the flange member 35 according to Example 3 will be described with reference to FIGS. 49A and 49B. FIG. 49A is a cross section of the flange member 35 taken along line A-A of FIG. 5. FIG. 49B is a cross section of the flange member 35 taken along line B-B of FIG. 5.

The flange member 35 according to Example 3 includes the press-fitted portion 312, the axle opening portion 314, the linking portion 315, and the outer-rim portion 319. When the press-fitted portion 312 is press-fitted in the end-opening portion 34 of the sleeve 30, the outer peripheral surface of the press-fitted portion 312, i.e., the press-fitted outer peripheral surface 312*f*, is in contact with the inner peripheral surface of the base 32 of the sleeve 30. The axle opening portion 314 includes the axle opening 313 in which a shaft member (not illustrated) is inserted. The outer-rim portion 319 includes the outer rim 319*f*, which is the outer-most peripheral portion of the flange member 35 in the radial direction. The linking portion 315 links the axle opening portion 314 with the press-fitted portion 312 and the outer-rim portion 319.

The linking portion 315 includes plural stress-absorbing low-rigidity portions 316Aa through 316Ac as stress-absorbing portions, any of which may be referred to as "the stress-absorbing portion 316A". The stress-absorbing low-rigidity portion 316A has a lower rigidity than the portions around it. The stress-absorbing low-rigidity portion 316A according to Example 3 includes concave portions 92 having a reduced thickness compared to the portions of the linking portion 315 around the concave portions 92. The concave portions 92 surrounded by the non-concave portions are rectangular in shape in the illustrated example of FIGS. 49A and 49B.

The axle opening portion 314 refers to the portion within the circle 317 having a radius corresponding to the distance between the axial center and the stress-absorbing low-rigidity portion 316A nearest the axial center, i.e., the stress-absorbing low-rigidity portion 316Aa, first excepting the axle opening 313.

Thus, when the press-fitted portion 312 is press-fitted within the end-opening portion 34, the concave portions 92 can be deformed such that the stress to which the press-fitted outer peripheral surface 312*f* may be subject from the inner peripheral surface of the sleeve 30 can be absorbed. Accordingly, the stress from the inner peripheral surface of the sleeve 30 upon press fitting can be prevented from being transmitted to the axle opening portion 314 via the linking portion 315.

The flange member 35 according to Example 3 has the feature that at least one stress-absorbing low-rigidity portion 316A including the concave portion 92 is disposed on the arbitrary imaginary line 318 drawn from the axle opening portion 314 to the outer-rim portion 319. For example, the arbitrary imaginary line includes arbitrary imaginary lines 318*a*, 318*b*, and 318*c*, as illustrated in FIG. 33B. Specifically, three concave portions 92 are provided on the arbitrary imaginary line 318*a*, two concave portions 92 are provided on the arbitrary imaginary line 318*b*, and one concave portion 92 is provided on the arbitrary imaginary line 318*c*. The imaginary line 318 refers to the arbitrary imaginary line drawn from the circumference of an imaginary projected circle 312*c* to the axle opening portion 314. The imaginary projected circle 312*c* is a projection of the press-fitted outer peripheral surface 312*f* of the press-fitted portion 312 on the imaginary plane 315*f* including the linking portion 315 and perpendicular to the axial direction (i.e., the lateral (left-right) direction in FIG. 49A).

In the flange member 35 of FIGS. 49A and 49B, the press-fitted outer peripheral surface 312*f* is formed parallel to the axial direction. When the press-fitted outer peripheral surface 312*f* is inclined with respect to the axial direction, the position of the circumference of the imaginary projected circle 312*c* is determined with respect to the position of the press-fitted outer peripheral surface 312*f* at the root of the press-fitted portion 312 (i.e., the portion 312*a* in FIG. 49A).

Thus, in accordance with Example 3, when the press-fitted portion 312 is press-fitted within the sleeve 30, the stress to which the press-fitted portion 312 may be subject from the base 32 of the sleeve 30 can be absorbed by deformation of the concave portion 92 as the stress-absorbing low-rigidity portion 316A. Accordingly, compared to a structure that does not include the stress-absorbing low-rigidity portion 316A, the deformation or displacement of the axle opening 313 can be more effectively prevented.

Thus, in the flange member 35 according to Example 3, at least one concave portion 92 is disposed on the arbitrary imaginary line 318 drawn from the axle opening portion 314 toward the outer-rim portion 319. Accordingly, the stress to which the press-fitted portion 312 may be subject from the base 32 in any direction upon press fitting can be absorbed by one or more of the concave portions 92. Accordingly, the stress to which the press-fitted outer peripheral surface 312*f* of the press-fitted portion 312 is subjected can be prevented from being directly transmitted to the axle opening portion 314, so that the deformation or displacement of the axle opening 313 can be prevented.

Further, each of the concave portions 92 surrounded by non-concave portions has a shape with a start point and an end point in the linking portion 315. Thus, the areas that are easily deformable are limited, so that deformation due to the stress upon press fitting can be prevented from being transmitted to the axle opening portion 314, thereby preventing the deformation or displacement of the axle opening 313.

EXPERIMENT 7

Experiment 7 was conducted in a manner similar to Experiment 6 using examples in which the location, the number, and the outer size of the stress-absorbing low-rigidity portion 316A of the flange member 35 according to Example 3 were varied.

The flange members 35 used in Experiment 7 had a thickness of 2.5 mm in the linking portion 315 and a thickness of 1.5 mm in the concave portion 92.

EXAMPLE 3-1

The photosensitive drum 3 was prepared in the same way as in Example 2-1 with the exception that the flange member 35 had a configuration illustrated in FIGS. 49A and 49B. The flange member 35 illustrated in FIGS. 49A and 493 includes the concave portions 92 formed by providing rectangular grooves on the side of the linking portion 315 facing the outside in the axial direction when attached to the sleeve 30.

EXAMPLE 3-2

The photosensitive drum 3 was prepared in the same way as in Example 3-1 with the exception that the base 32 included an aluminum tubular member having an outer diameter of 300 mm and that the flange member 35 had a configuration illustrated in FIG. 10. In Example 3-2, the stress-absorbing low-rigidity portions 316A of the flange member 35 illustrated in FIG. 10 were formed as the concave portions 92, as in Example 3-1. The same applies to Examples 3-3 through 3-17 and Examples 3-23 through 3-27 illustrated in FIGS. 11 through 30, as will be described below.

EXAMPLE 3-3

The photosensitive drum 3 was prepared in the same way as in Example 3-1 with the exception that the base 32 included an aluminum tubular member of an outer diameter of 300 mm, and that the flange member 35 had a configuration illustrated in FIG. 11.

EXAMPLE 3-4

The photosensitive drum 3 was prepared in the same way as in Example 3-1 with the exception that the base 32 had an aluminum tubular member having an outer diameter of 30 mm, and that the flange member 35 had a configuration illustrated in FIG. 12.

EXAMPLE 3-5

The photosensitive drum 3 was prepared in the same way as in Example 3-1 with the exception that the base 32 had an aluminum tubular member having an outer diameter of 30 mm, and that the flange member 35 had a configuration illustrated in FIG. 13.

EXAMPLE 3-6

The photosensitive drum 3 was prepared in the same way as in Example 3-1 with the exception that the base 32 had an aluminum tubular member having an outer diameter of 30 mm, and that the flange member 35 had a configuration illustrated in FIG. 14.

EXAMPLE 3-7

The photosensitive drum 3 was prepared in the same way as in Example 3-1 with the exception that the base 32 had an aluminum tubular member having an outer diameter of 30 mm, and that the flange member 35 had a configuration illustrated in FIG. 15.

EXAMPLE 3-8

The photosensitive drum 3 was prepared in the same way as in Example 3-1 with the exception that the base 32 had an aluminum tubular member having an outer diameter of 30 mm, and that the flange member 35 had a configuration illustrated in FIG. 16.

EXAMPLE 3-9

The photosensitive drum 3 was prepared in the same way as in Example 3-1 with the exception that the base 32 had an aluminum tubular member having an outer diameter of 30 mm, and that the flange member 35 had a configuration illustrated in FIG. 17.

EXAMPLE 3-10

The photosensitive drum 3 was prepared in the same way as in Example 3-1 with the exception that the base 32 had an aluminum tubular member having an outer diameter of 30 mm, and that the flange member 35 had a configuration illustrated in FIG. 18.

EXAMPLE 3-11

The photosensitive drum 3 was prepared in the same way as in Example 3-1 with the exception that the base 32 had an aluminum tubular member having an outer diameter of 30 mm, and that the flange member 35 had a configuration illustrated in FIG. 19.

EXAMPLE 3-12

The photosensitive drum 3 was prepared in the same way as in Example 3-1 with the exception that the base 32 had an aluminum tubular member having an outer diameter of 30 mm, and that the flange member 35 had a configuration illustrated in FIG. 20.

EXAMPLE 3-13

The photosensitive drum 3 was prepared in the same way as in Example 3-1 with the exception that the base 32 had an aluminum tubular member having an outer diameter of 30 mm, and that the flange member 35 had a configuration illustrated in FIG. 21.

EXAMPLE 3-14

The photosensitive drum 3 was prepared in the same way as in Example 3-1 with the exception that the base 32 had an aluminum tubular member having an outer diameter of 30 mm, and that the flange member 35 had a configuration illustrated in FIG. 22.

EXAMPLE 3-15

The photosensitive drum 3 was prepared in the same way as in Example 3-1 with the exception that the base 32 had an aluminum tubular member having an outer diameter of 30 mm, and the flange member 35 had a configuration illustrated in FIG. 23.

EXAMPLE 3-16

The photosensitive drum 3 was prepared in the same way as in Example 3-1 with the exception that the base 32 had an aluminum tubular member having an outer diameter of 30 mm, and that the flange member 35 had a configuration illustrated in FIG. 24.

EXAMPLE 3-17

The photosensitive drum 3 was prepared in the same way as in Example 3-1 with the exception that the base 32 had an aluminum tubular member having an outer diameter of 30 mm, and that the flange member 35 had a configuration illustrated in FIG. 25.

EXAMPLE 3-18

Figure 50A:
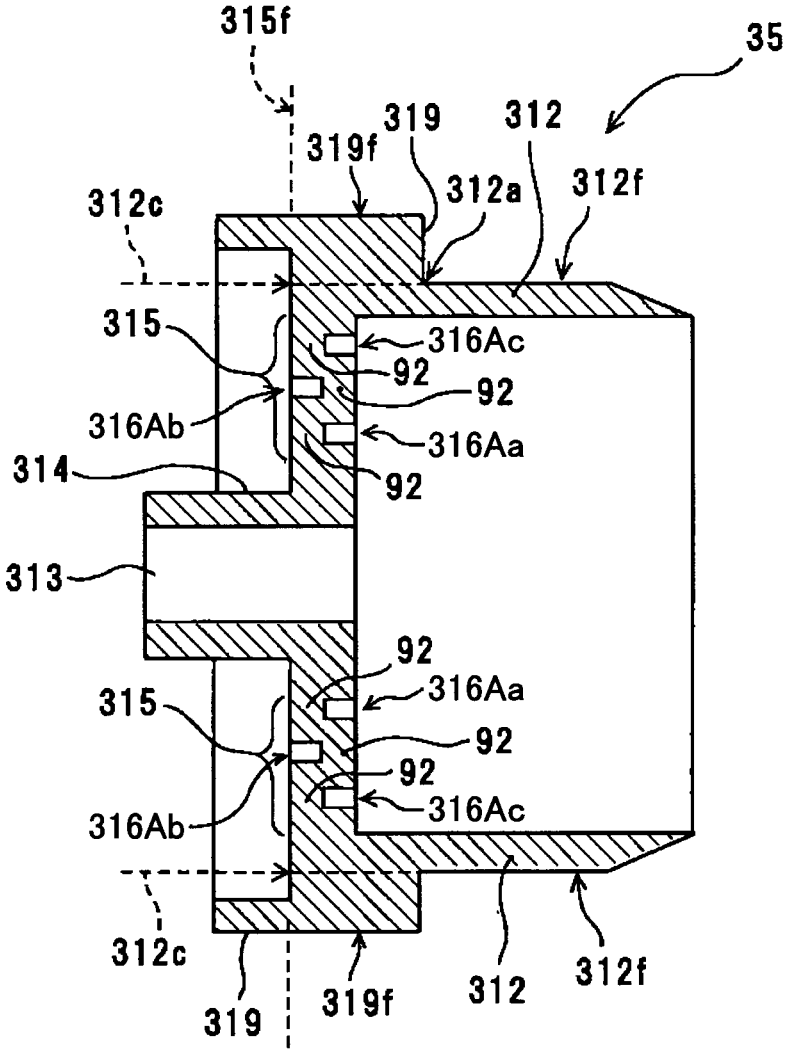
FIG. 50A is a cross section of the flange member according to Example 3-18 taken perpendicular to the axial direction.
Figure 50B:
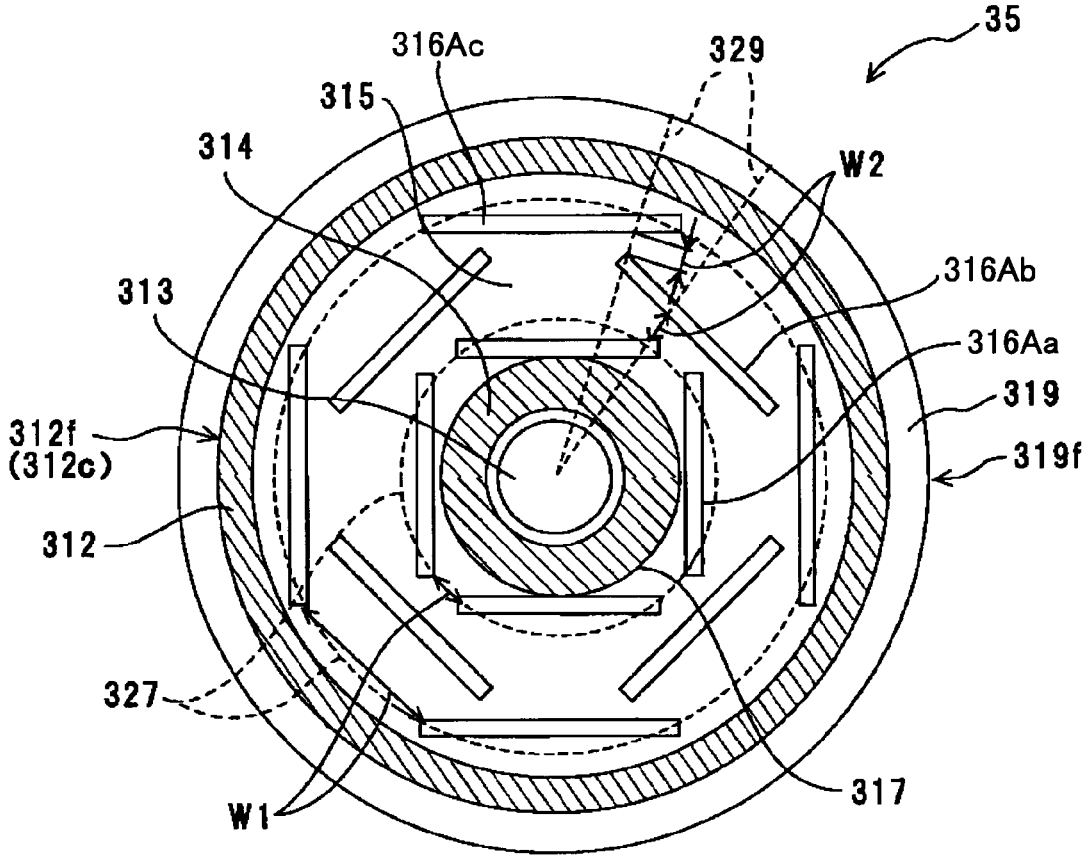
FIG. 50B is a cross section of the flange member according to Example 3-18 taken parallel to the axial direction.

The photosensitive drum 3 was prepared in the same way as in Example 3-1 with the exception that the flange member 35 had a configuration illustrated in FIGS. 50A and 50B. In the flange member 35 of FIGS. 50A and 50B, the stress-absorbing portion 316 includes a stress-absorbing portion 316*b* including the concave portion 92 formed by providing a rectangular groove on the side of the linking portion 315 facing the outside in the axial direction when the flange member 35 is attached to the sleeve 30. The stress-absorbing low-rigidity portion 316A also includes stress-absorbing low-rigidity portions 316*a* and 316*c* provided by forming the concave portions 92 on the side of the linking portion 315 facing the inside in the axial direction when attached to the sleeve 30.

EXAMPLE 3-19

Figure 51A:
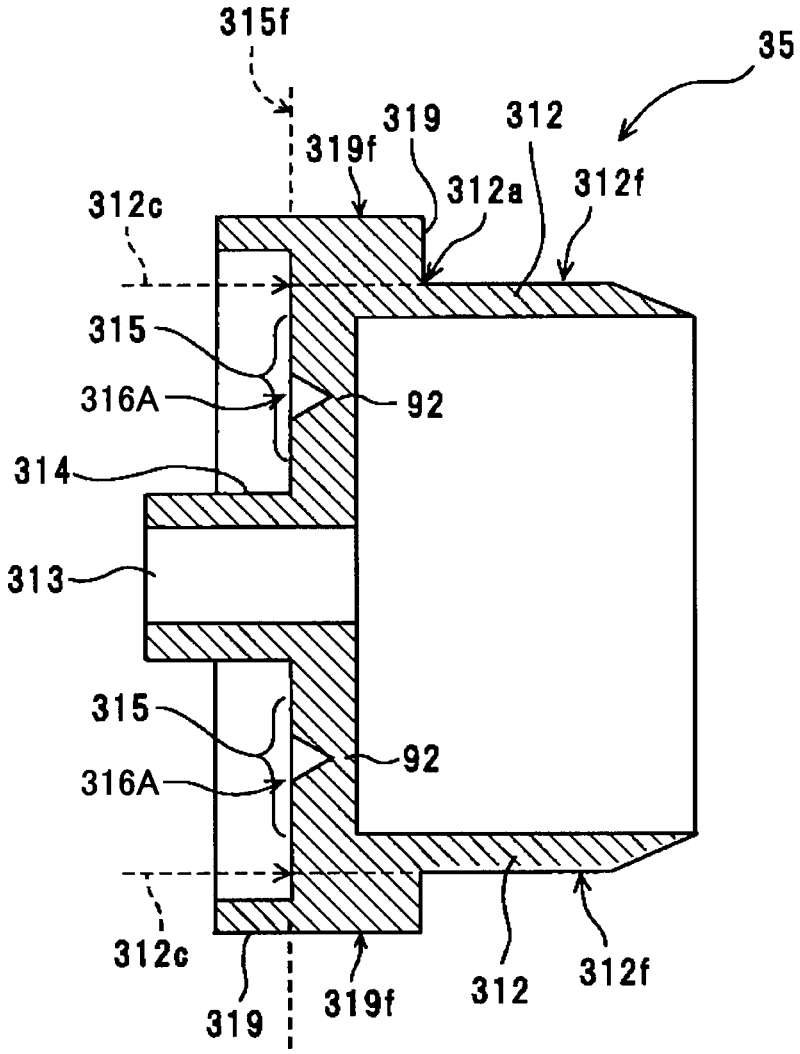
FIG. 51A is a cross section of the flange member according to Example 3-19 taken perpendicular to the axial direction.
Figure 51B:
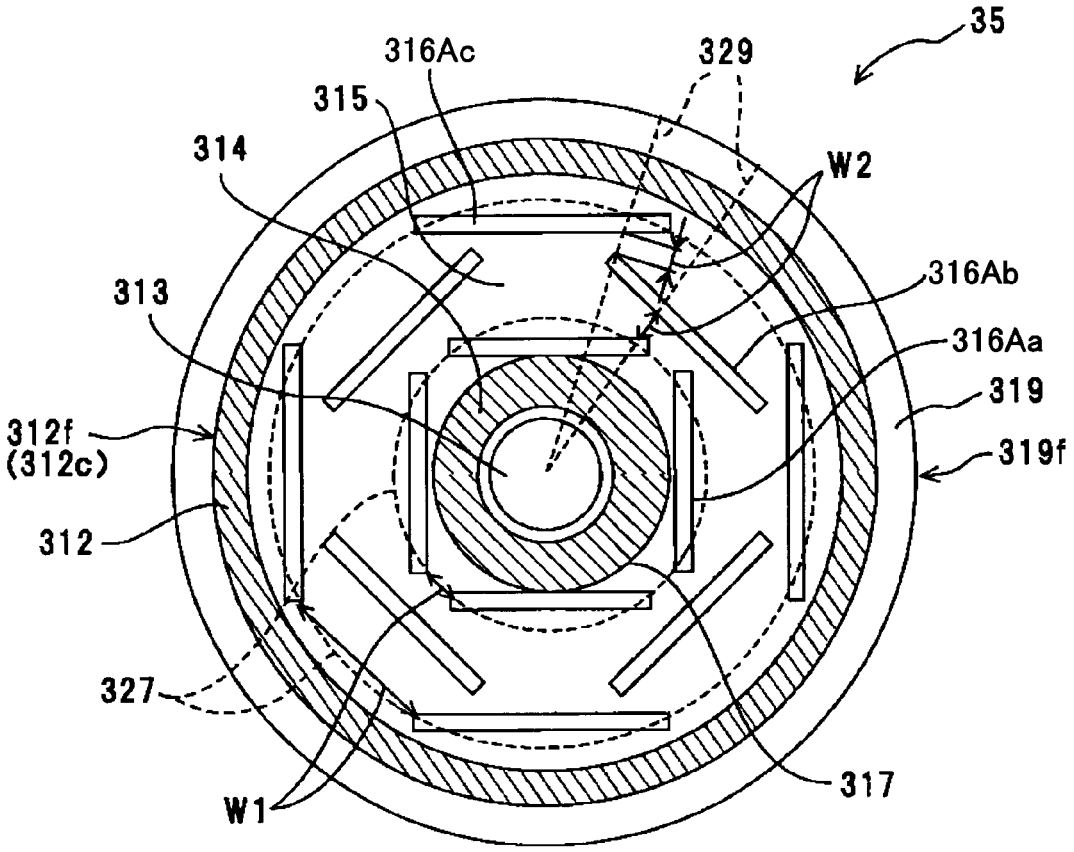
FIG. 51B is a cross section of the flange member according to Example 3-19 taken parallel to the axial direction.

The photosensitive drum 3 was prepared in the same way as in Example 3-1 with the exception that the flange member 35 had a configuration illustrated in FIGS. 51A and 51B. In the flange member 35 illustrated in FIGS. 51A and 51B, the stress-absorbing portion 316 was provided by forming the concave portions 92 in V-shape on the side of the linking portion 315 facing the outside in the axial direction when attached to the sleeve 30.

EXAMPLE 3-20

Figure 52A:
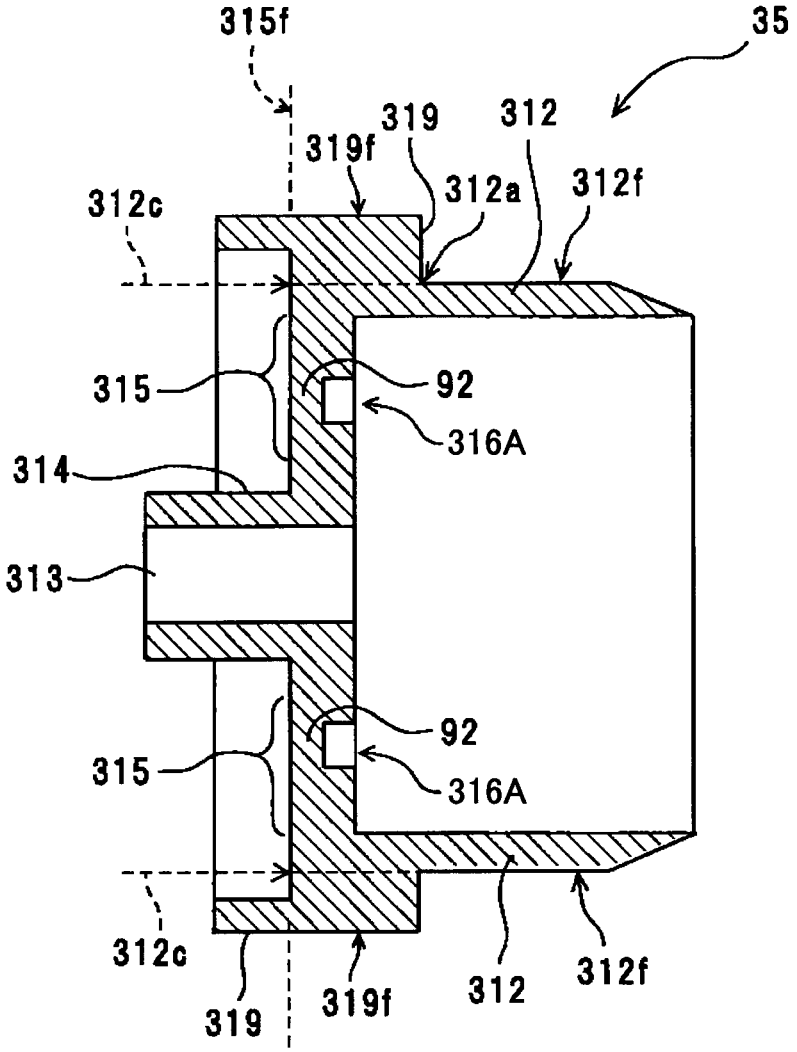
FIG. 52A is a cross section of the flange member according to Example 3-20 taken perpendicular to the axial direction.
Figure 52B:
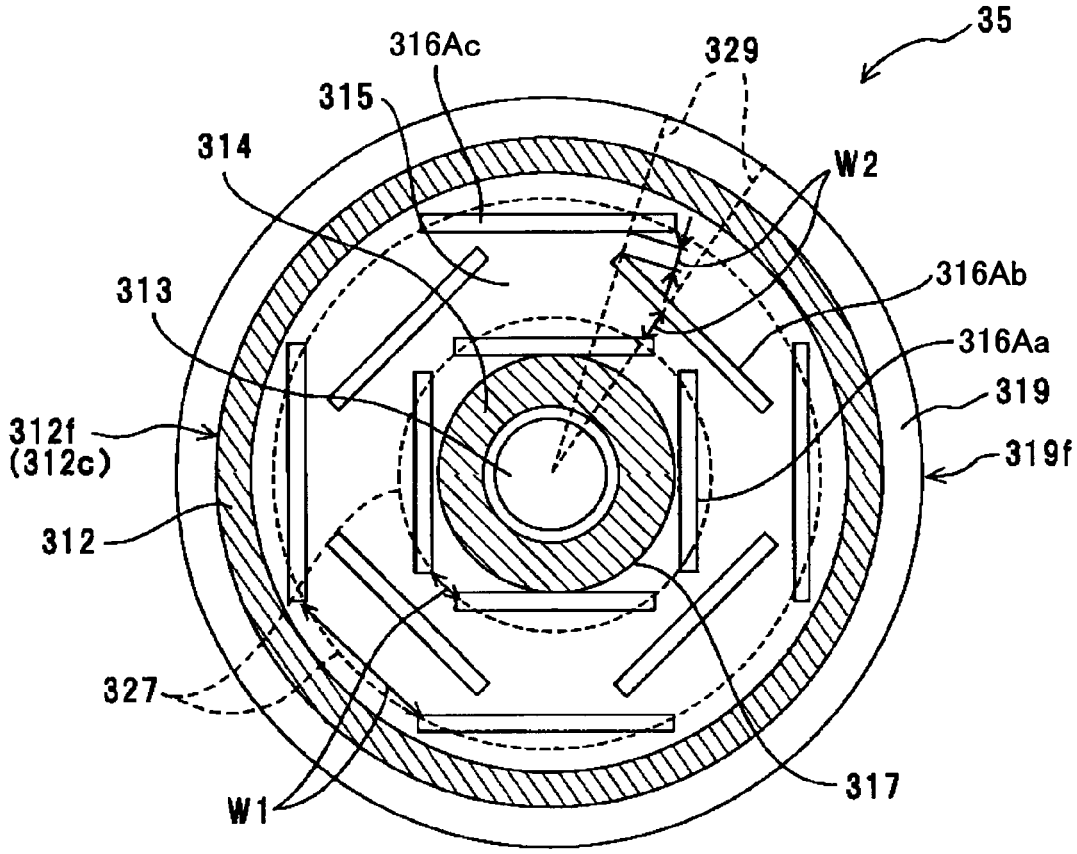
FIG. 52B is a cross section of the flange member according to Example 3-20 taken parallel to the axial direction.

The photosensitive drum 3 was prepared in the same way as in Example 3-1 with the exception that the flange member 35 had a configuration illustrated in FIGS. 52A and 52B. In the flange member 35 illustrated in FIGS. 52A and 52B, the stress-absorbing portion 316 includes the concave portions 92 formed by providing rectangular grooves on the side of the linking portion 315 facing the inside in the axial direction when attached to the sleeve 30.

EXAMPLE 3-21

Figure 53A:
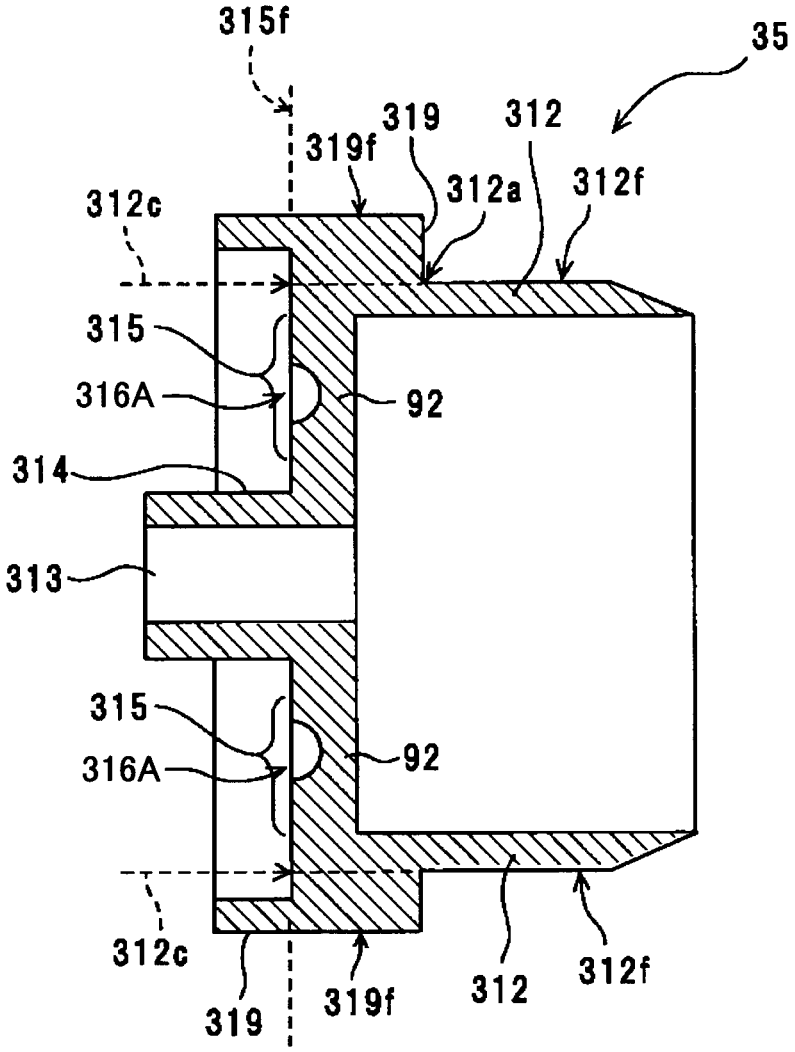
FIG. 53A is a cross section of the flange member according to Example 3-21 taken perpendicular to the axial direction.
Figure 53B:
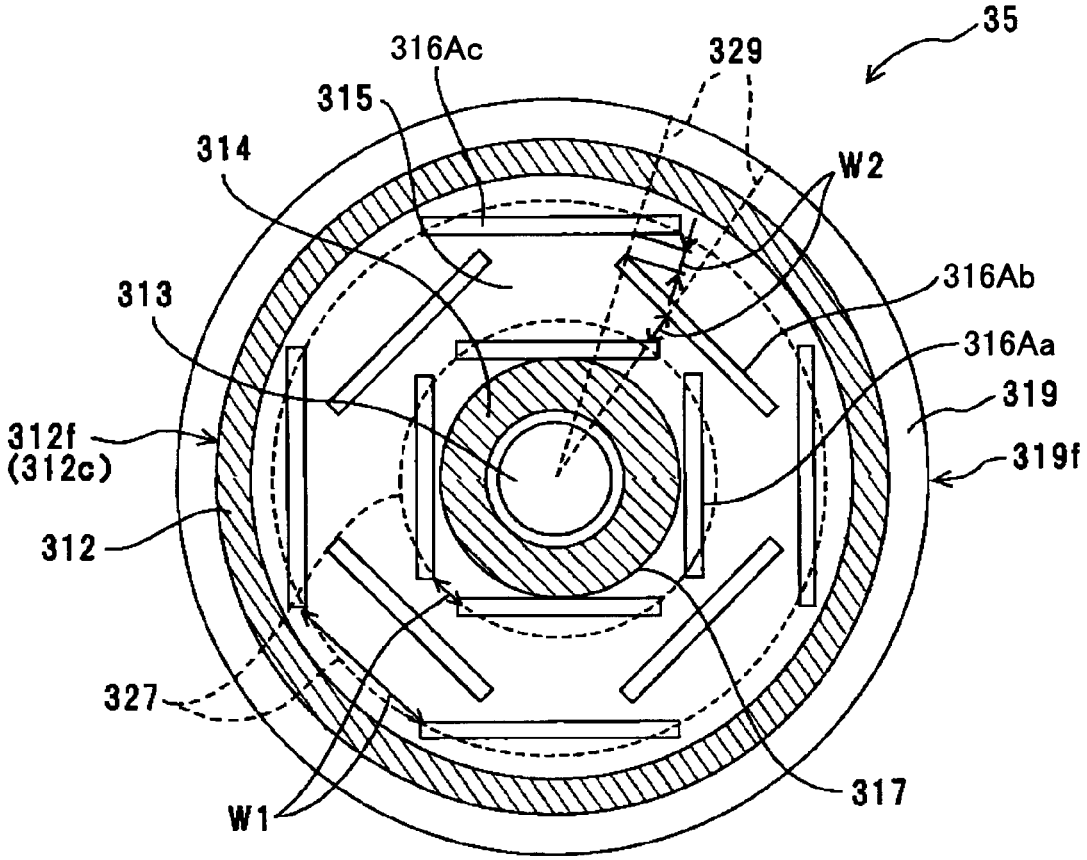
FIG. 53B is a cross section of the flange member according to Example 3-21 taken parallel to the axial direction.

The photosensitive drum 3 was prepared in the same way as in Example 3-1 with the exception that the flange member 35 had a configuration illustrated in FIGS. 53A and 53B. In the flange member 35 of FIGS. 53A and 53B, the stress-absorbing portion 316 includes the concave portions 92 formed by providing semicircular grooves on the side of the linking portion 315 facing the outside in the axial direction when attached to the sleeve 30.

EXAMPLE 3-22

Figure 54A:
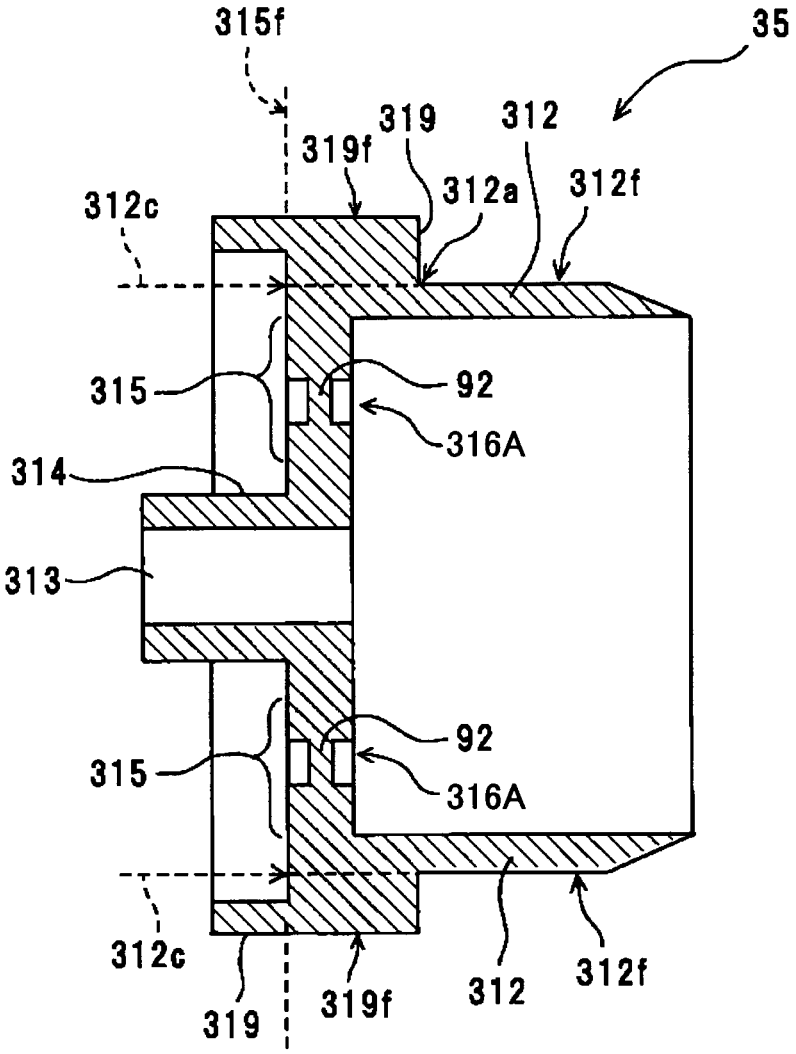
FIG. 54A is a cross section of the flange member according to Example 3-22 taken perpendicular to the axial direction.
Figure 54B:
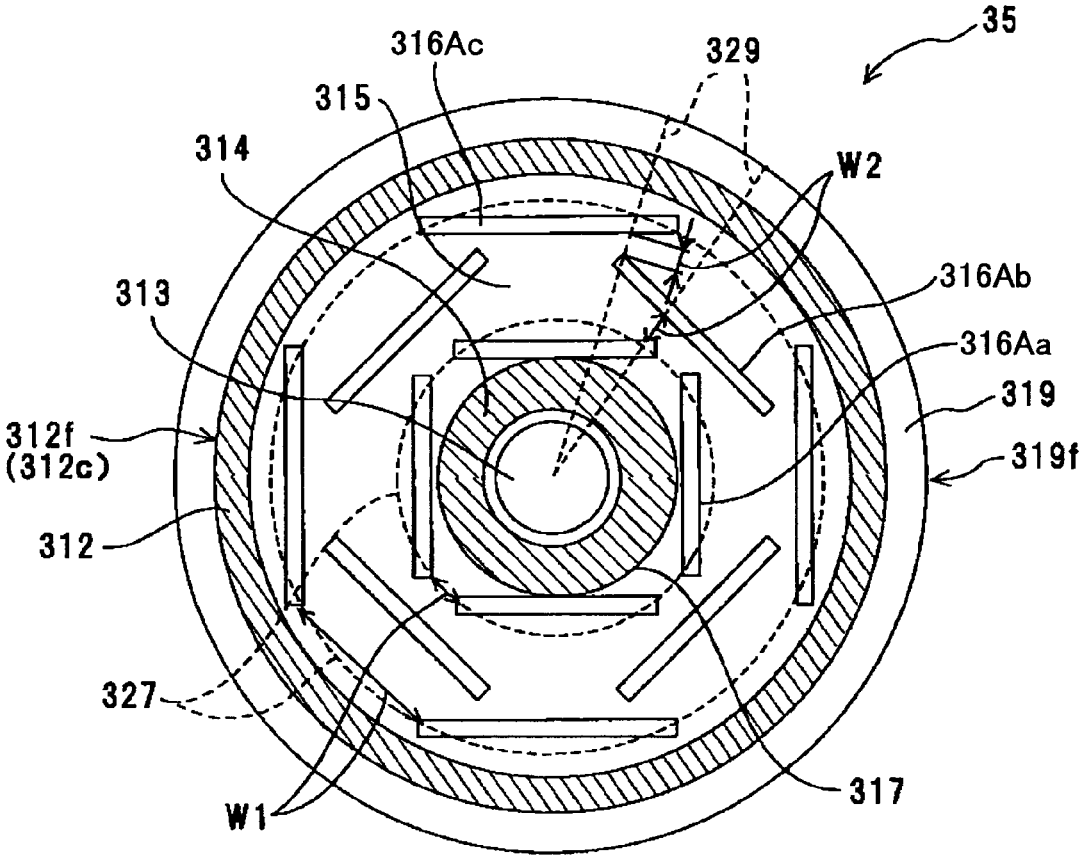
FIG. 54B is a cross section of the flange member according to Example 3-22 taken parallel to the axial direction.

The photosensitive drum 3 was prepared in the same way as in Example 3-1 with the exception that the flange member 35 had a configuration illustrated in FIGS. 54A and 54B. In the flange member 35 of FIGS. 54A and 54B, the stress-absorbing portion 316 includes the concave portions 92 formed by providing rectangular grooves on both sides of the linking portion 315 in the axial direction when attached to the sleeve 30.

EXAMPLE 3-23

The photosensitive drum 3 was prepared in the same way as in Example 3-1 with the exception that the base 32 included an aluminum tubular member having an outer diameter of 300 mm, and that the flange member 35 had a configuration illustrated in FIG. 26.

EXAMPLE 3-24

The photosensitive drum 3 was prepared in the same way as in Example 3-1 with the exception that the base 32 included an aluminum tubular member having an outer diameter of 300 mm, and that the flange member 35 had a configuration illustrated in FIG. 27.

EXAMPLE 3-25

The photosensitive drum 3 was prepared in the same way as in Example 3-1 with the exception that the base 32 included an aluminum tubular member having an outer diameter of 300 mm, and that the flange member 35 had a configuration illustrated in FIG. 28.

EXAMPLE 3-26

The photosensitive drum 3 was prepared in the same way as in Example 3-1 with the exception that the base 32 included an aluminum tubular member with an outer diameter of 300 mm, and that the flange member 35 had a configuration illustrated in FIG. 29.

EXAMPLE 3-27

The photosensitive drum 3 was prepared in the same way as in Example 3-1 with the exception that the base 32 included an aluminum tubular member having an outer diameter of 300 mm, and that the flange member 35 had a configuration illustrated in FIG. 30.

COMPARATIVE EXAMPLE 3

The photosensitive drum 3 was prepared in the same way as in Example 3-1 with the exception that the flange member 35 had a configuration illustrated in FIGS. 31A and 31B.

Table 3 illustrates the measurements of the flange member 35 according to Examples 3-1 through 3-27 and Comparative Example 3, and the results of experiments.

TABLE 3

| | | | | | | F | | G | | | |
|---|---|---|---|---|---|---|---|---|---|---|---|
| Ex | A | B | C | D | E2 | Max | Min | Max | Min | H | I |
| 3-1 | 60 | 33 | 4 | 3 | Yes | 30 | 8 | 6 | 4 | 11 | 4 |
| 3-2 | 300 | 10 | 8 | 33 | Yes | 6 | 3 | 4 | 2 | 16 | 4 |
| 3-3 | 300 | 11 | 180 | 6 | Yes | 8 | 2 | 18 | 4 | 17 | 4 |
| 3-4 | 30 | 12 | 4 | 2 | Yes | 6 | 2 | 1 | 1 | 12 | 5 |
| 3-5 | 30 | 13 | 4 | 2 | Yes | 3 | 2 | 1 | 1 | 9 | 5 |
| 3-6 | 30 | 14 | 8 | 2 | Yes | 3 | 2 | 3 | 3 | 10 | 5 |
| 3-7 | 30 | 15 | 4 | 2 | Yes | 8 | 4 | 2 | 2 | 14 | 4 |
| 3-8 | 30 | 16 | 4 | 2 | No | 6 | 5 | 3 | 3 | 13 | 5 |
| 3-9 | 30 | 17 | 2 | 4 | No | 10 | 8 | 4 | 2 | 12 | 5 |
| 3-10 | 30 | 18 | 4 | 2 | No | 20 | 8 | 2 | 2 | 14 | 5 |
| 3-11 | 30 | 19 | 2 | 2 | No | 18 | 4 | 4 | 4 | 14 | 5 |
| 3-12 | 30 | 20 | 8 | 2 | No | 5 | 4 | 4 | 4 | 14 | 4 |
| 3-13 | 30 | 21 | 5 | 2 | No | 6 | 4 | 8 | 4 | 14 | 4 |
| 3-14 | 30 | 22 | 4 | 2 | No | 6 | 3 | 2 | 2 | 13 | 5 |
| 3-15 | 30 | 23 | 4 | 2 | No | 8 | 6 | 2 | 2 | 10 | 5 |
| 3-16 | 30 | 24 | 2 | 3 | No | 4 | 2 | 12 | 4 | 14 | 5 |
| 3-17 | 30 | 25 | 4 | 2 | No | 12 | 4 | 4 | 4 | 13 | 4 |
| 3-18 | 60 | 50 | 4 | 3 | Yes | 30 | 8 | 6 | 4 | 14 | 5 |
| 3-19 | 60 | 51 | 4 | 3 | Yes | 30 | 8 | 6 | 4 | 12 | 5 |
| 3-20 | 60 | 52 | 4 | 3 | Yes | 30 | 8 | 6 | 4 | 13 | 5 |
| 3-21 | 60 | 53 | 4 | 3 | Yes | 30 | 8 | 6 | 4 | 12 | 4 |
| 3-22 | 60 | 54 | 4 | 3 | Yes | 30 | 8 | 6 | 4 | 11 | 5 |
| 3-23 | 300 | 26 | 181 | 6 | Yes | 3 | 0.9 | 15 | 0.9 | 25 | 3 |
| 3-24 | 300 | 27 | 8 | 34 | Yes | 2 | 4 | 4 | 1 | 21 | 3 |
| 3-25 | 300 | 28 | 1 | 2 | Yes | — | — | 100 | 50 | 29 | 3 |
| 3-26 | 300 | 29 | 4 | 2 | Yes | 281 | 16 | 16 | 8 | 25 | 3 |
| 3-27 | 300 | 30 | 4 | 2 | Yes | 100 | 8 | 141 | 141 | 22 | 3 |
| CE3 | 60 | 31 | 0 | 0 | No | — | — | — | — | 36 | 2 |

Thus, in the flange member 35 according to the present embodiment, the stress-absorbing low-rigidity portion 316A includes a side that intersects the radius 329. Accordingly, the stress upon press fitting can be absorbed efficiently, and the deformation or displacement of the axle opening 313 can be reduced.

When the maximum number of the stress-absorbing low-rigidity portions 316A in the circumference direction is 2 or more and 180 or less, the deformation or displacement of the axle opening 313 may be further reduced. The term "circumference" herein refers to a circular line made up of a set of points having the same distance from the center of the flange. In the illustrated examples, the circumference may correspond to any of the imaginary circles 327.

Preferably, when the internal diameter of the base 32 for the photosensitive drum 3 is 40 mm or less, the maximum number of the stress-absorbing low-rigidity portions 316A in the circumference direction may be 2 or more and 30 or less. More preferably, the maximum number may be 3 or more and 12 or less in view of the balance between the prevention of deformation or displacement of the axle opening 313 and the difficulty of forming the flange member 35.

Preferably, when the internal diameter of the base 32 for the photosensitive drum 3 is 40 mm or more and 150 mm or less, the maximum number of the stress-absorbing low-rigidity portions 316A in the circumference direction may be 2 or more and 100 or less. More preferably, the maximum number may be 12 or more and 24 or less in view of the balance between the prevention of deformation or displacement of the axle opening 313 and the difficulty of forming the flange member 35. Further preferably, when the internal diameter of the base 32 for the photosensitive drum 3 is more than 150 mm, the maximum number of the stress-absorbing low-rigidity portions 316A in the circumference direction may be 2 or more and 180 or less. More preferably, the maximum number may be 24 or more and 48 or less in view of the balance between the prevention of deformation or displacement of the axle opening 313 and the difficulty of forming the flange member 35.

When the maximum number of the stress-absorbing low-rigidity portions 316A on the arbitrary radius 329 is 2 or more and 33 or less, the deformation or displacement of the axle opening may be further reduced. The "arbitrary radius 329" refers to a line connecting the center of the flange and an arbitrary point on the circumference. In accordance with the present embodiment, the flange member 35 includes at least one stress-absorbing portion 316A on the arbitrary imaginary line 318 drawn from the axle opening portion 314 to the imaginary projected circle 312*c*. Thus, there is at least one stress-absorbing opening in the radial direction.

Preferably, when the internal diameter of the base 32 for the photosensitive drum 30 is 40 mm or less, the maximum number of the stress-absorbing low-rigidity portions 316A in the radial direction may be 2 or more and 5 or less. More preferably, from the viewpoint of balance between the prevention of deformation or displacement of the axle opening 313 and the difficulty of forming the flange member 35, the maximum number may be 3 or more and 5 or less.

Preferably, when the internal diameter of the base 32 for the photosensitive drum 3 is 40 mm or more and 150 mm or less, the maximum number of the stress-absorbing low-rigidity portions 316A in the radial direction may be 2 or more and 20 or less. More preferably, from the viewpoint of balance between the prevention of deformation or displacement of the axle opening 313 and the difficulty of forming the flange member 35, the maximum number may be 4 or more and 10 or less.

Preferably, when the internal diameter of the base 32 for the photosensitive drum 3 is more than 150 mm, the maximum number of the stress-absorbing low-rigidity portions 316A in the radial direction may be 2 or more and 33 or less. More preferably, from the viewpoint of balance between the prevention of deformation or displacement of the axle opening 313 and the difficulty of forming the flange member 35, the maximum number may be 6 or more and 20 or less.

When the interval of the stress-absorbing low-rigidity portions 316A adjacent to each other in the circumference direction is 1 mm or more and 280 mm or less, the deformation or displacement of the axle opening 313 may be further reduced. The "interval" herein refers to the circumferential interval W1 indicated in FIGS. 48A and 48B and other figures corresponding to the various examples. More specifically, the interval W1 refers to a minimum distance between the stress-absorbing low-rigidity portions 316A adjacent to each other in the circumference direction. In the flange member 35 according to Example 20 illustrated in FIG. 28, there is no such circumferential interval.

Preferably, when the internal diameter of the base 32 for the photosensitive drum 3 is 40 mm or less, the circumferential interval W1 may be 1 mm or more and 30 mm or less. More preferably, from the viewpoint of balance between the prevention of deformation or displacement of the axle opening 313 and the difficulty of forming the flange member 35, the circumferential interval W1 may be 1 mm or more and 10 mm or less.

Preferably, when the internal diameter of the base 32 for the photosensitive drum 3 is 40 mm or more and 150 mm or less, the circumferential interval W1 is 1 mm or more and 50 mm or less. More preferably, from the viewpoint of balance between the prevention of deformation or displacement of the axle opening 313 and the difficulty of forming the flange member 35, the circumferential interval W1 may be 1 mm or more and 30 mm or less.

Further preferably, when the internal diameter of the base 32 for the photosensitive drum 3 is more than 150 mm, the circumferential interval W1 is 1 mm or more and 280 mm or less. More preferably, from the viewpoint of balance between the prevention of deformation or displacement of the axle opening 313 and the difficulty of forming the flange member 35, the circumferential interval W1 may be 1 mm or more and 50 mm or less.

When the interval between the stress-absorbing low-rigidity portions 316A adjacent to each other in the radial direction may be 1 mm or more and 130 mm or less, the deformation or displacement of the axle opening 313 may be further reduced. The interval herein refers to the radial interval W2 illustrated in FIGS. 48A and 48B and other figures corresponding to the various examples. Specifically, the radial interval W2 indicates a minimum distance between the stress-absorbing low-rigidity portions 316A adjacent to each other in the radial direction.

Preferably, when the internal diameter of the base 32 for the photosensitive drum 3 is 40 mm or less, the radial interval W2 may be 1 mm or more and 10 mm or less. More preferably, from the viewpoint of balance between the prevention of deformation or displacement of the axle opening 313 and the difficulty of forming the flange member 35, the radial interval W2 may be 1 mm or more and 5 mm or less.

Preferably, when the internal diameter of the base 32 for the photosensitive drum 3 is 40 mm or more and 150 mm or less, the radial interval W2 may be 1 mm or more and 70 mm or less. More preferably, from the viewpoint of balance between the prevention of deformation or displacement of the axle opening 313 and the difficulty of forming the flange member 35, the radial interval W2 may be 1 mm or more and 30 mm or less.

Preferably, when the internal diameter of the base 32 for the photosensitive drum 3 is more than 150 mm, the radial interval W2 may be 1 mm or more and 130 mm or less. More preferably, from the viewpoint of balance between the prevention of deformation or displacement of the axle opening 313 and the difficulty of forming the flange member 35, the radial interval W2 may be 1 mm or more and 80 mm or less.

Thus, the flange member 35 according to Example 1 includes the press-fitted portion 312 configured to be press-fitted in the end-opening portion 34 of the sleeve 30, which is a hollow cylindrical sleeve member; the axle opening portion 314 including the axle opening 313 into which a shaft member is inserted at the position corresponding to the central axis of the sleeve 30 when the press-fitted portion 312 is press-fitted in the end-opening portion 34; and the linking portion 315 extending in a direction parallel to the circular cross section of the sleeve 30 upon press-fitting, and connecting the axle opening portion 314 with the press-fitted portion 312.

The linking portion 315 includes the stress-absorbing opening 316 configured to absorb the stress to which the press-fitted outer peripheral surface 312*f*, i.e., the outer peripheral surface of the press-fitted portion 312 that contacts the inner peripheral surface of the end-opening portion 34 of the sleeve 30 upon press fitting. Thus, the stress can be prevented from being transmitted to the axle opening portion 314 via the linking portion 315.

Further, the flange member 35 includes at least one stress-absorbing opening 316 on the arbitrary imaginary line 318 drawn from the circumference of the imaginary projected circle 312*c* to the axle opening portion 314. The imaginary projected circle 312*c* is a projection of the press-fitted outer peripheral surface 312*f* on the imaginary plane 315*f* including the linking portion 315 and perpendicular to the axial direction. Thus, any imaginary line 318 drawn from the circumference of the imaginary projected circle 312*c* to the axle opening portion 314 intersects the stress-absorbing opening 316. Accordingly, the stress to which the press-fitted outer peripheral surface 312*f* may be subject from any direction can be absorbed by the stress-absorbing opening 316. As a result, the stress to which the press-fitted outer peripheral surface 312*f* is subjected can be prevented from being directly transmitted to the axle opening portion 314, thereby preventing the deformation or displacement of the axle opening 313. Thus, deformation or displacement of the axle opening 313 upon press fitting of the flange member 35 into the sleeve 30 can be more reliably prevented.

When the flange member 35 according to Example 1 has the configuration of FIG. 46 where the stress-absorbing opening 316 is rectangular, the stress-absorbing opening 316 includes a substantially straight side that perpendicularly intersects the virtual line 318 extending in the radial direction of the circular cross section when the flange member 35 is press-fitted in the sleeve 30. Thus, when stress is applied in a direction along the virtual line 318, the linking portion 315 can be readily deformed near the stress-absorbing opening 316, so that the stress can be prevented from being transmitted to the axle opening portion 314 more reliably.

The flange member 35 according to Example 2 or 3 includes the press-fitted portion 312 configured to be press-fitted in the axial end-opening portion 34 of the sleeve 30, which is a hollow cylindrical sleeve member, the axle opening portion 314 including the axle opening 313 into which a shaft member is inserted at the position corresponding to the central axis of the sleeve 30 when the press-fitted portion 312 is press-fitted in the end-opening portion 34, and the linking portion 315 extending in a direction parallel to the circular cross section of the sleeve 30 upon press-fitting, and connecting the axle opening portion 314 with the press-fitted portion 312.

The linking portion 315 includes the stress-absorbing low-rigidity portion 316A having a lower rigidity than the areas around the stress-absorbing low-rigidity portion 316A. The stress-absorbing portion 316A is configured to be deformed upon press fitting of the press-fitted portion 312 in the end-opening portion 34. Thus, the stress to which the press-fitted outer peripheral surface 312*f*, i.e., the outer peripheral surface of the press-fitted portion 312 that contacts the inner peripheral surface of the end-opening portion 34 of the sleeve 30, can be absorbed by deformation of the stress-absorbing low-rigidity portion 316A, so that the stress can be prevented from being transmitted to the axle opening portion 314 via the linking portion 315.

Further, the flange member 35 according to Example 2 or 3 includes at least one stress-absorbing portion 316A on the arbitrary imaginary line 318 drawn from the circumference of the imaginary projected circle 312*c* to the axle opening portion 314. The imaginary projected circle 312*c* is a projection of the press-fitted outer peripheral surface 312*f* on the imaginary plane 315*f* including the linking portion 315 and perpendicular to the axial direction. Thus, any imaginary line 318 drawn from the circumference of the imaginary projected circle 312*c* to the axle opening portion 314 intersects the stress-absorbing portion 316. Accordingly, the stress to which the press-fitted outer peripheral surface 312*f* may be subject from any direction can be absorbed by the stress-absorbing low-rigidity portion 316A. As a result, the stress to which the press-fitted outer peripheral surface 312*f* is subjected can be prevented from being directly transmitted to the axle opening portion 314, thereby preventing the deformation or displacement of the axle opening 313. Thus, deformation or displacement of the axle opening 313 upon press fitting of the flange member 35 into the sleeve 30 can be more reliably prevented.

Particularly, in the flange member 35 according to Example 2, the stress-absorbing portion 316 includes the stress absorbing openings in the linking portion 315 which is filled with the stress-absorbing material 91 more readily deformable than the material of the linking portion 315. Thus, the stress upon press fitting can be absorbed by deformation of the stress-absorbing material 91 of the stress-absorbing low-rigidity portion 316A.

In the flange member 35 according to Example 3, the stress-absorbing low-rigidity portion 316A includes the concave portions 92 having a reduced thickness compared to the thickness of the surrounding areas of the linking portion 315. Thus, the stress upon press fitting can be absorbed by deformation of the concave portion 92 with the reduced thickness.

In the flange members 35 illustrated in FIGS. 48A, 48B, 10 through 15, 26 through 30, and 49 through 54, the boundary between the stress-absorbing low-rigidity portion 316A and the surrounding portions includes a substantially straight side perpendicularly intersecting the radius 329 of the imaginary projected circle 312*c*. Thus, the linking portion 315 is readily deformable near the stress absorbing opening 36 when stress is applied in a direction along the radius 329, so that the stress can be prevented from being transmitted to the axle opening portion 314 more reliably.

Preferably, in the flange member 35 according to the various examples, the number of the stress-absorbing low-rigidity portions 316A or stress-absorbing openings 316 disposed on the same circumference at the same distance from the central position of the axle opening 313 in the radius direction in the circular cross section when press-fitted in the sleeve 30 may be 2 or more and 180 or less. In Experiments 1, 6, and 7, it was confirmed that when the number of the stress-absorbing openings 316 or stress-absorbing low-rigidity portions 316A in the circumference direction is this range, the runout can be more effectively prevented than according to the Comparative Examples.

Preferably, in the flange member 35, the number of the stress-absorbing low-rigidity portions 316 or stress-absorbing low-rigidity portion 316A that intersect the radius 329, which is an imaginary line drawn from the central position of the axle opening 313 to the circumference of the imaginary projected circle 312*c*, may be 2 or more and 33 or less. It was confirmed in Experiments 1, 6, and 7 that when the number of the stress-absorbing low-rigidity portions 316 or stress-absorbing low-rigidity portions 316A in the radial direction is in this range, the runout can be more effectively prevented than according to the Comparative Examples.

Preferably, in the flange member 35, the circumferential interval W1 may be 1 mm or more and 280 mm or less. The circumferential interval W1 is the interval between a plurality of stress-absorbing low-rigidity portions 316 or stress-absorbing low-rigidity portions 316A adjacent to each other on the same circumference of the imaginary circle 327 having the same distance from the central position of the axle opening 313 in the radial direction of a circular cross section when press-fitted in the sleeve 30. In Experiments 1, 6, and 7, it was confirmed that when the circumferential interval W1 is in this range, runout can be more effectively prevented than according to the Comparative Examples.

Preferably, in the flange member 35, the radial interval W2 may be 1 mm or more and 130 mm or less. The radial interval W2 is the interval between a plurality of the stress-absorbing openings 316 or stress-absorbing low-rigidity portions 316A that intersect the radius 329, which is an imaginary line drawn from the central position of the axle opening 313 to the circumference of the imaginary projected circle 312*c*. It was confirmed through Experiments 1, 6, and 7 that when the radial interval W2 is in this range, runout can be more effectively prevented than according to the Comparative Example.

In accordance with the present invention, the photosensitive drum 3 includes the sleeve 30, which is a hollow and cylindrical sleeve member having the photosensitive layer 31 on an outer peripheral surface thereof, and the flange members.

The flange members include the axle opening 313 in which a shaft member positioned at the central axis of the sleeve 30 is inserted. The flange members are press-fitted in the end-opening portions 34 at the ends of the sleeve 30 in the axial direction. By using the flange member 35 having the inventive features in the photosensitive drum 3, a high runout accuracy can be obtained because of the reduced positional error of the axle opening 313, thus minimizing the total run-out.

The image forming unit 1 according to Embodiment 1 or the process cartridge 700 according to Embodiment 2 may provide a process cartridge that can be attached to or detached from the copy machine 500 or the printer 600. The copy machine 500 or the printer 600, i.e., the image forming apparatus main body, includes the photosensitive drum 3, the charging unit 4 that charges the photosensitive drum 3, the latent-image forming unit that forms an electrostatic latent image on the surface of the photosensitive drum 3 charged by the charging unit 4, the developing unit 5 that develops the electrostatic latent image by attaching toner thereto, the transfer unit that transfers the toner image formed by the developing unit onto the intermediate transfer belt 10 or the transfer sheet P as a transferred body, and the drum cleaning unit 6 that removes the residual toner from the surface of the photosensitive drum 3 after the transfer process. The process cartridge 700 enables the photosensitive drum 3, the charging unit 4, the developing unit 5, and the drum cleaning unit 6 to be integrally attached to or detached from the image forming apparatus main body. By using the photosensitive drum 3 including the flange members 35 having the features according to the embodiments of the invention and a high runout accuracy in the process cartridge, the development of variations in the distance between the surface of the photosensitive drum 3 and a process unit, such as the charging unit 4 or the developing unit 5, for example, can be prevented. Thus, the density irregularities due to charge irregularities or development irregularities can be prevented.

The copy machine 500 according to Embodiment 1 is an image forming apparatus including the photosensitive drum 3, the charging unit 4 that charges the photosensitive drum 3, the exposing unit 21 (latent-image forming unit) that forms an electrostatic latent image on the surface of the photosensitive drum 3 charged by the charging unit 4, the developing unit 5 that attaches toner to the electrostatic latent image formed by the exposing unit 21, the primary transfer roller 8 (transfer unit) that causes the toner image formed by the developing unit 5 to be transferred onto the intermediate transfer belt 10 (transferred body), and the drum cleaning unit 6 that removes the toner remaining on the surface of the photosensitive drum 3 after the transfer process. By using the photosensitive drum 3 having the flange members 35 with the features of the embodiments that provide a high runout accuracy in the copy machine 500, development of variations in the distance between the surface of the photosensitive drum 3 and a process unit, such as the charging unit 4 or the developing unit 5, for example, can be prevented. Thus, the density irregularities due to charge irregularities or development irregularities can be prevented. Further, in the case of the tandem-type image forming apparatus illustrated in FIG. 2, positional error of the position at which a toner image is formed due to the runout of the photosensitive drum 3 can be prevented, so that an image error in a multi-color image can be minimized, and a high-quality image can be provided.

The printer 600 according to Embodiment 2 includes an image forming apparatus having the photosensitive drum 3, the charging unit 4 that charges the photosensitive drum 3, the exposing apparatus (latent-image forming unit; not illustrated) that forms an electrostatic latent image on the surface of the photosensitive drum 3 charged by the charging unit 4, the developing unit 5 that attaches toner to the electrostatic latent image formed by the exposing apparatus, the transfer charger 70 (transfer unit) that transfers the toner image formed by the developing unit 5 onto the transfer sheet P (transferred body), and the drum cleaning unit 6 that removes the toner remaining on the surface of the photosensitive drum 3 after the transfer process. By using the photosensitive drum 3 having the flange members 35 with the inventive features in the printer 600, development of variations in the distance between the surface of the photosensitive drum 3 and the charging unit 4 or the developing unit 5, for example, can be prevented because of the high runout accuracy of the photosensitive drum 3. Thus, density irregularities due to charge irregularities or development irregularities can be prevented.

Although this invention has been described in detail with reference to certain embodiments, variations and modifications exist within the scope and spirit of the invention as described and defined in the following claims.

The present application is based on Japanese Priority Applications No. 2010-254183 filed Nov. 12, 2010 and 2010-254187 filed Nov. 12, 2010, the entire contents of which are hereby incorporated by reference.

The invention claimed is:

1. A flange member comprising:

a press-fitted portion configured to be press-fitted in an end-opening portion at an end of a hollow and cylindrical sleeve member in an axial direction of the sleeve member;

an axle opening portion including an axle opening into which a shaft member is inserted at a position corresponding to a central axis of the sleeve member when the press-fitted portion is press-fitted in the end-opening portion; and a linking portion extending in a direction parallel to a circular cross section of the sleeve member upon press fitting of the flange member, the linking portion connecting the axle opening portion to the press-fitted portion, wherein the linking portion includes plural stress-absorbing portions, each stress-absorbing portion configured to be deformed so as to absorb a stress to which an outer peripheral surface of the press-fitted portion is subjected upon contact with an inner peripheral surface of the sleeve member when the press-fitted portion is press-fitted in the end-opening portion, thus preventing the stress from being transmitted to the axle opening portion via the linking portion, wherein for every possible imaginary line drawn from a circumference of an imaginary projected circle to the axle opening portion, at least one of the plural stress-absorbing portions is disposed on said imaginary line drawn from a circumference of the imaginary projected circle to the axle opening portion, the imaginary projected circle being a projection of the outer peripheral surface of the press-fitted portion on an imaginary plane perpendicular to the axial direction and including the linking portion, and wherein each stress-absorbing portion includes an opening through the linking portion in the axial direction.

2. The flange member according to claim 1, wherein the opening is filled with a resilient material that is more readily deformable than a material of the linking portion.

3. The flange member according to claim 1, wherein the stress-absorbing portion includes a concave portion having a thickness less than a thickness of portions of the linking portion around the concave portion.

4. The flange member according to claim 1, wherein a boundary between the stress-absorbing portion and portions around the stress-absorbing portion includes a substantially straight side that perpendicularly intersects a radius of the imaginary projected circle.

5. The flange member according to claim 1, wherein the stress-absorbing portion includes a substantially straight side that perpendicularly intersects an imaginary line extending in a radial direction of the circular cross section when the flange member is press-fitted in the sleeve member.

6. The flange member according to claim 1, wherein the number of the stress-absorbing portions disposed on a circumference at the same distance from a central position of the axle opening in a radial direction of the circular cross section when the flange member is press-fitted in the sleeve member is 2 or more and 180 or less.

7. The flange member according to claim 1, wherein the number of the stress-absorbing portions that intersect an imaginary line drawn from a central position of the axle opening to a circumference of the imaginary projected circle is 2 or more and 33 or less.

8. The flange member according to claim 1, wherein, when the flange member is press-fitted in the sleeve member, an interval between the stress-absorbing portions adjacent to each other on a circumference having the same distance from a central position of the axle opening in a radial direction of the circular cross section is 1 mm or more and 280 mm or less.

9. The flange member according to claim 1, wherein an interval of the stress-absorbing portions adjacent to each other that intersect an imaginary line drawn from a central position of the axle opening to a circumference of the imaginary projected circle is 1 mm or more and 130 mm or less.

10. A photosensitive drum comprising:

a hollow and cylindrical sleeve member having a photosensitive layer on an outer peripheral surface of the sleeve member; and the flange member according to claim 1 press-fitted in an end-opening portion at an end of the sleeve member in an axial direction of the sleeve member.

11. A process cartridge that can be attached to or detached from an image forming apparatus main body, the process cartridge comprising:

a photosensitive body;

a charging unit configured to charge the photosensitive body;

a latent-image forming unit configured to form an electrostatic latent image on a surface of the photosensitive body charged by the charging unit;

a developing unit configured to attach toner onto the electrostatic latent image formed by the latent-image forming unit;

a transfer unit configured to transfer a toner image formed by the developing unit onto a transferred body;

a cleaning unit configured to remove the toner from the surface of the photosensitive body after the toner image is transferred onto the transferred body, wherein the photosensitive body includes the photosensitive drum according to claim 10.

12. An image forming apparatus comprising:

a photosensitive body;

a charging unit configured to charge the photosensitive body;

a latent-image forming unit configured to form an electrostatic latent image on a surface of the photosensitive body charged by the charging unit;

a developing unit configured to attach toner to the electrostatic latent image formed by the latent-image forming unit;

a transfer unit configured to transfer a toner image formed by the developing unit onto a transferred body;

a cleaning unit configured to remove the toner from the surface of the photosensitive body after the toner image is transferred onto the transferred body, wherein the photosensitive body includes the photosensitive drum according to claim 10.

13. An image forming method comprising:

uniformly charging a surface of a photosensitive body;

forming an electrostatic latent image on the charged surface of the photosensitive body;

forming a toner image by supplying toner to the electrostatic latent image formed on the surface of the photosensitive body; and transferring the toner image formed on the surface of the photosensitive body onto a transferred body, wherein the photosensitive body includes the photosensitive drum according to claim 10.

14. The flange member according to claim 1, wherein each stress-absorbing portion has a cross-sectional shape extending in a direction other than a radial direction of the flange member.

* * * * *